US006146802A

United States Patent [19]

Okada et al.

[11] Patent Number: 6,146,802

[45] Date of Patent: Nov. 14, 2000

[54] TONER AND DEVELOPMENT UNIT AND IMAGE FORMING APPARATUS USING THE SAME

[75] Inventors: Hideki Okada; Kazuhiro Ichikawa; Hiroshi Ito; Toshiya Takahata, all of Nagano, Japan

[73] Assignee: Seiko Epson Corporation, Tokyo, Japan

[21] Appl. No.: 09/361,859

[22] Filed: Jul. 27, 1999

[30] Foreign Application Priority Data

| | | | |
|---|---|---|---|
| Jul. 27, 1998 | [JP] | Japan | 10-211375 |
| Jul. 27, 1998 | [JP] | Japan | 10-211376 |
| Jul. 27, 1998 | [JP] | Japan | 10-211377 |
| Jul. 27, 1998 | [JP] | Japan | 10-211378 |
| Jul. 27, 1998 | [JP] | Japan | 10-211379 |
| Apr. 2, 1999 | [JP] | Japan | 11-095867 |

[51] Int. Cl.[7] ..... G03G 9/08

[52] U.S. Cl. ..... 430/110; 430/111; 399/297

[58] Field of Search ..... 430/106, 109, 430/110, 111; 399/297

[56] References Cited

U.S. PATENT DOCUMENTS

| | | | |
|---|---|---|---|
| 5,066,558 | 11/1991 | Hikake et al. | 430/109 |
| 5,512,406 | 4/1996 | Takeda et al. | 430/110 |
| 5,659,858 | 8/1997 | Kunugi et al. | 399/252 |
| 5,840,458 | 11/1998 | Kido et al. | 430/111 |
| 5,976,750 | 11/1999 | Hagi et al. | 430/110 |
| 5,998,079 | 12/1999 | Thompson et al. | 430/106 |

FOREIGN PATENT DOCUMENTS

| | | |
|---|---|---|
| 2170917 | 8/1986 | United Kingdom . |

*Primary Examiner*—John Goodrow

*Attorney, Agent, or Firm*—Sughrue, Mion, Zinn, Macpeak & Seas, PLLC

[57] ABSTRACT

A toner comprising: a plurality of mother particles; and a plurality of external additive particles to be attached to the mother particles, the external additive particles including external additive particles attached to the mother particle and external additive particles liberated from the mother particles, wherein an inclination (particle sizes of the external additives/particle sizes of the mother particles) of an approximation straight line obtained by approximating distribution of particle sizes of the external additives with respect to the particle sizes of the mother particles by a least-square method is not larger than 0.6. Also, disclosed is an image forming apparatus using the toner.

28 Claims, 26 Drawing Sheets

TONER AND DEVELOPMENT UNIT AND IMAGE FORMING APPARATUS USING THE SAME

FIELD OF THE INVENTION

A first aspect of the present invention relates to a technical field of a toner for developing an electrostatic latent image formed on a latent-image carrier and a technical field of an image forming apparatus arranged to transfer a developed image obtained by developing the electrostatic latent image positioned on the latent-image carrier to a transfer member, such as paper, and fixing the transferred image positioned on the transfer member. More particularly, the first aspect of the present invention relates to a technical field of a toner which exhibits satisfactory fluidity and electrification characteristic and a technical field of an image forming apparatus constituted to remove residual toner left on a latent-image carrier by performing a cleaning process.

A second aspect of the present invention relates to a technical field of a toner for developing an electrostatic latent image formed on a latent-image carrier and a technical field of an image forming apparatus arranged to transfer a developed image obtained by developing the electrostatic latent image positioned on the latent-image carrier to a transfer member, such as paper, and fixing the transferred image positioned on the transfer member. More particularly, the second aspect of the present invention relates to a technical field of a toner which exhibits satisfactory fluidity and electrification characteristic and a technical field of an image forming apparatus constituted to prevent adhesion of the transfer member to a fixing unit during a fixing process.

A third aspect of the present invention relates to a technical field of a toner for developing an electrostatic latent image formed on a latent-image carrier and a technical field of a development unit for causing a toner carrier to carry toner to move toner to a latent-image carrier and developing the electrostatic latent image on the latent-image carrier with toner. More particularly, the present invention relates to a technical field of a toner having excellent fluidity and an electrification characteristic and a technical field of a development unit equipped with a toner-regulating member for forming a uniform thin layer on the toner carrier and performing uniform electrification toner.

A fourth aspect of the present invention relates to a technical field of a development unit for causing a toner carrier to carry a toner to move the same to the latent-image carrier so as to develop an electrostatic latent image on the latent-image carrier with the moved toner. More particularly, the present invention relates to a technical field of a development unit equipped with a toner-regulating member for forming a uniform thin layer of a toner in which a plurality of external additives adhere to a plurality of mother particles.

A fifth aspect of the present invention relates to a technical field of a toner for developing an electrostatic latent image on a latent-image carrier and a technical field of a development unit for causing a toner carrier to carry a toner to move the same to a latent-image carrier and developing the electrostatic latent image on the latent-image carrier with the moved toner. More particularly, the present invention relates to a technical field of a toner having excellent fluidity and an electrification characteristic and a technical field for a development unit equipped with a toner-regulating member for forming a uniform thin layer on the toner carrier and performing uniform electrification of the toner.

A sixth aspect of the present invention relates to a technical field of a toner for developing an electrostatic latent image on a latent-image carrier (hereinafter called an "OPC") and a technical field of an image forming apparatus arranged to transfer a toner image obtained by developing the electrostatic latent image on the OPC with the toner to a transfer member such as paper. More particularly, the present invention relates to a technical field of a toner which makes it possible to efficiently transfer a toner image even with respect to a transfer member such as rough paper, to which an image cannot easily be transferred, and to stabilize a toner image on the transfer member in both of short time and long time aspects, and a technical field of an image forming apparatus using the toner.

BACKGROUND OF THE INVENTION

1. Image forming apparatuses are constituted to use a toner to develop an electrostatic latent image formed on a latent-image carrier and transfer the developed image to a transfer member, such as paper, so that a transferred image of the exposed electrostatic latent image positioned on the latent-image carrier is obtained on the transfer member.

FIG. 10 is a schematic view showing an intermediate transfer type full-color image forming apparatus as an example of the conventional image forming apparatus.

As shown in FIG. 10, the image forming apparatus 101 is constituted such that an image is exposed on a latent-image carrier (hereinafter sometimes called an "OPC") 102 so that an electrostatic latent image is formed. Moreover, the electrostatic latent image on the OPC 102 is sequentially (the order of colors may be determined arbitrarily) developed by yellow, magenta, cyan and black development units 103, 104, 105 and 106 so as to be formed into a visible image. Then, color matching of the developed image on the OPC 102 is performed by a transferring unit 107, and then transferred to a transfer paper 108 which is one example of transfer members. Then, the transfer image is fixed by a fixing unit 109. As a result, a required image is obtained on the transfer paper 108.

After the developed image has been transferred to the transfer paper 108, residual toner T' left on the OPC 102 is removed by a cleaning blade 110 so as to be gathered into a residual toner box 111.

Toner T for use in the conventional image forming apparatus 101 is described below. Toner T supplied from the toner supply members 103*c*, 104*c*, 105*c* and 106*c* of the development units and placed on the toner carriers 103*a*, 104*a*, 105*a* and 106*a* is, by the toner-regulating members 103*b*, 104*b*, 105*b* and 106*b*, formed into a uniform layer and uniformly electrified. Then, toner T is moved to the OPC 102. To reliably move toner T to the OPC 102 through spaces between the toner carriers 103*a*, 104*a*, 105*a* and 106*a* and the toner blades 103*b*, 104*b*, 105*b* and 106*b*, toner T must have satisfactory fluidity and excellent electrification characteristic. Therefore, conventional toner T has a constitution that external additives 13 composed of silica ($SiO_2$) are allowed to adhere to the surfaces of mother particles 12 made of a resin as shown in FIG. 11 to improve the fluidity and electrification characteristics thereof.

Toner T produced such that the external additives 13 are allowed to adhere to the mother particles 12 also includes the external additives 13 liberated from the mother particles 12. The liberated external additives 13 are relatively hard as compared with the mother particles 12. When the liberated external additives 13 contained in residual toner T' are removed by the cleaning blade 110, the liberated external additives 13 are fixed to a contact portion (a nip portion) 102*a* of the OPC 102 with the cleaning blade 110 as shown in FIG. 12 so that the external additives 13 remain. As a result, so-called filming occurs. If filming occurs, an image having a satisfactory quality cannot be obtained.

Therefore, a technique for preventing occurrence of filming has been suggested in Japanese Patent Publication No. 7-99438 by reducing coagulation (aggregation) of the external additives 13 liberated from the mother particles 12 of toner T for use in the image forming apparatus 1.

According to the foregoing disclosure, occurrence of the filming at the cleaning blade 110 due to the external additives 13 can be somewhat reduced.

The inventors of the present invention has variously studied about filming, thus resulting in a fact that external additives 13 allowed to adhere to the mother particles 12 of toner T also can fix to the cleaning blade 110 so that filming occurs. That is, stress is repeatedly exerted on the external additives 13 allowed to adhere to the mother particles 12 when a contact development is performed in which the external additives 13 are brought into contact with the OPC 102 and when a contact transfer is performed in which the external additives 13 are brought into contact with the transferring unit 107 during the process for developing an electrostatic latent image on the OPC 102 and the process for transferring a developed image on the OPC 102. As a result of the stress, the external additives 13 are liberated from the mother particles 12.

Even if coagulation (aggregation) of the external additives 13 liberated from the mother particles 12 in toner T is reduced as disclosed in the foregoing disclosure, the external additives 13 liberated from the mother particles 12 owning to the stress undesirably remain in the nip portion 102*a* of the OPC 102. Thus, external additives 13 are fixed to the nip portion 102*a*. Thus, filming occurs.

If the external additives 13 in the form of the coagulation do not exist in toner T, existence of the liberated external additives 13 having a small particle size in a large amount causes secondary coagulation of the external additives 13 to occur. The secondary coagulation is caused from electrostatic coagulation which occurs during contact development with the OPC 102 when the development process is performed and contact transfer with the transferring unit 107. Stress of toner T which is exerted during the contact development with the OPC 102 is usually larger than stress in the development unit. The development unit for use in a high image quality development system is generally arranged to rotate at different peripheral speed with respect to the OPC 102. Therefore, a fact has been detected that great stress is exerted on toner T and, thus, secondary coagulation of the external additives 13 easily occurs.

As described above, the disclosed toner cannot prevent occurrence of coagulation caused from the secondary coagulation of the external additives 13 liberated from the mother particles 12 in toner T. Therefore, occurrence of filming cannot satisfactorily and effectively be prevented.

In addition, there is a concern that the external additives are liberated from the mother particles when stress is repeatedly exerted on toner during contact development and contact transfer. Therefore, the lifetime of toner is limited. That is, elongation of the lifetime of toner cannot be expected.

2. FIG. 20 is a schematic view showing an intermediate transfer type full-color image forming apparatus as an example of the conventional image forming apparatus.

As shown in FIG. 20, the image forming apparatus 201 is constituted such that an image is exposed on to a latent-image carrier (hereinafter sometimes called an "OPC") 202 so that an electrostatic latent image is formed. Moreover, the electrostatic latent image on the OPC 202 is sequentially (the order of colors may be determined arbitrarily) developed by yellow, magenta, cyan and black development units 203, 204, 205 and 206 so as to be formed into a visible image. Then, color matching of the developed image on the OPC 202 is performed by a transferring unit 207, and then transferred to transfer paper 208 which is one of transfer members. Then, the transfer image is fixed by a fixing unit 209. As a result, a required image is obtained on the transfer paper 208.

After the developed image is transferred to the transfer paper 208, residual toner T' left on the OPC 202 is removed by a cleaning blade 210 so as to be gathered in a residual toner box 211.

Toner T for use in the conventional image forming apparatus 201 is described below. Toner T supplied from the toner supply members 203*c*, 204*c*, 205*c* and 206*c* of the development units and placed on the toner carriers 203*a*, 204*a*, 205*a* and 206*a* is, by toner-regulating members 203*b*, 204*b*, 205*b* and 206*b*, formed into a uniform layer and uniformly electrified. Then, toner T is moved to the OPC 202. To reliably move toner T to the OPC 202 through spaces between the toner carriers 203*a*, 204*a*, 205*a* and 206*a* and the toner blades 203*b*, 204*b*, 205*b* and 206*b*, toner T must have satisfactory fluidity and excellent electrification characteristic. Therefore, conventional toner T has a constitution that external additives 13 composed of silica ($SiO_2$) are allowed to adhere to the surfaces of mother particles 12 made of a resin as shown in FIG. 11 to improve the fluidity and electrification characteristics thereof.

Toner T comprising the external additives 13 allowed to adhere to the mother particles 12 has the characteristics as shown in FIG. 21 that the mother particles 12 has higher adhesive property as compared with that of a heating member 209*a* of the fixing unit 209. On the other hand, the external additives 13 have low adhesive property as compared with that of the heating member 209*a* of the fixing unit 209. If toner T on the transfer paper 208 is toner T which smoothly adhere to the mother particles 12 of the external additives 13, the external additives 13 exist at an interface between the heating member 209*a* of the fixing unit 209 and toner T on the transfer paper 208 when the transferred image on the transfer paper 208 is fixed. Therefore, adhesion between the heating member 209*a* and toner T on the transfer paper 208 is considerably reduced. Therefore, so-called offset of toner T with which toner T on the transfer paper 208 adheres to the heating member 209*a* does not occur.

If toner T on the transfer paper 208 is toner T which does not smoothly adhere to the mother particles 12 of the external additives 13, substantially no external additives 13 exists at the interface between the heating member 209*a* and toner T on the transfer paper 208 during the fixing process. Therefore, the adhesion between the heating member 209*a* and toner T on the transfer paper 208 is undesirably enhanced. Therefore, offset of toner T occurs as shown in FIG. 21. Hence it follows that the transfer paper 208 undesirably wound to the heating member 209*a*.

Therefore, a technique has been suggested in Japanese Patent Publication No. 5-56501, in which toner is arranged such that specific inorganic fine particles having a separating function is mixed with toner T for use in the image forming apparatus 201. Thus, offset of toner occurring during the fixing process is prevented.

Toner disclosed as described above causes the specific inorganic fine particles exist between the surface of molten toner and the heating member during the fixing process. Thus, the separating characteristic of the specific inorganic fine particles prevents adhesion of toner T to the heating member. As a result, occurrence of offset can be prevented.

The inventors of the present invention has studied the offset of toner which occurs during the fixing process. As a result, toner T of the type having the external additives 13 allowed to adhere to the mother particles 12 is caused to be toner T forming the transferred image transferred to the surface of the transfer paper 208 and including toner in which the external additives 13 are liberated and inhibited from satisfactory adhesion to the mother particles 12. The reason for this lies in that stress is repeatedly exerted on the external additives 13 allowed to adhere to the mother particles 12 when a contact development is performed in which the external additives 13 are brought into contact with the OPC 202 and when a contact transfer is performed in which the external additives 13 are brought into contact with the transferring unit 207. As a result of the stress, the external additives 13 are liberated from the mother particles 12.

Even if the specific inorganic fine particles are mixed with toner as employed in the foregoing disclosure, the stress sometimes causes the specific inorganic fine particles to be liberated from the mother particles. Therefore, there is a concern that the offset of toner cannot effectively be prevented.

As described above, the disclosed toner cannot necessarily prevent liberation of the specific inorganic fine particles from the mother particles which occurs owning to the stress which is exerted during the contact development process and the contact transfer process. Therefore, occurrence of the offset of toner cannot satisfactorily and effectively be prevented. In addition, the disclosed toner cannot reliably prevent liberation of the specific inorganic fine particles from the mother particles. To prevent occurrence of the offset, the lifetime of toner is limited. That is, elongation of the lifetime of toner cannot be expected.

3. As shown in FIG. 26, a conventional development unit 301 is arranged to develop an electrostatic latent image on the surface of a latent-image carrier with toner. Toner in a toner-accommodating portion 302 moved to a toner supply member 304 by a toner-carrying member 303. Then, toner T is supplied to a toner carrier 305 by the toner supply member 304 so as to be held on the surface of the toner carrier 305. Moreover, toner T on the toner carrier 305 is formed into a uniform thin layer by a toner-regulating blade 306. Moreover, toner T is uniformly electrified, and then moved to a latent-image carrier 307. Toner T is used to develop an electrostatic latent image on the latent-image carrier 307 so as to be visualized.

Toner T for use in the conventional and usual development unit 301 is allowed to pass through a space between the toner carrier 305 and the toner-regulating blade 306 so as to be moved to the latent-image carrier 307 when toner T on the toner carrier 305 is formed into the uniform thin layer and uniformly electrified by the toner-regulating blade 306. Toner T must pass through the space between the toner carrier 305 and the toner-regulating blade 306 so as to be formed into the uniform thin layer and electrified uniformly so as to be moved to the latent-image carrier 307. Therefore, toner T must have satisfactory fluidity and excellent electrification characteristic. Therefore, as shown in FIG. 11, conventional toner T has a constitution that external additives 13 composed of silica ($SiO_2$) are allowed to adhere to the surfaces of mother particles 12 composed of a resin. Thus, the required fluidity and electrification characteristic have been obtained.

The particle sizes of particles of toner T, however, vary considerably. Moreover, adhesion of the external additives 13 to the mother particles 12 is not always uniformly and sufficiently performed. Hence it follows that toner T having unsatisfactory fluidity and electrification characteristic is formed. If toner T of the foregoing type is moved to a contact portion (hereinafter also called a "nip portion") of the toner-regulating blade 306 with the toner carrier 305, toner T cannot pass through the space between the toner carrier 305 and the toner-regulating blade 306, as shown in FIG. 27. Thus, toner T is selectively left in the nip portion and retention of toner T occur. If toner T having unsatisfactory fluidity, electrification characteristic and large particle sizes is moved and retained in the nip portion. The retained toner T having the large particle size undesirably forms a movement stripe on the toner carrier 305.

If the foregoing movement stripe is formed on the toner carrier 305, only toner T having satisfactory fluidity, electrification characteristic and small and intermediate particle sizes is selectively moved to the latent-image carrier 307. Therefore, an excellent image quality cannot be realized.

4. As shown in FIG. 30, a conventional one-component development unit 401 uses a usual one-component developer such that a one-component developer composed of toner is used to develop an electrostatic latent image formed on the surface of a latent-image carrier. In the development unit 401, toner serving as the one-component developer in the toner-accommodating portion 402 is moved to a toner supply roller 404 by a toner-carrying member 403. Then, toner T is supplied to a developer carrier 405 by a toner supply roller 404 so as to be held on the surface of the developer carrier 405. Then, toner T on the developer carrier 405 is formed into a uniform thin layer and uniformly electrified by a toner-regulating blade 406 so as to be moved to the latent-image carrier 407. Toner T is used to develop an electrostatic latent image on the latent-image carrier 407 so as to be visualized.

Toner T for use in the conventional and usual development unit 401 is allowed to pass through a space between the developer carrier 405 and the toner-regulating blade 406 so as to be moved to the latent-image carrier 407 when toner T on the developer carrier 405 is formed into the uniform thin layer and uniformly electrified by the toner-regulating blade 406.

When the developer carrier 405 in a state in which the toner-regulating blade 406 has been made contact with the developer carrier 405 is rotated at high speed to obtain a large amount of image at high speed by the one-component development method, a portion of toner T cannot pass through the space between the developer carrier 405 and the toner-regulating blade 406, as shown in FIG. 31. The portion of toner T is sometimes and undesirably fixed to a contact portion (hereinafter called a "nip portion") **406*a* of the toner-regulating blade 406 in which the toner-regulating blade 406 is made contact with the developer carrier 405. The fixed toner T" causes unevenness to occur during the process of the developer carrier 405** to move toner. Therefore, the conventional one-component development method encounters frequent occurrence of unevenness of the density of a formed image in a form of a longitudinal stripe.

Toner T must pass through the space between the developer carrier 405 and the toner-regulating blade 406 so as to be formed into a uniform thin layer and uniformly electrified. Then, toner T is moved to the latent-image carrier 407.

To achieve this, toner T must have satisfactory fluidity and excellent electrification characteristic. Therefore, as shown in FIG. 11, conventional toner T has a constitution that external additives 13 composed of silica ($SiO_2$) are allowed to adhere to the surfaces of mother particles 12 composed of a resin. Thus, the required fluidity and electrification characteristic have been obtained.

The particle sizes of particles of toner T, however, vary considerably. Moreover, adhesion of the external additives 13 to the mother particles 12 is not always uniformly and sufficiently performed. Hence it follows that toner T having unsatisfactory fluidity and electrification characteristic is formed. If toner T of the foregoing type is moved to the nip portion 406*a* of the toner-regulating blade 406, also toner T of the foregoing type cannot pass through the space between the developer carrier 405 and the toner-regulating blade 406. As a result, toner T is undesirably fixed to the nip portion 406*a* of the toner-regulating blade 406. Thus, the fixed toner T" causes unevenness to occur in moving toner T as described above. As a result, unevenness in the density of the image in the form of a longitudinal stripe takes place.

Therefore, a development unit has been disclosed in Japanese Patent Laid-Open No. 6-11879, which is constituted such that a film-thickness-regulating member made contact with a rotative developer carrier which carries toner is worn owning to friction with the developer carrier before toner is fixed. Thus, it is attempted to prevent fixation of toner to the film-thickness-regulating member.

The disclosed development unit enables the portion of the film-thickness-regulating member, to which toner will be fixed, to be removed before the fixation of toner. As a result, fixation of toner hardly occurs.

The development unit disclosed as described above and constituted such that the film-thickness-regulating member is worn encounters limitation for use of the film-thickness-regulating member. As a result, the development unit cannot easily be used for a long time. That is, there arises a problem in that the durability of the development unit is unsatisfactory.

The development unit disclosed as described above requires the film-thickness-regulating member having a special shape and made of a special material. In addition, the film-thickness-regulating member is brought into contact with the developer carrier when the film-thickness-regulating member has been worn. Therefore, the film-thickness-regulating member must be pressed against the developer carrier by a pressing member. As a result, there arises a problem in that the film-thickness-regulating member has a too complicated structure and cost cannot easily be reduced.

Moreover, control is required such that pressing of the film-thickness-regulating member by means of the pressing member is performed substantially uniformly. It leads to a fact that the structures of the film-thickness-regulating member and the pressing member are excessively complicated. Thus, there arises a problem in that the foregoing members cannot easily be manufactured. Since the film-thickness-regulating member must have a special shape and a special material and the pressing member is required, the foregoing structure cannot easily be applied to the conventional development unit. Therefore, there arises a problem in that general versatility cannot be realized.

5. The reason why the above-described fixation of toner T' to the developer-regulating member 406 occurs is considered as follows. Toner T, in which the concentration of the external additives 13 is lower than a predetermined concentration, which has a low coverage of external additives and which has a small particle size is, by physical adhesive force, allowed to adhere to a contact portion between the developer-regulating member 406 and the developer carrier 405. Then, toner T is repeatedly slides and rubbed between the developer-regulating member 406 and the developer carrier 405 which moves at high speed. Thus, thermomechanical stress is exerted on toner T. Toner T having a low coverage of the external additives and a small particle size has a problem in that thermal deformation easily occurs because its thermal capacity is reduced according to the small volume. Moreover, movement caused from flow of toner does not easily occur because the coverage of the external additives is low. Therefore, when thermomechanical stress is, from outside, exerted on toner T having the low coverage of external additives is low and a small particle size, toner T cannot disperse the stress to the surrounding portions. Therefore, toner T is undesirably deformed. As a result, toner T having the deformed shape is joined to adjacent toner and the surface of the developer-regulating member 406. Thus, fixation of toner T occurs.

Fixed toner T" causes unevenness in the movement of toner similarly to the foregoing description. Thus, unevenness in the density of the images in the form of a longitudinal stripe takes place.

6. A conventional image forming apparatus of conventional type encounters a fact that the gradation expression is improved as the particle size of toner is reduced. Thus, the image quality can be improved, causing the resolution of a developed image on the OPC to be improved. On the other hand, a transferred image transferred from the OPC to the transfer member encounters a fact that the resolution realized by transfer excessively deteriorates as the particle size of toner is reduced.

A mono-color image forming apparatus, which is attempted to be capable of obtaining a transferred image having a high resolution even if the particle size of toner is reduced, has been suggested in Japanese Patent Laid-Open No. 3-170979. The image forming apparatus disclosed as described above is constituted to directly press transfer paper against a toner image developed on the OPC. Thus, the toner image is physically transferred on the transfer paper. As a result, flying and retention from transfer can be reduced to improve the efficiency in transferring. Thus, a transferred image having a high resolution can be obtained.

The reduction in the particle size of toner, however, causes its fluidity to deteriorate. As the fluidity of toner deteriorates, missing of an intermediate portion of a characteristic or a line occurs.

Therefore, the foregoing disclosure has disclosed a technique that toner is covered with silica (for example, mother particles of toner are added and covered with external additives ($SiO_2$) as shown in FIG. 11 in spite of omission from the disclosure) to improve the fluidity of toner. Tests were performed to measure change in the fluidity and that in the ratio of missing of an intermediate portion in a line having a thickness of 300 $\mu$m when the amount of silica, which is added to toner having a particle size of 7 $\mu$m, has been changed from 0.2 wt % to 2.0 wt %. When the amount of silica, which is added, is made to be 0.4 wt % or larger, the ratio of missing of an intermediate portion can be lowered to be 5% or lower. As a result, missing of an intermediate portion cannot be recognized as a defective image by the unaided eyes. Thus, an image exhibiting excellent gradient and sharpness can be obtained.

Full color image forming apparatuses, such as color printers, have been developed in recent years. FIG. 41 is a schematic view showing an intermediate transfer type color printer which is an example of a conventional full color image forming apparatus.

Referring to FIG. 41, in the color printer 601, a print command signal (an image forming signal) supplied from a computer (not shown) is supplied to a control unit (not shown) of the color printer 601. As a result, rotations of the following units in predetermined directions are performed: an OPC 602, development units 603, 604, 605 and 606 for developing corresponding colors (yellow, magenta, cyan and black) (the order of the development units corresponding to the foregoing colors is arbitrarily), development rollers 603*a*, 604*a*, 605*a* and 606*a* which are toner carriers and an intermediate transfer medium (a drum may be substituted for an illustrated transfer belt) 607. Then, the outer surface of the OPC 602 is uniformly electrified to surface potential of $V_o$ by an electrifying roller 608 arranged to apply voltage $V_a$.

Then, selective exposure to the outer surface of the OPC 602, which has uniformly been electrified, in accordance with image information of yellow, which is a first color, is performed by an exposing unit. Thus, an electrostatic latent image in yellow is formed. Then, only a development roller 603*a* of a development unit 603 for yellow is brought into contact with the OPC 602. Moreover, toner is electrified with development bias voltage $V_b$ of the development roller 603*a* so as to be moved to the OPC 602. Therefore, an electrostatic latent image for yellow on the OPC 602 is developed with toner so that a yellow toner image is formed on the OPC 602. The yellow toner image formed on the OPC 602 is primarily be transferred to the intermediate transfer medium 607 so that a yellow toner image is formed. At this time, a secondary transfer roller 607*a* and a cleaning blade 609 are brought to a state in which they are positioned apart from the intermediate transfer medium 607.

Residual toner T' is left on the OPC 602 after the primary transfer of the yellow toner image has been completed. Residual toner T' is removed by a cleaning blade 610 of the OPC 602 so as to be gathered in a residual toner box 611. Then, the OPC is destaticized by destaticizing light. Then, the exposing unit is again operated to perform selective exposure in accordance with image information of magenta which is a second color. Then, the development roller 603*a* of the development unit 603 is moved apart from the OPC 602. Moreover, only the development roller 604*a* of the development unit 604 is brought into contact with the OPC 602. As a result, an electrostatic latent image for magenta on the OPC 602 is developed so that a magenta toner image is formed on the OPC 602. Similarly to the process for forming the yellow image, the magenta toner image is primarily transferred to the intermediate transfer medium 607 so that a magenta toner image is formed. Then, residual toner on the OPC 602 is removed by the cleaning blade 610. Moreover, the OPC 602 is destaticized. Then, similar operations are performed for cyan, which is a third color and black which is a fourth color. Thus, the four colors are matched on the intermediate transfer medium 607 so that toner image in four colors is formed on the intermediate transfer medium 607.

After the toner image in the four colors has been formed on the intermediate transfer medium 607 owning to the primary transfer, the secondary transfer roller 607*a* is pressed against the intermediate transfer medium 607. Thus, the toner image in the four colors on the intermediate transfer medium 607 is transferred to the transfer member 612. Moreover, a cleaning blade 609 for the intermediate transfer medium 607 is brought into contact with the intermediate transfer medium 607. Then, residual toner T' left on the intermediate transfer medium 607 after the secondary transfer of the toner image to the transfer member 612 is remove by the cleaning blade 609. Similarly to the process for cleaning the OPC 602, residual toner T' is gathered in a residual toner box (not shown).

The toner image in the four colors formed on the transfer member 612 owning to the secondary transfer is allowed to pass through a fixing unit 613. Thus, the toner image is fixed to the surface of the transfer member 612. Then, paired discharge rollers (not shown) are rotated to discharge and accommodate the transfer member 612 having the fixed toner image in a case. Thus, a full color image is formed on the transfer member 612 by the color printer 601.

The transferring operation which is performed by the full color printer 601 encounters a problem in that unevenness in color occurs owning to missing of an intermediate portion when multilayered toner in the form of superimposition of four colors. In general, unevenness in color occurring owning to the missing of an intermediate portion can somewhat be obtained by enlarging the thickness of each color. However, the amount of exhaust toner is enlarged owning to residue from transfer. Thus, there arises a problem in that the cost cannot be reduced owning to wasteful use of toner.

Also the full color printer 601 may be constituted such that silica is added by 0.4 wt % or greater to overcome the problem of missing of an intermediate portion as disclosed in the foregoing disclosure. If rough paper is employed as the transfer member 612, simple increase in the amount of silica cannot overcome the problem of unevenness in color occurring owning to missing of an intermediate portion when transfer to the rough paper is performed.

Toner of a type coated with the external additive-synchronized toner in a sufficiently large amount encounters deterioration of toner after toner has been used for a long time. As a result, there arise problem in that transfer efficiency deteriorates and that stable color development cannot be performed.

As described above, the conventional image forming apparatus has been suffered from difficulty in efficiently transferring toner in the foregoing colors and stabilizing the color development in both of short time and long time aspects depending on the type of the transfer member 612 including rough paper.

SUMMARY OF THE INVENTION

In view of the foregoing, an object of the present invention, in a first aspect, is to provide a toner which is capable of furthermore reliably preventing occurrence of filming and furthermore elongating the lifetime thereof.

Another object of the present invention is to provide an image forming apparatus which is capable of preventing liberation of external additives from toner during contact development and contact transfer so as to be capable of furthermore preventing occurrence of filming.

In a second aspect, an object of the present invention is to provide a toner which is capable of furthermore reliably preventing occurrence of offset and furthermore elongating the lifetime thereof by preventing liberation of external additives from mother particles which occurs during contact development and contact transfer.

Another object of the present invention is to provide an image forming apparatus which is capable of preventing adhesion of a transfer member to a fixing unit by preventing occurrence of offset.

In a third aspect, an object of the present invention is to provide a toner having further improved fluidity and electrification characteristic regardless of the particle size.

Another objet of the present invention is to provide a development unit incorporating a toner-regulating member which is able to form a uniform thin layer of toner and uniformly electrify toner and which is capable of preventing formation of movement stripe.

In a fourth aspect, an object of the present invention is to provide a development unit which is capable of effectively preventing fixation of a toner to a toner-regulating member to prevent occurrence of unevenness in movement of the toner in the form of a longitudinal stripe and obtaining excellent image quality for a long time and which requires a simple structure and the cost of which can be reduced.

In a fifth aspect, an object of the present invention is to provide a toner having improved fluidization and an electrification characteristic.

Another object of the present invention is to provide a development unit which is capable of preventing fixation of toner to a toner-regulating member and preventing occurrence of unevenness in the movement of the toner.

In a sixth aspect, an object of the present invention is to provide a toner which enables efficient multilayer transfer free from missing of an intermediate portion to be performed such that only a smallest amount of the toner is required and stable color development is permitted in both of short time and long time aspects and an image forming apparatus using the toner.

Other objects and effects of the present invention will become apparent from the following description.

The first aspect of the present invention mainly relates to the following items 1) to 6).

1) A toner comprising:

a plurality of mother particles; and a plurality of external additive particles to be attached to said mother particles, said external additive particles including external additive particles attached to said mother particle and external additive particles liberated from said mother particles, wherein an inclination (particle sizes of said external additives/particle sizes of said mother particles) of an approximation straight line obtained by approximating distribution of particle sizes of said external additives with respect to the particle sizes of said mother particles by a least-square method is not larger than 0.6.

2) The toner according to the above 1), the proportion of the number of said external additive particles liberated from said mother particles is not higher than 5% based on the number of the entire toner particles.

3) The toner according to the above 1) or 2), wherein a value obtained by dividing the average of the equivalent particle sizes of said external additive particles attached to said mother particle with the average of the equivalent particle sizes of the entire external additive particles is larger than 1.

4) A toner comprising:

a plurality of mother particles; and a plurality of external additive particles to be attached to said mother particles, said external additive particles including external additive particles attached to said mother particle and external additive particles liberated from said mother particles, wherein a value obtained by dividing the average of the equivalent particle sizes of said external additive particles attached to said mother particle with the average of equivalent particle sizes of the entire external additive particles is larger than 1.

5) An image forming apparatus comprising:

a toner;

a latent-image carrier on which an electrostatic latent image is formed;

a development unit for developing the electrostatic latent image formed on said latent-image carrier by using said toner;

a transferring unit for transferring the developed image positioned on said latent-image carrier; and a cleaning member for cleaning residual toner left on said latent-image carrier after said transfer step, wherein said toner is a toner according to any one of the above 1) to 3).

6) An image forming apparatus comprising:

a toner;

a latent-image carrier on which an electrostatic latent image is formed;

a development unit for developing the electrostatic latent image formed on said latent-image carrier by using said toner;

a transferring unit for transferring the developed image positioned on said latent-image carrier; and a cleaning member for cleaning residual toner left on said latent-image carrier after said transfer step, wherein said toner is a toner according to the above 4).

The second aspect of the present invention mainly relates to the following items 7) to 16).

7) A toner comprising: a plurality of mother particles; and a plurality of external additive particles to be attached to said mother particles, and including toner particles comprising said mother particle having attached thereto said external additive particles and toner particles comprising said mother particle not having attached thereto said external additive particles, wherein an inclination (particle sizes of said external additive particles/particle sizes of said mother particles) of an approximation straight line obtained by approximating distribution of particle sizes of said external additive particles with respect to the particle sizes of said mother particles by a least-square method is not smaller than 0.4.

8) A toner comprising: a plurality of mother particles; and a plurality of external additive particles to be attached to said mother particles, and including toner particles comprising said mother particle having attached thereto said external additive particles and toner particles comprising said mother particle not having attached thereto said external additive particles, wherein a value obtained by dividing the average of the equivalent particle sizes of said toner particles each comprising said mother particle having attached thereto said external additive particles with the average of the equivalent particle sizes of the entire toner particles is larger than 1.

9) The toner according to the above 7), wherein a percentage of the number of said toner particles each comprising said mother particle having attached thereto said external additive particles and the number of the entire toner particles is not lower than 60%.

10) The toner according to the above 8), wherein a percentage of the number of said toner particles each comprising said mother particle having attached thereto said external additive particles and the number of the entire toner particles is not lower than 60%.

11) The toner according to the above 7) or 8), wherein said mother particles and said external additive particles have polarities different from each other.

12) The toner according to the above 9), wherein said mother particles and said external additive particles have polarities different from each other.

13) The toner according to the above 11), wherein the polarity of said mother particles is positive, and the polarity of said external additive particles is negative.

14) The toner according to the above 12), wherein the polarity of said mother particles is positive, and the polarity of said external additive particles is negative.

15) An image forming apparatus comprising:

a toner;

a latent-image carrier on which an electrostatic latent image is formed;

a development unit for developing the electrostatic latent image formed on said latent-image carrier by using said toner;

a transferring unit for transferring the developed image positioned on said latent-image carrier; and a fixing unit for fixing the transferred image positioned on said latent-image carrier, wherein said toner is a toner according to the above 7).

16) An image forming apparatus comprising:

a toner;

a latent-image carrier on which an electrostatic latent image is formed;

a development unit for developing the electrostatic latent image formed on said latent-image carrier by using said toner;

a transferring unit for transferring the developed image positioned on said latent-image carrier; and a fixing unit for fixing the transferred image positioned on said latent-image carrier, wherein said toner is a toner according to any one of the above 8) to 14).

The third aspect of the present invention mainly relates to the above item 8) and the following items 17) and 18).

17) A development unit comprising:

a toner;

a toner carrier for carrying said toner;

a toner supply member for supplying toner to said toner carrier; and a toner-regulating member for limiting movement of toner such that a uniform thin layer of said toner is formed on said toner carrier, wherein said toner is a toner according to the above 8).

18) The development unit according to the above 17), further comprising a bias voltage apply member disposed between said toner carrier and said toner supply member and arranged to apply bias voltage in a direction in which toner is moved from said toner supply member to said toner carrier owning to the difference in the potential.

The fourth aspect of the present invention mainly relates to the following items 19) to 21).

19) A development unit comprising:

a toner;

a toner carrier for carrying said toner; and a toner-regulating member for limiting movement of toner such that a uniform thin layer of said toner is formed on said toner carrier, wherein said toner comprises: a plurality of mother particles; and a plurality of external additive particles to be attached to said mother particles, and including: toner particles having an external additive concentration not lower than a predetermined concentration; and toner particles having an external additive concentration lower than a predetermined concentration wherein said toner has a proportion of the number of said toner particles having an external additive concentration lower than a predetermined concentration based on the number of the entire toner particles of not higher than 30%, and wherein said toner-regulating member comprises a soft elastic member.

20) The development unit according to the above 19), wherein said elastic member is a rubber or elastomer having an impact resilience of not lower than 10%.

21) The development unit according to the above 19) or 20), wherein when said toner-regulating member is used to contact with said toner with the edge thereof, said soft elastic member has a rubber hardness of 60 or lower, and when said toner-regulating member is used to contact with said with the body thereof, said soft elastic member has a rubber hardness of 30 or lower.

The fifth aspect of the present invention mainly relates to the following items 22) and 23).

22) A toner comprising: a plurality of mother particles; and a plurality of external additive particles to be attached to said mother particles, and including: toner particles having an external additive concentration not lower than a predetermined concentration; and toner particles having an external additive concentration lower than a predetermined concentration, wherein siad toner satisfy the following relationship:

$D1/D2<2$ wherein D1 represents the average of the equivalent particle sizes of the entire toner particles and D2 represents the average of the equivalent particle sizes of said toner particles having an external additive concentration lower than a predetermined concentration.

23) A development unit comprising:

a toner;

a toner carrier for carrying said toner; and a toner-regulating member for limiting movement of toner such that a uniform thin layer of said toner is formed on said toner carrier, wherein said toner is a toner according to the above 22).

The sixth aspect of the present invention mainly relates to the following items 24) to 28).

24) A toner comprising:

a plurality of mother particles; and a plurality of external additive particles to be attached to said mother particles, said external additive particles including external additive particles attached to said mother particle and external additive particles liberated from said mother particles, wherein an inclination (particle sizes of said external additives/particle sizes of said mother particles) of an approximation straight line obtained by approximating distribution of particle sizes of said external additives with respect to the particle sizes of said mother particles by a least-square method is not smaller than 0.4, and wherein the content of said liberated external additive particles is not lower than 1.0 wt % based on the total weight of said toner.

25) A toner comprising:

a plurality of mother particles; and a plurality of external additive particles to be attached to said mother particles, said external additive particles including external additive particles attached to said mother particle and external additive particles liberated from said mother particles, wherein said liberated external additive particles have a volume-based mean particle size of not smaller than 1.5 μm.

26) The toner according to the above 25), wherein said liberated external additive particles have a cumulative relative frequency value D50 of not lower than 1.5 V in case where the volume-based particle size of said liberated external additive particles is expressed with cubic-root voltage.

27) An image forming apparatus comprising:

a toner;

a latent-image carrier on which an electrostatic latent image is formed;

a development unit for developing the electrostatic latent image on said latent-image carrier with said toner; and a transfer unit for transferring said developed image on said latent-image carrier, wherein said toner is a toner according to the above 24).

28) An image forming apparatus comprising:

a toner;

a latent-image carrier on which an electrostatic latent image is formed;

a development unit for developing the electrostatic latent image on said latent-image carrier with said toner; and a transfer unit for transferring said developed image on said latent-image carrier, wherein said toner is a toner according to the above 25) or 26).

DETAILED DESCRIPTION OF THE INVENTION

Figure 1:
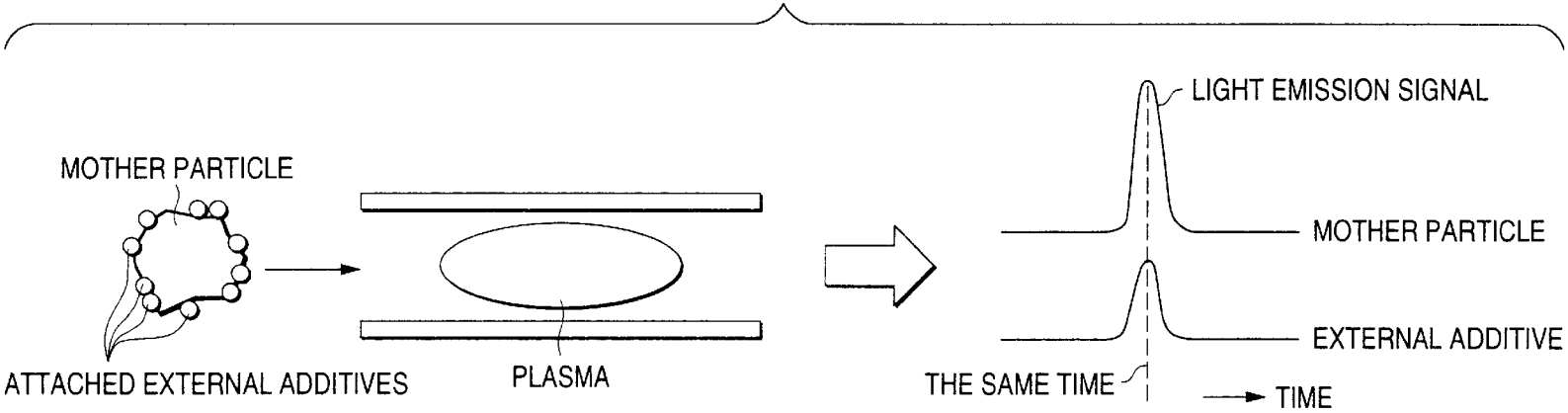
FIGS. 1(*a*) and 1(*b*) are diagrams showing an example of a conventional toner analyzing method for analyzing a state of adhesion between mother particles and external additives of toner according to an embodiment of the present invention.
Figure 1:
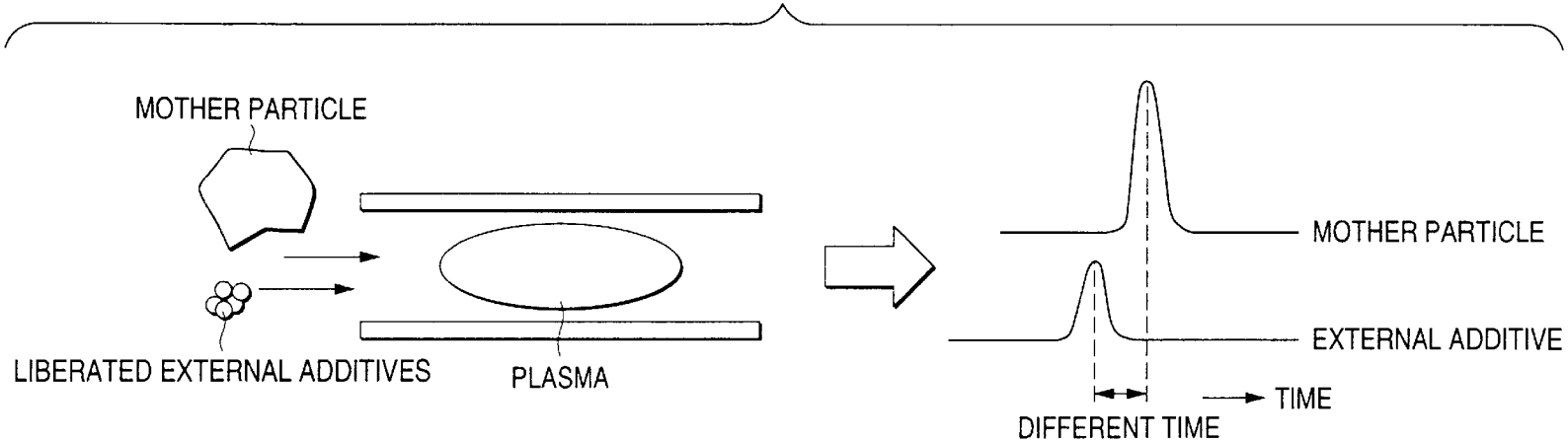

Referring to the drawings, an embodiment of the present invention will now be described.

FIG. 1 is a diagram showing an example of a conventional method of analyzing toner for use in a process for analyzing a state of adhesion between mother particles and external additives of toner according to an embodiment of the present invention.

A state of adhesion between the mother particles and the external additives of toner T according to this embodiment must be analyzed. Toner T according to this embodiment is analyzed by a toner analyzing method disclosed in "New Method of Analyzing Additive, Analysis of Toner by Particle Analyzer", Toshiyuki Suzuki and Sumio Takahara, collection of "Japan Hardcopy '97", (95-th) annual meeting of Electrophotography Association, sponsored by Electrophotography Association, Jul. 9 to 11, 1997.

The foregoing toner analyzing method is an element analyzing method having the steps of introducing, into plasma, particles of toner T obtained by allowing external additives comprising silica ($SiO_2$) to adhere to the surfaces of mother particles comprising a resin to excite particles of toner T; and obtaining emission spectrum as shown in FIG. 1 realized owning to the excitation.

An axis of abscissa of the graph shown in FIG. 1 showing emission spectrum stands for time axis. As shown in FIG. 1(*a*), introduction of particles of toner T having external additives allowed to adhere to mother particles of toner T made of a resin into plasma causes both of the mother particles and the external additives to emit light. Since the mother particles and the external additives are simultaneously introduced into plasma, the mother particles and the external additives simultaneously emit light. The state in which the mother particles and the external additives simultaneously emit light is a state in which the mother particles and the external additives are synchronized with each other. Namely, the state in which the mother particles and the external additives are synchronized with each other is a state in which the external additives are allowed to adhere to the mother particles.

In a state as shown in FIG. 1(*b*) in which the mother particles to which the external additives are not allowed and the external additives liberated from the mother particles are introduced into plasma, both of the mother particles and the external additives emit light similarly to the foregoing case. At this time, the mother particles and the external additives are introduced into plasma at different time. Therefore, the mother particles and the external additives emit light at different times (if the mother particles are introduced into plasma prior to the introduction of the external additives, the mother particles first emit light, and then the external additives emit light).

The foregoing state in which the mother particles and the external additives emit light at different times is a state in which the mother particles and the external additives are not synchronized with each other (that is, an asynchronous state) Namely, the state in which the mother particles and the external additives are asynchronous with each other is a state in which the external additives are not allowed to adhere to the mother particles.

Figure 2:
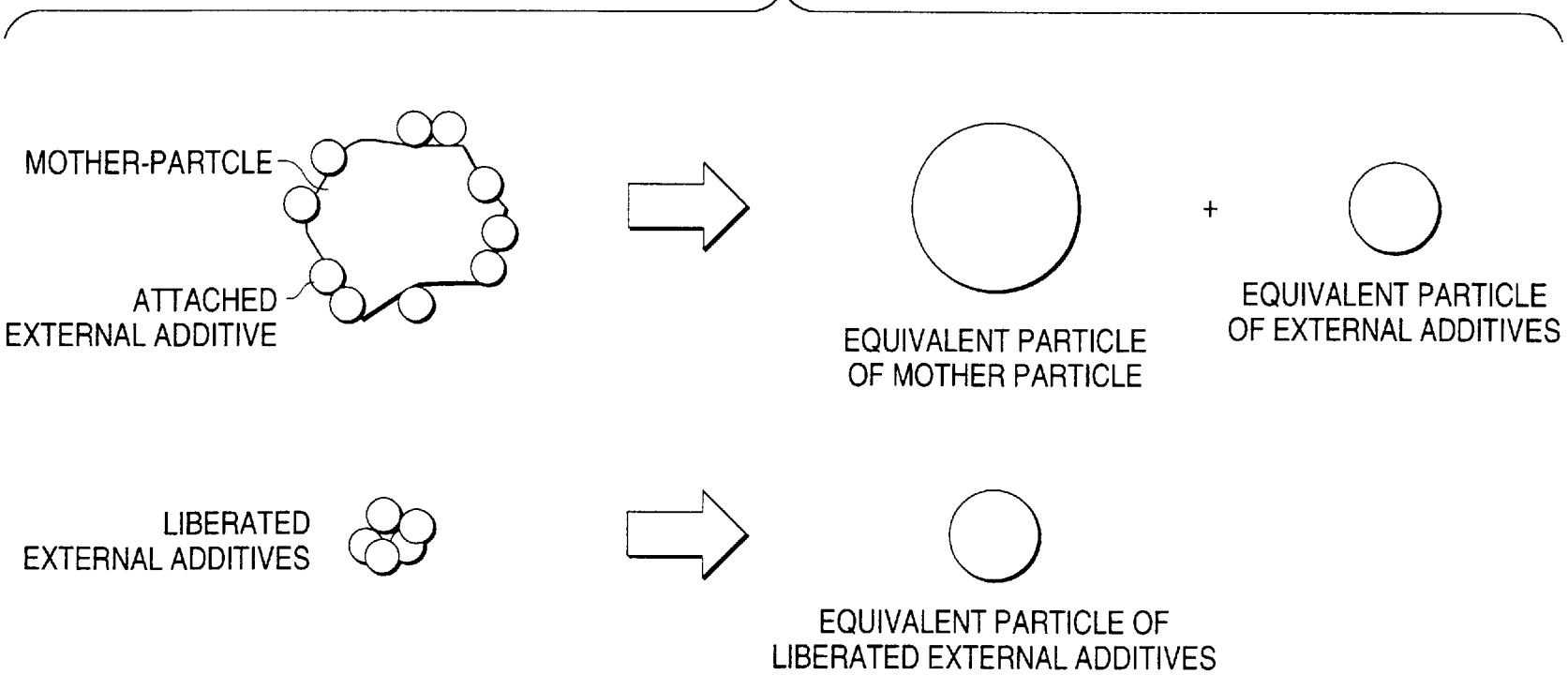
FIG. 2 is a diagram showing equivalent particles and equivalent particle sizes for use in the toner analyzing method shown in FIG. 1.

Referring to FIG. 1, the height of the light emission signal indicates the intensity of emitted light. The intensity of emitted light does not concern the size and shape of the particles. The intensity is in proportion to the number of atoms (C and $SiO_2$) of the elements contained in the particles. To indicate the intensity of emitted light of each element with the size of the particles, a particle of a pearl composed of only the contact and the external additives is assumed when light emission of the mother particles and the external additives has occurred as shown in FIG. 2. Thus, the particle size of the pearl is used to indicate the particle size of each of the mother particles and the external additives. The particle of the pearl is called an equivalent particle, and the particle size of the equivalent particle is called an equivalent particle size. Since the external additives having very small sizes cannot individually be detected, the detected light emission signals of the external additives are integrated to be converted into one equivalent particle so as to be analyzed.

As described below, toner T according to the present invention comprises at least mother particles and external additive particles. The mother particles comprise at least a resin, which comprises at least carbon atoms as a constituting element. Therefore, the light emission spectrum attributed to carbon atoms is detected to evaluate the mother particles. On the other hand, the external additive comprises fine particles of a metal oxide, metal carbide, a metal nitride or metal salt. In the case of $SiO_2$, for example, light the light emission spectrum attributed to Si is detected to evaluate the external additive.

Figure 3:
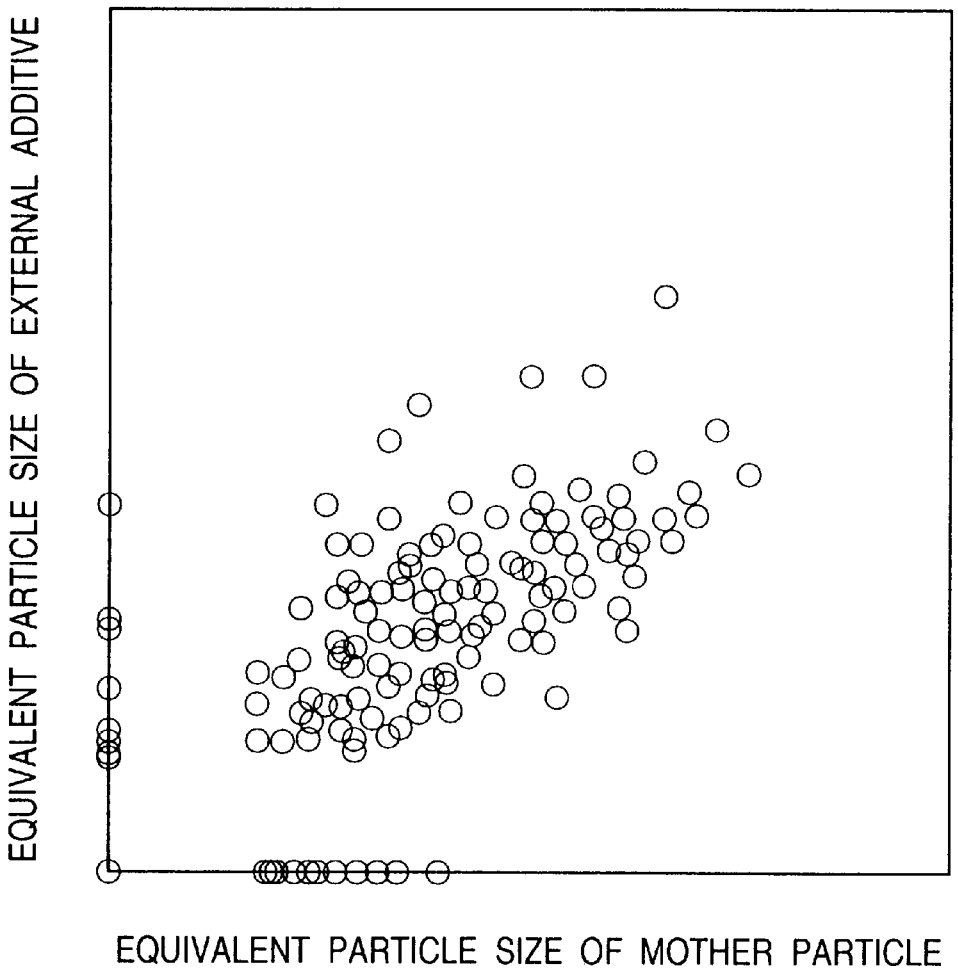
FIG. 3 is a graph showing results of analysis performed with the toner analyzing method shown in FIG. 1.

When the equivalent particle size of the equivalent particle obtained from the emission spectrum of each of the mother particles and the external additives is plotted for each particle of toner T, a graph showing the distribution of equivalent particle sizes of the toner particles as shown in FIG. 3 can be obtained.

The graph shown in FIG. 3 has an axis of abscissa which stands for equivalent particle sizes of the mother particles and an axis of ordinate which stands for equivalent particle sizes of the external additives. The equivalent particles indicated on the axis of abscissa represent asynchronous mother particles to which the external additives are not allowed to adhere. On the other hand, the equivalent particles indicated on the axis of ordinate represent asynchronous external additives liberated from the mother particles. Equivalent particles deviated from the axis of abscissa and the axis of ordinate indicate synchronized toner T having the external additives allowed to adhere the mother particles.

Thus, a state of adhesion of the external additives to the mother particles of toner T is analyzed.

Toner T for use in the image forming apparatus according to this embodiment may be negative-polarity or positive-polarity toner. The mother particles comprises at least a coloring material and resin. Moreover, an electrification-controlling agent, a dispersant, a lubricant (Wax), a magnetic material and other additives may be added.

The resin constituting the mother particles may be selected from: polystyrene and copolymers thereof, for example, hydrogenated styrene resin, styrene-isobutyrene copolymer, ABS resin, ASA resin, AS resin, AAS resin, ACS resin, AES resin, styrene-P-chlorostyrene copolymer, styrene-propylene copolymer, styrene-butadiene crosslinked polymer, styrene-butadiene-chlorinated paraffin copolymer, styrene-allyl-alcohol copolymer, styrene-butadiene emulsion, styrene-maleate copolymer, styrene-isobutylene copolymer, styrene-maleic anhydride copolymer; acrylate resins and methacrylate resins and their copolymers; styrene-acrylic resins and their copolymers, for example, styrene-acryl copolymer, styrene-diethylamino-ethylmethaacrylate copolymer, styrene-butadiene-acrylic ester copolymer, styrene-methylmethaacrylate copolymer, styrene-n-butylacrylate copolymer, styrene-methylmethaacrylate-n-butylmethaacrylate copolymer, styrene-methylmethaacrylate-butylarylate-N-(ethoxymethyl) acrylamide copolymer, styrene-glycidylmethaacrylate copolymer, styrene-butadiene-dimethyl-aminoethylmethaacrylate copolymer, styrene-acrylic ester-maleate copolymer, styrene-methyl methaacrylate-acrylic acid-2-ethylhexyl copolymer, styrene-n-butylarylate-ethylglycolmethaacrylate copolymer, styrene-n-butylmethaacrylate-acrylic acid copolymer, styrene-n-butylmethaacrylate-maleic anhydride copolymer, styrene-butyl acrylate-isobutyl maleate half ester-divinylbenzene copolymer; polyesters and their copolymers; polyethylene and their copolymers; epoxy resins; silicon resins; propylene and copolymers thereof; fluororesins; polyamide resins; polyvinyl alcohol resins; polyurethane resins; and polyvinylbutyral resin. Any one of the foregoing materials may be employed singly or two or more materials may be blended.

The coloring material includes carbon black, spirit black, nigrosine, rhodamine material, triaminotriphenylmethane, cation type material, dioxazine, copper phthalocyanine, perylene, azo-type material, gold-contained azo pigment, azochrome complex, carmine material, benzidine, solar pure yellow 8G, quinacridon, polytungstophosphate, Indanthrene Blue, sulfonamide derivative and the like.

The electrification-controlling agent may be an electron-acceptable organic complex, chlorinated polyester, nitrohumic acid, quaternary ammonium salt or pyridinium salt.

The lubricant may be polypropylene wax, polyethylene wax or the like.

The dispersant may be metallic soap, polyethylene glycol or the like.

Other additives may be zinc stearate, zinc oxide, cerium oxide or the like.

The magnetic material includes metal powder of Fe, Co, Ni, Cr, Mn or Zn; metal oxide, such as Fe3O4, Fe2O3, Cr2O3 or ferrite; an alloy having a ferromagnetic characteristic owning to heat treatment of an alloy containing manganese and acid; and the like. A previous treatment using a coupling material may be performed.

The foregoing materials are formed into the mother particles by a usual kneading pulverization method, a spray and dry method or a polymerizing method.

The external additives include a variety of materials having surfaces subjected to a process for obtaining hydrophobic characteristic. For example, inorganic fine particles made of metal oxide, such as silica, alumina titanium oxide, their composite oxide; or organic fine particles, for example, acryl fine particles. As its surface treatment material, any one of the following materials may be employed: a silane coupling agent, a titanate coupling agent, a fluorine-contained silane coupling agent or silicon oil. It is preferable that the hydrophobic ratio of the external additives processed with the foregoing processing agent is 60% or higher when the ratio is measured by a conventional methanol method. If the ratio is not higher than the above-mentioned value, deterioration in the electrification characteristic and fluidity easily occurs in a hot and wet environment owning to adsorption of water. It is preferable that the particle size of the external additives is 0.001 $\mu$m to 1 $\mu$m from a viewpoint of improving a transporting characteristic and fluidity. It is preferable that the amount of the added external additives is 0.1 wt % to 5 wt % with respect to the mother particles of toner. If the amount is larger than the foregoing value, the possibility that the external additives are made to be asynchronous with respect to toner is raised. Thus, secondary coagulation frequently occurs, causing determination in the electrification characteristic and increase in the movement marks to take place.

The number of kinds of the external additives is not limited to one, and two or more kinds of external additives may be used in combination.

The mother particles and the external additives are mixed in a dry state so as to be allowed to adhere to one another by using a high-speed fluidization mixing machine, such as a Henschel mixer or perpen mayer or a mixing machine using a mechanochemical method.

In the present invention, the toner may be used as either of a one-component developer and a two-component developer together with a carrier component.

The material of the toner carrier for use in the development unit according to the present invention may be any material so long as it can be formed into a toner carrier, such as a magnetic material, a non-magnetic material, a conductive material, an insulating material, a metal material, rubber and resin. For example, the material may be any one of the following materials: a metal material, such as aluminum, nickel or stainless steel; rubber, such as natural rubber, silicon rubber, urethane rubber, butadiene rubber, chloroprene rubber, neoprene rubber, or NBR; or resin, such as styrol resin, vinyl chloride resin, polyurethane resin, polyethylene resin, methacrylic resin or nylon. As a matter of course, coating of the upper layer of the foregoing material is permitted. The coating material may be polyethylene, polystyrene, polyurethane, polyester, nylon or acryl. The toner carrier may be formed into any one of a variety of shapes including a non-elastic shape, an elastic shape, a single layer, a multi-layered structure, a film or a roller. The surface roughness Rz (ten-point average surface roughness according to JIS B 0601) of the toner carrier is made to be 1 $\mu$m to 10 $\mu$m.

It is preferable that the material of the toner supply member for use in the present invention is an elastic material to stabilize the contact of the Loner carrier. In this embodiment, the material of the toner supply member may be polyurethane foam, polystyrene foam, polyethylene foam, polyester foam, ethylene propylene foam, nylon foam or silicon foam. The foaming cell for constituting the toner supply member may be either a single foam type material or a successive foam type material. If the foaming cell is constituted by the successive foam type material, toner is introduced into the foam cell in the supply member. As a result, coagulation of toner occurs, causing easy movement of toner to be inhibited and movement marks to be formed in the limiting portion. Therefore, the single foam material is a preferred material. The hardness must be 10° to 40° (measured by Aska-C hardness meter). The optimum hardness is 35° to 40° with which an effect to scrape residual toner on the toner carrier can be improved. The resistance must be $10^3$ Ωcm (volume resistance) to $10^7$ Ωcm As a matter of course, rubber having elasticity may be substituted for the foam material. Specifically, a material obtained by dispersing a conductive agent, such as carbon, in any one of the following materials and by molding the material into a desired shape: silicon rubber, urethane rubber, natural rubber, isoprene rubber, styrene-butadiene rubber, butadiene rubber, chloroprene rubber, butyl rubber, ethylene propylene rubber, epichlorohydrine rubber, nitril butadiene rubber and acryl rubber.

The toner-regulating member for use in the present invention may be an elastic chip made of a rubber or the like formed into a curved-shape and joined to a plate member made of stainless steel, copper, iron or a resin. The rubber chip may be a material obtained by dispersing a conductive agent made of carbon in any one of the following materials and by molding the material into a required shape: silicon rubber, urethane rubber, natural rubber, isoprene rubber, styrene-butadiene rubber, butadiene rubber, chloroprene rubber, butyl rubber, ethylene propylene rubber, epichlorohydrine rubber, nitril butadiene rubber and acryl rubber. Also a material obtained by integrally molding the foregoing rubber material or a material constituted by a signal plate member may be employed. As a matter of course, coating of the upper layer of the foregoing material is permitted. The coating material may be polyethylene, polystyrene, nylon, polyurethane or polyester.

The cleaning blade for use in the present invention may be constituted by forming an elastic chip provided for a plate member made of stainless steel, copper, iron or resin. The rubber chip may be obtained by molding silicon rubber, urethane rubber, natural rubber, isoprene rubber, styrene-butadiene rubber, butadiene rubber, chloroprene rubber, butyl rubber, ethylene propylene rubber, epichlorohydrine rubber, nitril butadiene rubber and acryl rubber. As an alter native to this, a cleaning blade obtained by polishing or cutting the foregoing structure.

First Aspect of the Invention

Figure 4:
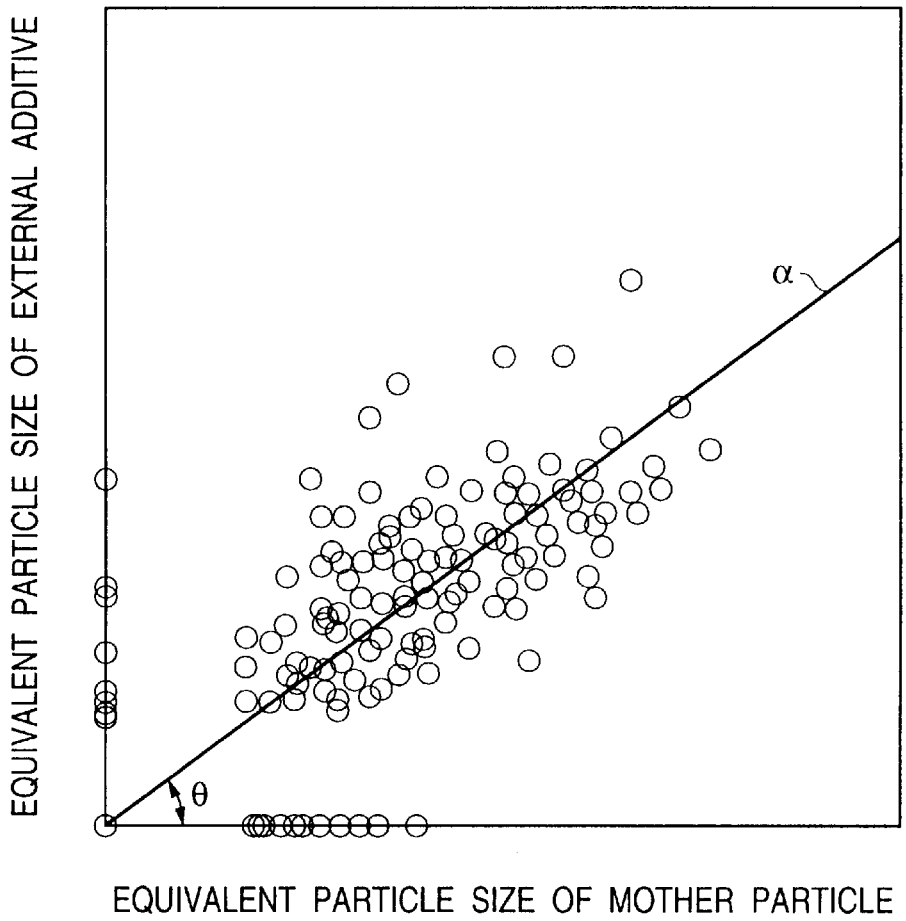
FIG. 4 is a diagram showing an approximation straight line for use to constitute toner according to the present invention in accordance with results of analysis shown in FIG. 3.

Toner T according to this aspect of the invention has been analyzed by the foregoing analyzing method. Toner T according to an embodiment comprises silica particles to serve as the external additives. As shown in FIG. 4, a state of adhesion between carbon contained in mother particles 12 of toner T and the external additives 13 analyzed by the foregoing analyzing method is analyzed by using approximation straight line α obtained by the least-square method and passing through the origin. The inclination θ (equivalent particle size of the external additives/equivalent particle size of the mother particles) of the approximation straight line α indicates the concentration of the external additives 13 allowed to adhere (synchronized with) the mother particles 12. That is, the concentration of the external additives 13 is lowered as the inclination θ is reduced. In the foregoing case, the amount of the synchronized external additives 13 is small and also the particle size is small. As the inclination θ is enlarged, the concentration of the synchronized external additives 13 raised. In the foregoing case, the amount of the synchronized external additives 13 is large and also the particle size is large.

As the amount of synchronized external additives 13 is enlarged, the inclination θ is enlarged. Thus, the liberated external additives 13 occurring owning to stress easily increases. As a result, filming easily occurs. As the particle size of the external additives 13 is enlarged, the inclination θ is enlarged. Thus, the external additives 13 are easily liberated. As a result, filming easily occurs.

Toner T according to this embodiment is constituted such that the inclination θ of the approximation straight line α concerning the concentration of the synchronized external additives 13 is not larger than 0.6.

Toner T constituted as described above and comprising the mother particles 12 and the external additives 13 which are synchronized with one another is arranged such that the inclination θ of the approximation straight line α on the basis of the concentration of the external additives 13 with respect to the particle size of the mother particles 12 is not larger than 0.6. Thus, the overall amount of the external additives 13 which adhere to toner T and the particle size of the external additives 13 which adhere to the mother particles 12 can be limited to an extent with which the number of occurrences of filming is not substantially changed if the number of prints increases. As a result, liberation of the external additives 13 from the mother particles 12 of synchronized toner T can be prevented in the contact development process and contact transfer process in the image forming operation. Namely, formation of the asynchronous external additives 13 can be prevented. Therefore, retention of the external additives 13 in the nip portion 2*a* on the OPC 102 can furthermore effectively be prevented. As a result, filming can effectively be prevented.

Figure 10:
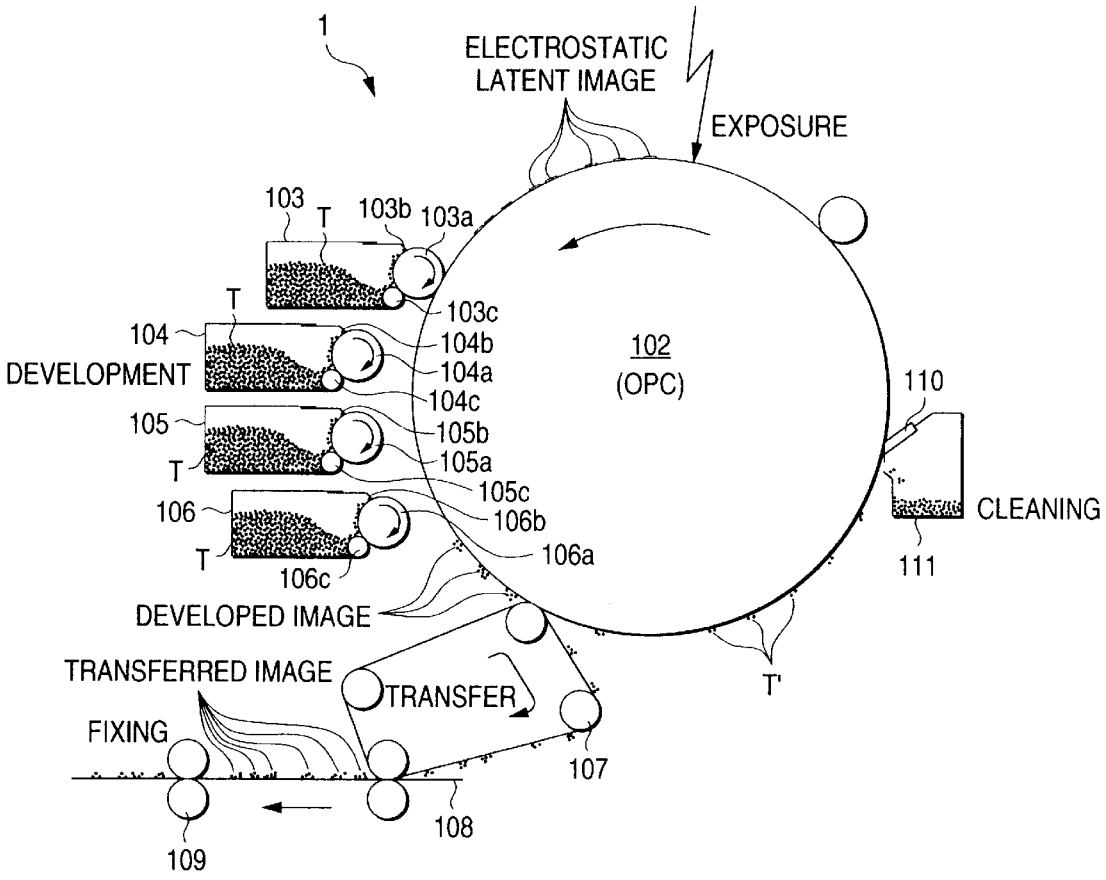
FIG. 10 is diagram schematically showing a conventional image forming apparatus equipped with a cleaning member.
Figure 11:
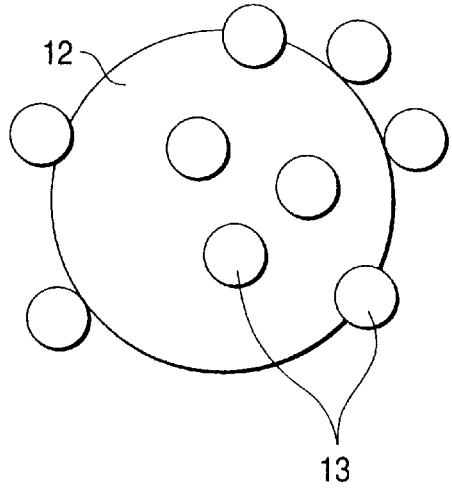
FIG. 11 is a diagram showing a toner particle having external additives allowed to adhere to a mother particle.
Figure 12:
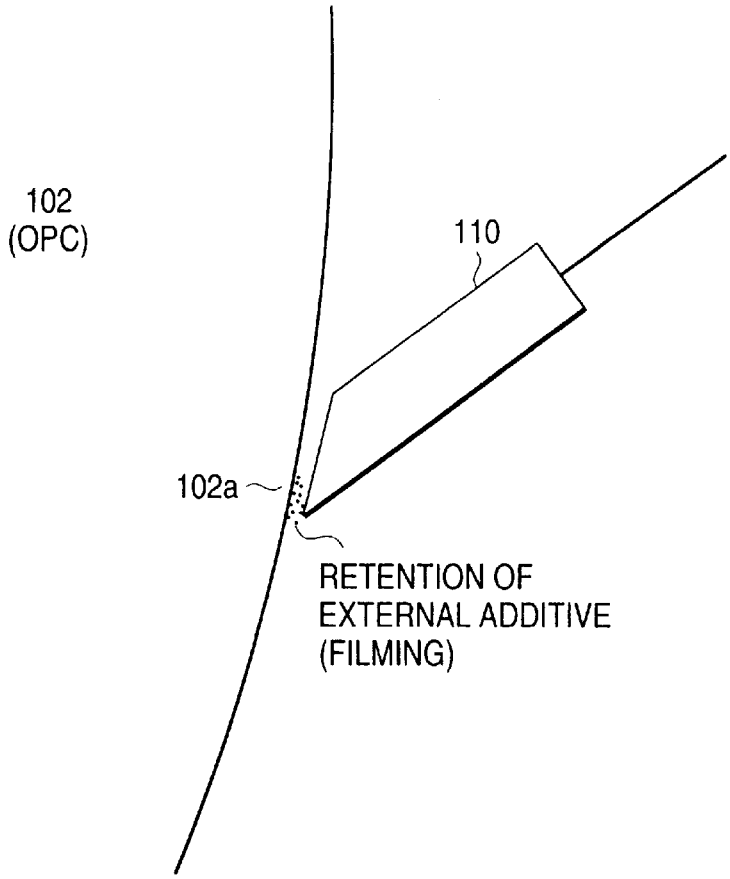
FIG. 12 is a diagram showing filming which occurs when an image has been formed by the image forming apparatus shown in FIG. 10 by using conventional toner.

Toner T according to this aspect of the present invention and having the constitution that the inclination θ of the approximation straight line α is 0.6 and toner T which does not accord thereto and having the constitution that the inclination θ of the approximation straight line α is 0.7 were subjected to image forming tests by using the image forming apparatus 101 equipped with the cleaning blade 110 as shown in FIG. 10. Thus, results shown in FIG. 5 were obtained. Toner containing silica fine particles was used in the tests to detect emission spectrum of Si so as to perform the measurement (which applies to the following tests).

Figure 5:
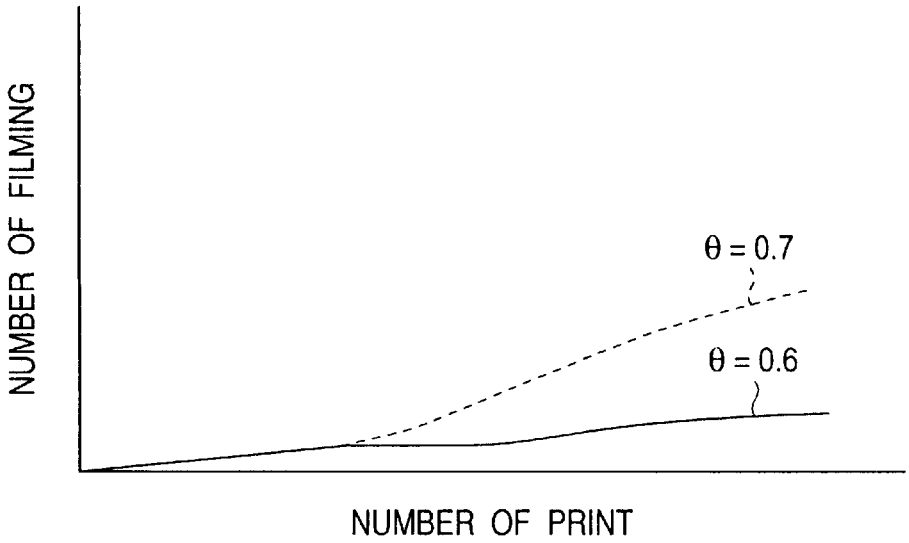
FIG. 5 is a graph showing results of image forming tests using toner according to the embodiment of the present invention and toner not according to the embodiment.

As can be understood from FIG. 5, toner T having the inclination θ of the approximation straight line α which is 0.7 encountered rapid enlargement of the number of occurrences of filming caused by the external additives 13 on the OPC 2. Toner T according to this embodiment is free from considerably change in the number of occurrences of filming which are caused by the external additives 13 or the number is slightly enlarged. Toner T according to this embodiment is able to reduce occurrence of filming which are caused by the external additives 13.

Toner T according to this embodiment is able to prevent liberation of external additives 13 from the mother particles 12 if stress is repeatedly exerted on toner T during contact development and contact transfer. Therefore, the lifetime of toner T can furthermore be elongated.

The present invention is not limited to the silica fine particles which are employed as the external additives. Any one of various materials may be employed. When the toner analyzing test is performed, the emission spectrum of the elements, which must be detected, is appropriately selected in accordance with the material of the external additives. Thus, a similar measurement can be made by using external additives other than silica. When titanium oxide is employed to serve as the external additives, the emission spectrum of Ti must be detected and processed. When alumina is employed, the emission spectrum of Al must be detected and processed. In the present invention, two or more kinds of external additives may be used. In such cases, it is sufficient if at least one of them satisfies the above-described relationship.

Figure 6:
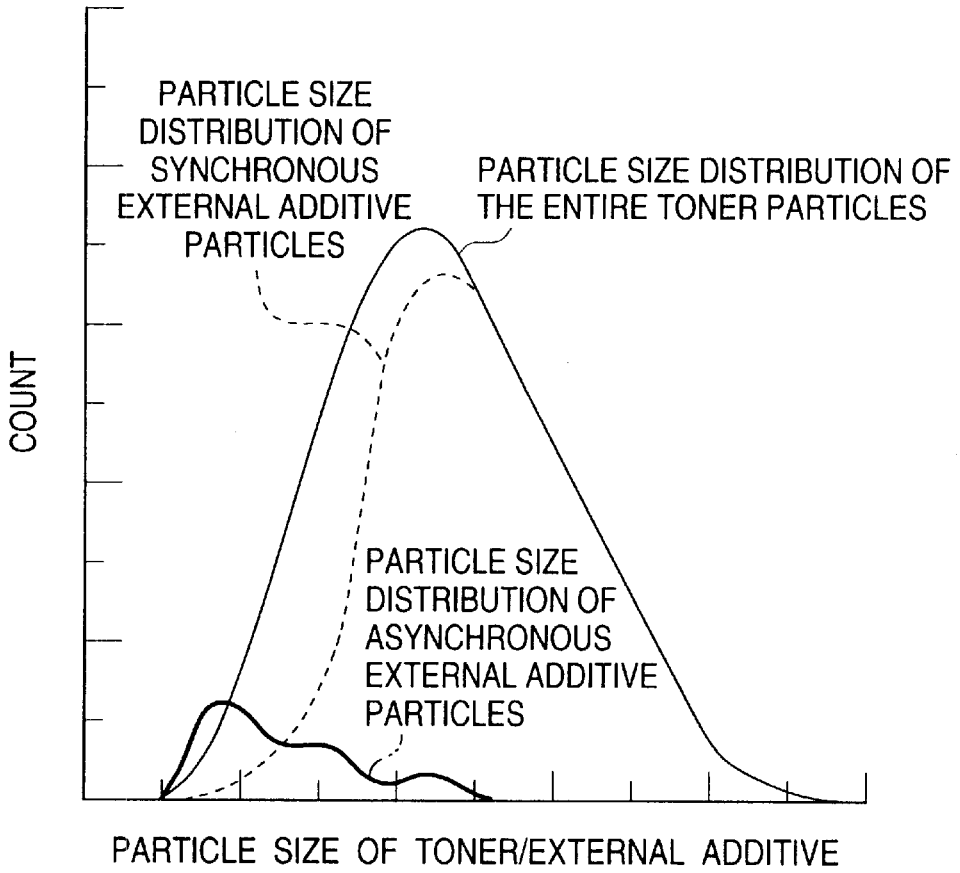
FIG. 6 is a normal distribution graph of particle sizes of toner according to the embodiment of the present invention and obtained from results of analysis shown in FIG. 4.

FIG. 6 is a normal distribution graph showing another embodiment of toner according to the present invention and the distribution of particle sizes obtained from results of analysis shown in FIG. 4.

A second embodiment of toner according to the first aspect of the present invention is constituted such that toner T has the inclination θ which is not larger than 0.6 and the number of the asynchronous external additives 13 shown in FIG. 6 is not higher than 5% with respect to the overall number of toner particles. Since the proportion of the asynchronous external additives 13 is determined as described above, re-coagulation of the external additives 13 can be prevented. Therefore, filming can be prevented.

While the proportion of the asynchronous external additives 13 was being enlarged with respect to the overall toner particles, image forming tests were performed similarly to the foregoing tests. Thus, results as shown in FIG. 7 were obtained.

Figure 7:
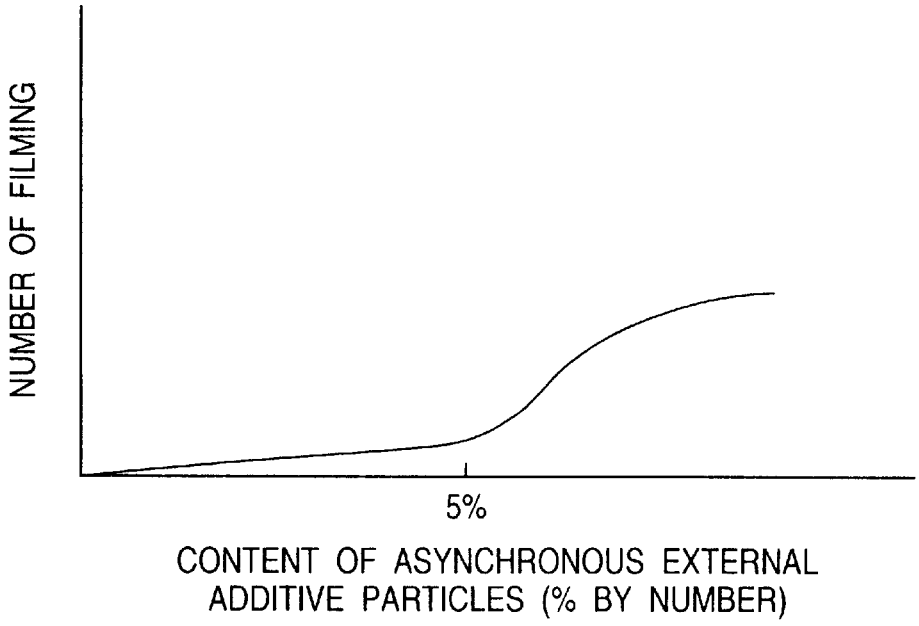
FIG. 7 is a graph showing results of image forming tests using toner shown in FIG. 6 and toner other than that shown in FIG. 6.

As can be understood from FIG. 7, the number of occurrences of filming caused from the external additives 13 on the OPC 102 is rapidly enlarged as the number of prints increases if the proportion of the asynchronous external additives 13 is larger than 5% with respect to the overall toner particles. When the proportion of the asynchronous external additives 13 is not larger than 5% with respect to the overall toner particles, the number of occurrences of filming caused from the external additives 13 is slightly enlarged if the number of prints increases. Thus, substantially no influence is exerted on the image. That is, also toner T according to this embodiment is able to prevent filming caused from the external additives 13.

Also toner T according to this embodiment is able to elongate the lifetime thereof similarly to toner T according to the foregoing embodiment.

Figure 8:
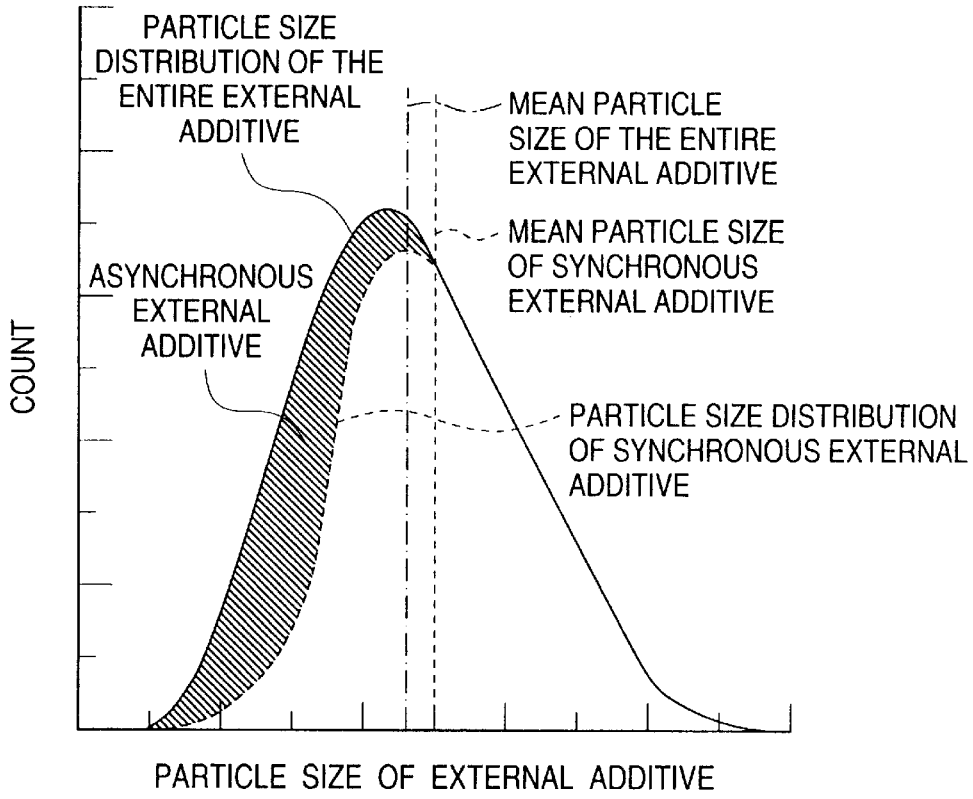
FIG. 8 is a normal distribution graph of particle sizes of toner according to another example of the embodiment of the present invention and obtained from results of analysis shown in FIG. 4.

FIG. 8 is a normal distribution graph showing another embodiment of toner according to this aspect of the present invention and the particle sizes of external additives obtained from results of analysis shown in FIG. 4.

A third embodiment of toner according to the first aspect of the present invention is constituted such that the mean particle size of synchronized external additives 13 of toner T is larger than the mean particle size of the overall portion of the external additives 13 as shown in FIG. 8. That is, the following relationship is satisfied.

$$\frac{\text{mean particle size of synchronized additives}}{\text{mean particle size of overall portion of additives}} > 1$$

As a result of the foregoing constitution, a major portion of the external additives 13 having large particle sizes adheres to the mother particles 12 of toner T so as to be formed into synchronized external additives 13. A major portion of the synchronous external additives 13 liberated from the mother particles 12 is formed into external additives 13 having small particle sizes.

Therefore, also toner T according to this embodiment is able to reduce the asynchronous external additives 13 during the contact development process and the contact transfer process in the image forming process. Therefore, retention of the external additives 13 in the nip portion 2*a* on the OPC 102 can furthermore be reduced. Thus, filming can effectively be prevented.

Image forming tests were performed similarly to the foregoing tests by using toner T in which the mean particle size of the synchronized external additives 13 is larger than the mean particle size of the overall portion of the external additives 13 and toner T which does not accord thereto and in which the mean particle size of the synchronized external additives 13 is smaller than the mean particle size of the overall portion of the external additives 13. Thus, results shown in FIG. 9 were obtained.

Figure 9:
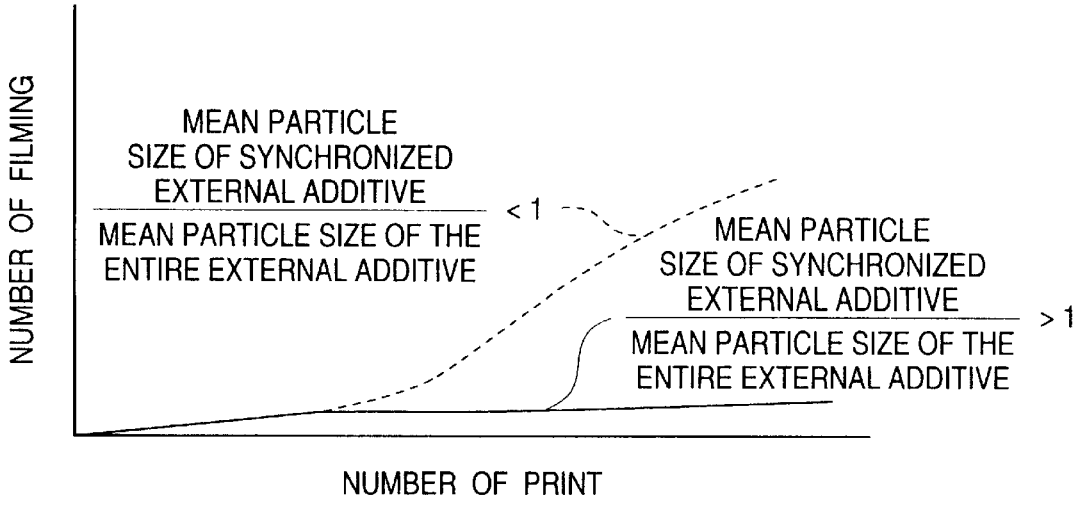
FIG. 9 is a graph showing image forming tests using toner shown in FIG. 8 and toner other than that shown in FIG. 8.

As can be understood from FIG. 9, toner T having the mean particle size of the synchronized external additives 13 which is smaller than the mean particle size of the overall portion of the external additives 13 encounters rapid enlargement of occurrence of filming on the OPC 102 owning to the external additives 13 when the number of prints has been enlarged. Toner T according to this embodiment is free from considerable change in occurrence of filming caused by the external additives 13 when the number of prints has been enlarged. Also toner T according to this embodiment enables occurrence of filming caused from the external additives 13 to be prevented.

Also toner T according to this embodiment, lifetime of toner T can furthermore be elongated similarly to toner T according to the foregoing embodiment.

In the foregoing embodiment, the state of adhesion between the mother particles and the external additives of toner is analyzed by the toner analyzing method disclosed in the foregoing collection. As a matter of course, any toner analyzing method may be employed if the method is able to obtain the mean particle size of the equivalent particle sizes of the synchronized toner particles and the mean particle size of the equivalent particle sizes of the entire toner particles.

The image forming apparatus according to the first aspect of the present invention is not limited to the image forming apparatus 101 shown in FIG. 10. The present invention may be applied to any image forming apparatus if the apparatus at least constituted such that residual toner T' on the OPC 102 is cleaned by the cleaning blade 110 after the development process.

In each embodiment, silica ($SiO_2$) is employed to serve as the external additives 13. A material other than silica may be employed to serve as the external additives 13 if the material is able to adhere to the mother particles and improve the fluidity of toner T.

As can be understood from the foregoing description, toner according to the first aspect of the present invention is constituted to regulate the amount and particle size of the external additives, which adhere to the mother particles. Therefore, liberation of the external additives from the mother particles during the process of contact development with the latent-image carrier and the process for contact transfer with the transfer unit in the image forming process can be prevented. Therefore, retention of the external additives in the cleaning portion of the latent-image carrier can be prevented. Thus, filming can be prevented.

Toner and the image forming apparatus according to the first aspect of the present invention are arranged to prevent liberation of the external additives from the mother particles if stress is repeatedly exerted on toner T during the contact development and the contact transfer. Therefore, the lifetime of toner can furthermore be elongated.

The second embodiment in the first aspect of the present invention, re-coagulation of the external additives can be prevented. Therefore, filming can furthermore be prevented.

According to the third embodiment in the first aspect of the invention, a major portion of the external additives having the large particle sizes are made to be synchronized external additives. A major portion of the non-synchronized external additives is made to be the external additives having the small particle sizes. Thus, the inclination of the approximation straight line can be reduced. Therefore, filming can furthermore be prevented.

The image foregoing apparatus according to the first aspect of the invention is arranged to use toner according to any one of the foregoing embodiments to prevent retention of the external additives in the cleaning portion of the latent-image carrier. Therefore, filming of the latent-image carrier can be prevented.

Since the lifetime of toner can be elongated, also the lifetime of the image forming apparatus using toner can be elongated.

Second Aspect of the Invention

In the second aspect of the invention, the above-described materials for use as the external additive may be combined with one another in consideration of the electrification train of the external additives. Specifically, it is preferable that the combination is performed such that the mother particles have the positive polarity and the external additives have negative polarity.

The heating member for use in the fixing unit of the image forming apparatus according to the second aspect of the invention may be any one of heating members made of metal, rubber, resin, a conductive material or an insulating material or comprising a roller or a belt. For example, the material may be a structure having the surface of a metal member made of aluminum, stainless steel or nickel, which is coated with silicon rubber, fluorine rubber or fluororesin. An elastic layer satisfying required heat resistance and toner separating characteristic is a preferred material to serve as the coating material. The shape of the heating member may be any one of a film, a roller and the like.

Figure 13:
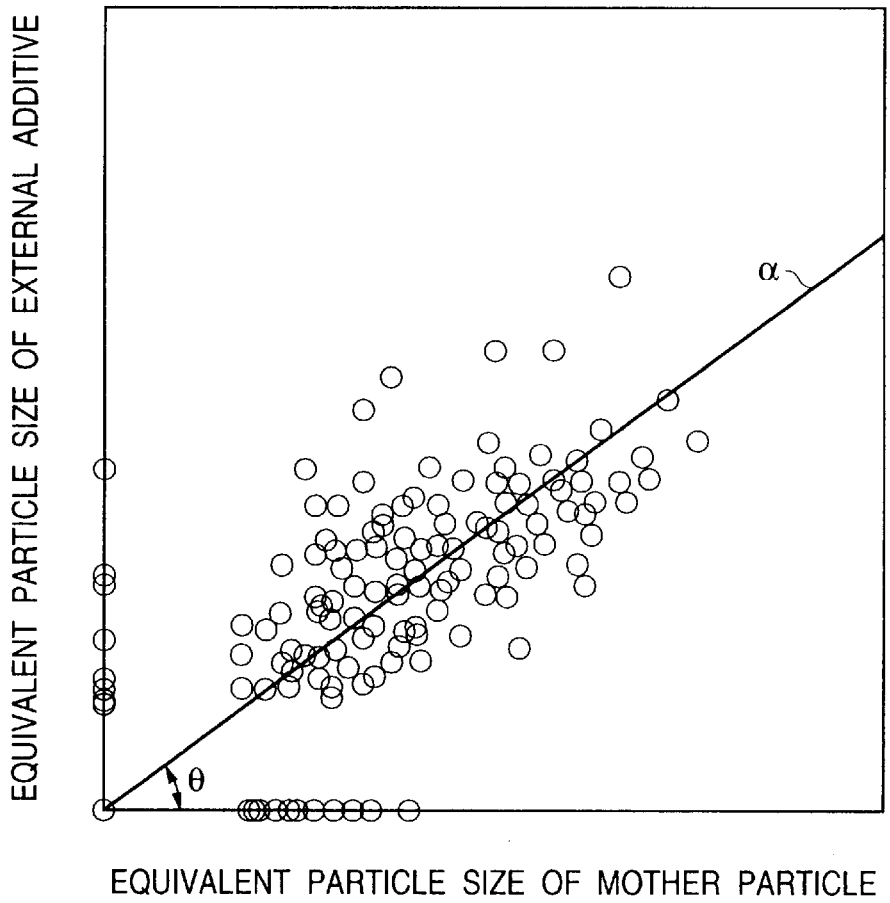
FIG. 13 is a diagram showing an approximation straight line for use to constitute toner according to the present invention in accordance with results of analysis shown in FIG. 3.

Toner T according to the second aspect of the invention has been analyzed by the foregoing analyzing method. Toner T according to an embodiment comprises silica particles to serve as the external additives. As shown in FIG. 13, a state of adhesion between carbons contained in mother particles 12 of toner T and the external additives 13 analyzed by the foregoing analyzing method is analyzed by using approximation straight line α obtained by the least-square method and passing through the origin. The inclination θ (equivalent particle size of the external additives/equivalent particle size of the mother particles) of the approximation straight line α indicates the concentration of the external additives 13 allowed to adhere (synchronized with) the mother particles 12. That is, the concentration of the external additives 13 is lowered as the inclination θ is reduced. In the foregoing case, the amount of the synchronized external additives 13 is small and also the particle size is small. As the inclination θ is enlarged, the concentration of the synchronized external additives 13 raised. In the foregoing case, the amount of the synchronized external additives 13 is large and also the particle size is large.

As the inclination θ is enlarged, the amount of synchronized external additives 13 is enlarged as described above. Therefore, the external additives 13 are allowed to adhere to the mother particles 12 having high adhesive property with respect to the heating member 209*a*. Thus, the particle size including the primary and secondary particle sizes of the external additives 13 having low adhesive property is enlarged. Therefore, as the inclination θ is enlarged, adhesive strength with which the transfer paper 208 and the heating member 209*a* are allowed to adhere to each other is reduced.

Toner T according to this mother particles is constituted such that the inclination θ of the approximation straight line α concerning the concentration of the synchronized external additives 13 is not smaller than 0.4.

Toner T constituted as described above and comprising the mother particles 12 and the external additives 13 which are synchronized with one another is arranged such that the inclination θ of the approximation straight line α on the basis of the concentration of the external additives 13 with respect to the particle size of the mother particles 12 is not smaller than 0.4. Hence it follows that the external additives 13 having a large particle size including the primary and secondary particle sizes and having low adhesive property can be allowed to adhere to the mother particles 12 having high adhesive property with respect to the heating member 209*a*. As a result, the adhesion with which the transfer paper 208 and the heating member 209*a* are allowed to adhere to each other can be lowered. Therefore, occurrence of offset with which toner T adheres to the heating member 209*a* can be prevented. It leads to a fact that winding of the transfer paper 208 around the heating member 209*a* can effectively be prevented.

Figure 20:
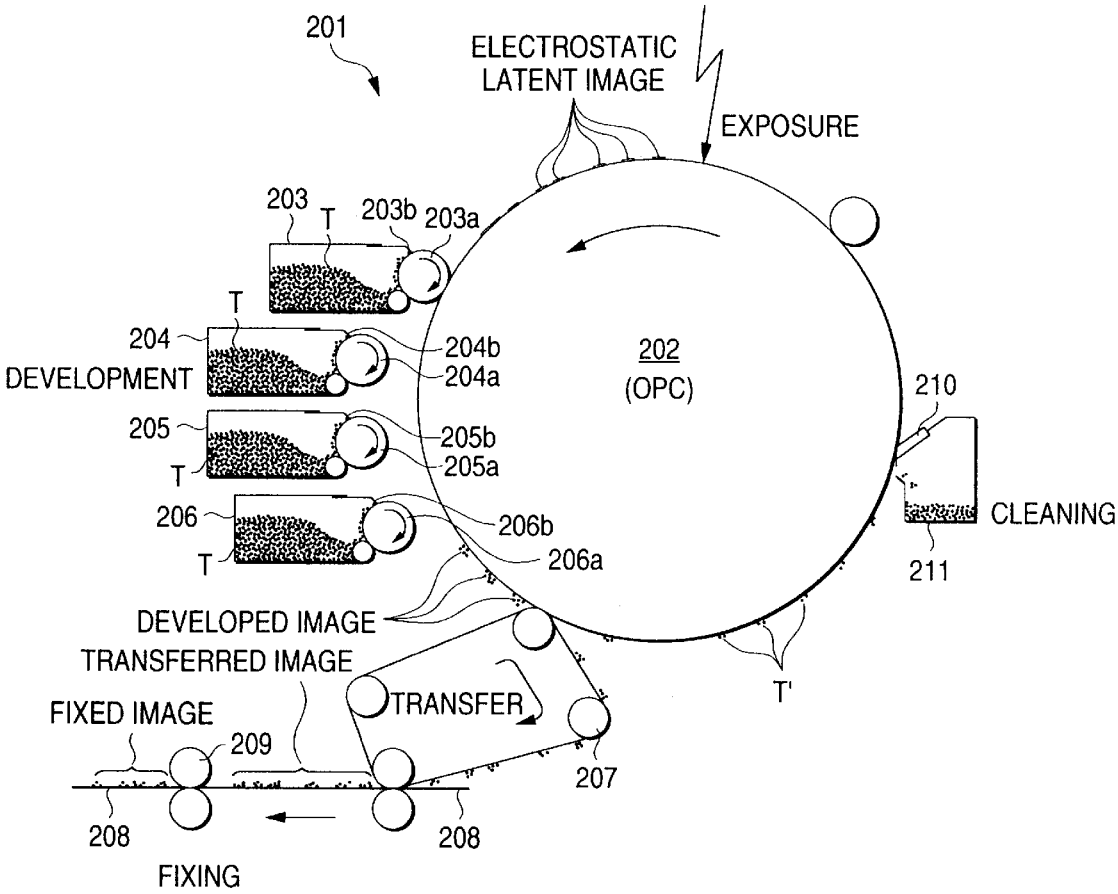
FIG. 20 is diagram schematically showing a full-color and tandem type image forming apparatus which is an example of a conventional image forming apparatus.
Figure 21:
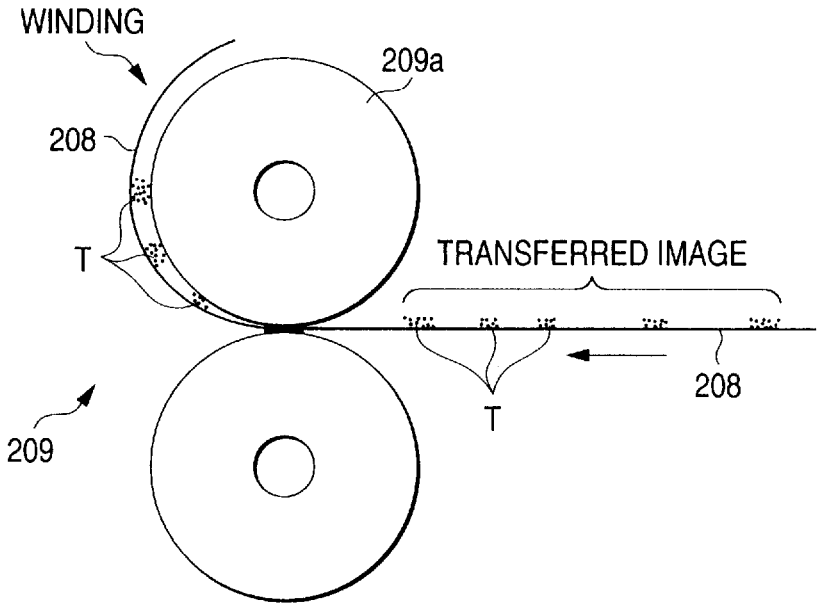
FIG. 21 is a diagram showing winding of transfer paper around a heating member which occurs when an image has been formed with conventional toner by the image forming apparatus shown in FIG. 20.

Toner T according to the above embodiment of the present invention and having the constitution that the inclination θ of the approximation straight line α is 0.5 and toner T which does not accord thereto and having the constitution that the inclination θ of the approximation straight line α is 0.3 were subjected to image forming tests by using the image forming apparatus 1 equipped with the heating member 209*a* as shown in FIG. 20. Thus, results shown in FIG. 14 were obtained. Toner containing silica fine particles was used in the tests to detect emission spectrum of Si so as to perform the measurement (which applies to the following tests).

Figure 14:
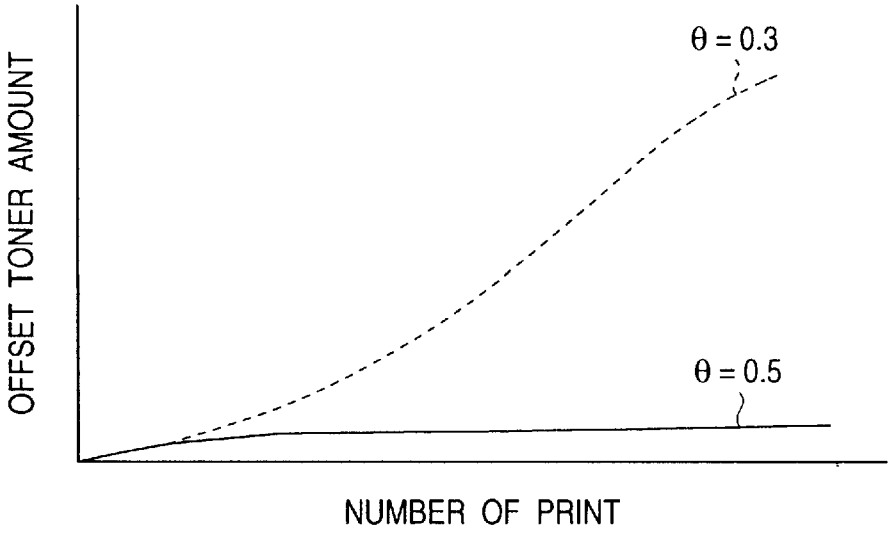
FIG. 14 is a graph showing results of image forming tests using toner according to the embodiment of the present invention and toner not according to the embodiment.

As can be understood from FIG. 14, toner T having the inclination θ of the approximation straight line α which is 0.3 encountered rapid enlargement of the amount of offset toner allowed to adhere to the heating member 209*a* to an extent with which the transfer paper 208 is undesirably wound around the heating member 209*a* as the number of prints increases. On the other hand, toner T having the inclination θ which is 0.5 is substantially free from considerable change in the amount of offset toner with which the transfer paper 208 does not wound around the heating member 209*a* if the number of prints increases. Therefore, toner T according to this embodiment is able to reduce offset of toner T to the heating member 209*a*, causing occurrence of winding of the transfer paper 208 around the heating member 209*a* to be prevented. A further precise investigation was performed, resulting in rapid enlargement of the amount of offset toner when the inclination θ of the approximation straight line α was not larger than 0.3. Therefore, it is preferable that the inclination θ of the approximation straight line α is not smaller than 0.4.

Toner T according to this embodiment is able to prevent liberation of external additives 13 from the mother particles 12 if stress is repeatedly exerted on toner T during contact development and contact transfer. Therefore, the lifetime of toner T can furthermore be elongated.

The present invention is not limited to the silica fine particles which are employed as the external additives. Any one of various materials may be employed. When the toner analyzing test is performed, the emission spectrum of the elements, which must be detected, is appropriately selected in accordance with the material of the external additives. Thus, a similar measurement can be made by using external additives other than silica. When titanium oxide is employed to serve as the external additives, the emission spectrum of Ti must be detected and processed. When alumina is employed, the emission spectrum of Al must be detected and processed. In the present invention, two or more kinds of external additives may be used. In such cases, it is sufficient if at least one of them satisfies the above-described relationship.

Figure 15:
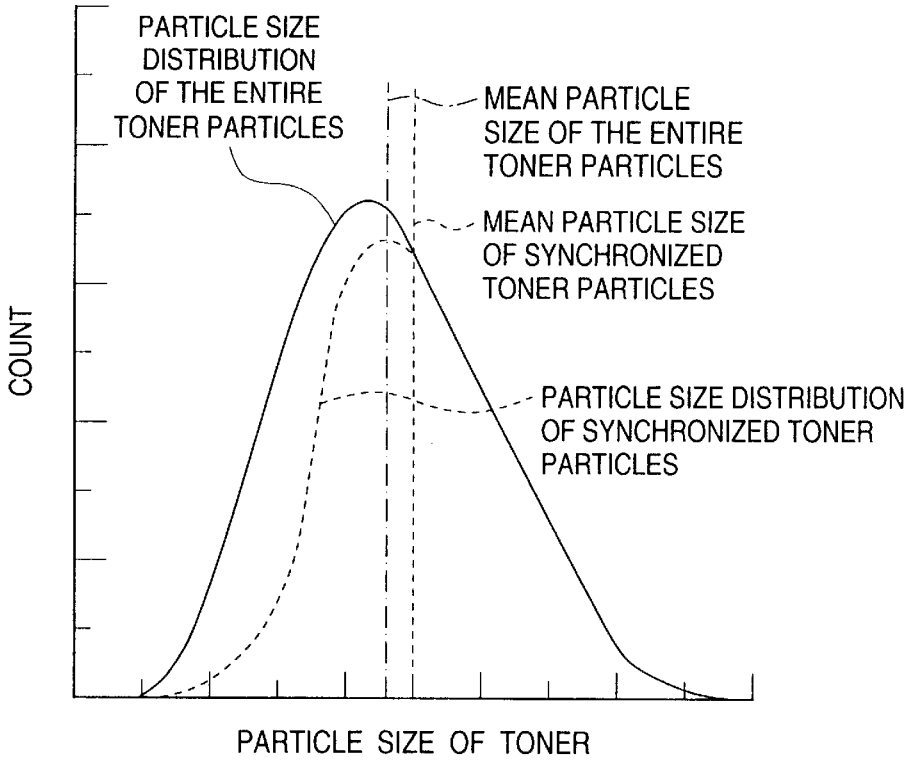
FIG. 15 is a normal distribution graph of particle sizes of toner according to the embodiment of the present invention and obtained from results of analysis shown in FIG. 13.

FIG. 15 is a normal distribution graph showing the distribution of particle sizes according to a second embodiment of the toner according to the second aspect of the present invention.

Particles of toner T shown in FIG. 3 and analyzed by the foregoing toner analyzing method is shown such that the axis of abscissa stands for particle sizes (the equivalent particle sizes) of toner. On the other hand, the axis of ordinate stands for the number of particles having the respective particle size. Thus, the normal distribution graph shown in FIG. 15 can be obtained.

Toner T according to this embodiment has a constitution that the mean particle size of a portion of toner particles (hereinafter called "external additives-synchronized toner") in which external additives 13 allowed to adhere to the resin mother particles 12 is larger than the mean particle size of the entire toner particles. That is, the following relationship is satisfied:

$$\frac{\text{mean particle size of synchronized toner}}{\text{mean particle size of overall portion of toner}} > 1$$

Toner T constituted as described above is arranged such that the mean particle size of external additive-synchronized toner particles is made to be larger than the mean particle size of the entire toner particles. Thus, the external additives 13 can uniformly be allowed to adhere to at least the mother particles 12 having larger particle size. The mother particles 12 having the large particle size exerts a great influence on the coagulating force which is generated between toner T and the heating member 209*a*. Therefore, adhesion of the external additives 13 to the mother particles 12 having the large particle size enables the coagulating force between toner T and the heating member 209*a* to be reduced. As a result, occurrence of offset with which toner T adheres to the heating member 209*a* can be prevented. Therefore, winding of the transfer paper 208 around the heating member 209*a* can effectively be prevented.

Figure 16:
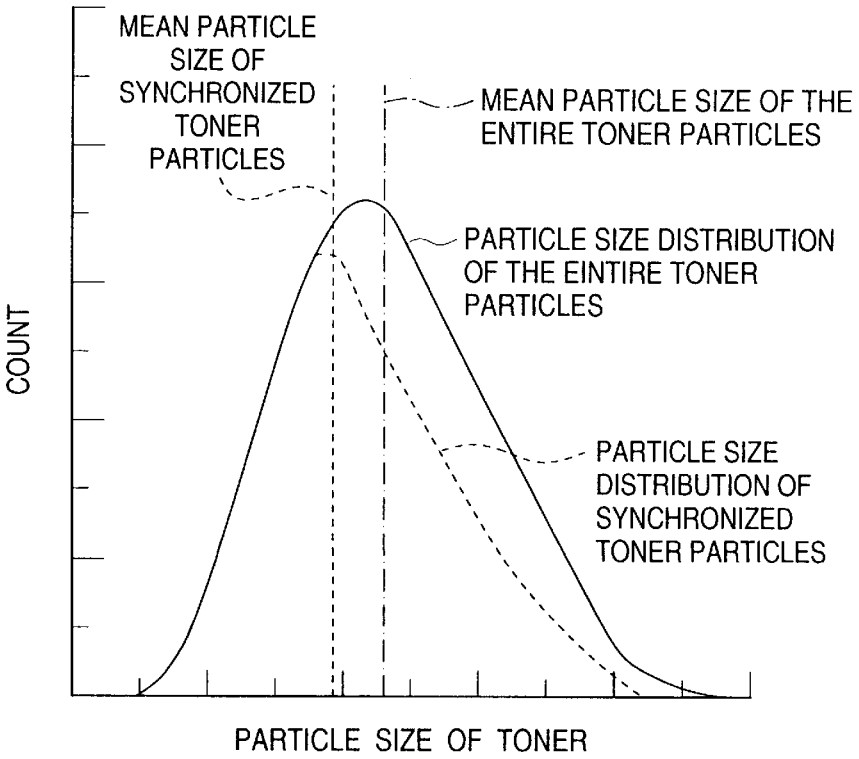
FIG. 16 is a normal distribution graph showing particle sizes of toner other than that shown in FIG. 15.

Image forming tests were performed by using toner T according to this embodiment and toner T constituted such that the mean particle size of the external additive-synchronized toner particles shown in FIG. 16 was smaller than the mean particle size of the entire toner particles, that is, the following relationship was satisfied:

$$\frac{\text{mean particle size of synchronized toner}}{\text{mean particle size of overall portion of toner}} < 1$$

The test was performed by using the image forming apparatus equipped with the heating member 209*a* constituted as shown in FIG. 20. Thus, results shown in FIG. 17 were obtained.

Figure 17:
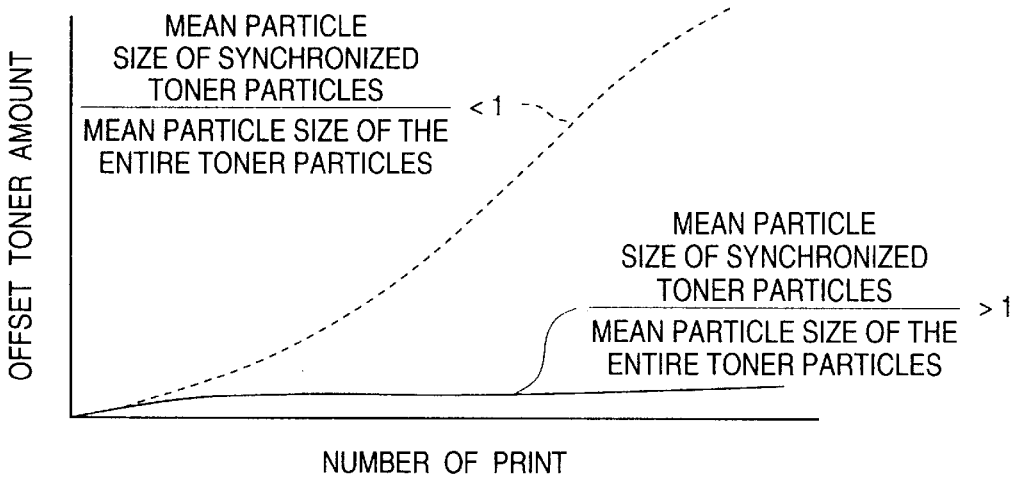
FIG. 17 is a graph showing results of image forming tests using toner shown in FIG. 15 and toner other than that shown in FIG. 15.

As can be understood from FIG. 17, toner T shown in FIG. 16 encounters rapid enlargement of the amount of offset toner allowed to adhere to the heating member 209*a* to an extent that the transfer paper 208 is wound around the heating member 209*a* as the number of prints increases. On the other hand, toner T shown in FIG. 15 and according to this embodiment is free from considerable change in the amount of offset toner which adheres to the heating member 209*a* if the number of prints increases. The amount is not enlarged to an extent with which the transfer paper 208 is wound around the heating member 209*a*. Therefore, the toner T according to this embodiment is able to reduce the offset of toner T to the heating member 209*a*. Thus, occurrence of winding of the transfer paper 208 around the heating member 209*a* can be prevented.

Also toner T according to this embodiment is able to furthermore elongate the lifetime thereof similarly to the foregoing embodiment.

Figure 18:
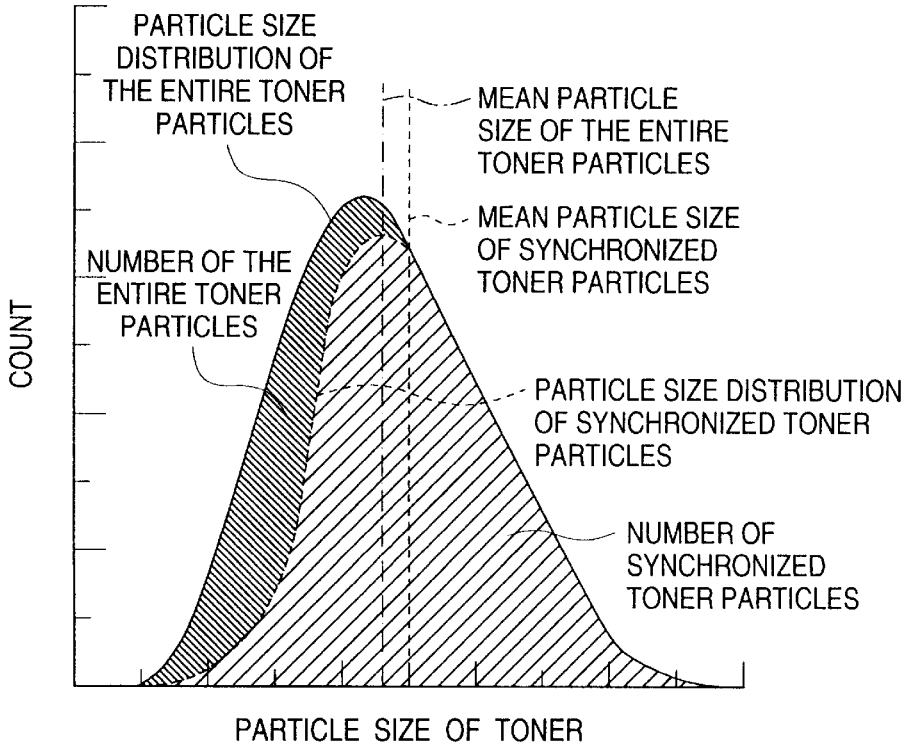
FIG. 18 is a normal distribution graph of particle sizes of toner according to another example of the embodiment of the present invention and obtained from results of analysis shown in FIG. 13.

FIG. 18 is a normal distribution graph showing distribution of particle sizes of toner according to a third embodiment in the second aspect of the present invention.

Toner T according to this embodiment is constituted such that the inclination θ is not smaller than 0.4. Moreover, the mean particle size of the external additive-synchronized toner particles is made to be larger than the mean particle size of the entire toner particles. In addition, a ratio of the number of the external additive-synchronized toner and the number of the entire toner particles, that is, the synchronization ratio is not lower than 60%.

Toner T constituted as described above and according to this embodiment is arranged such that the synchronization ratio of the mother particles 12 and the external additives 13 is not lower than 60%. Thus, existence of the external additives 13 having low adhesive property at the interface between the heating member 209*a* and the transfer paper 208 is permitted. Therefore, adhesive force with which the heating member 209*a* and toner on the transfer paper 208 adhere to each other can be reduced. Hence it follows that occurrence of offset with which toner T adheres to the heating member 209*a* can be prevented. As a result, winding of the transfer paper 208 around the heating member 209*a* can effectively be prevented.

Toner T according to this embodiment and having the synchronization ratio of 60% and toner T which does not accord thereto were used to perform image forming tests by the image forming apparatus 201 equipped with the heating member 209*a* constituted as shown in FIG. 20. Thus, results shown in FIG. 19 were obtained.

Figure 19:
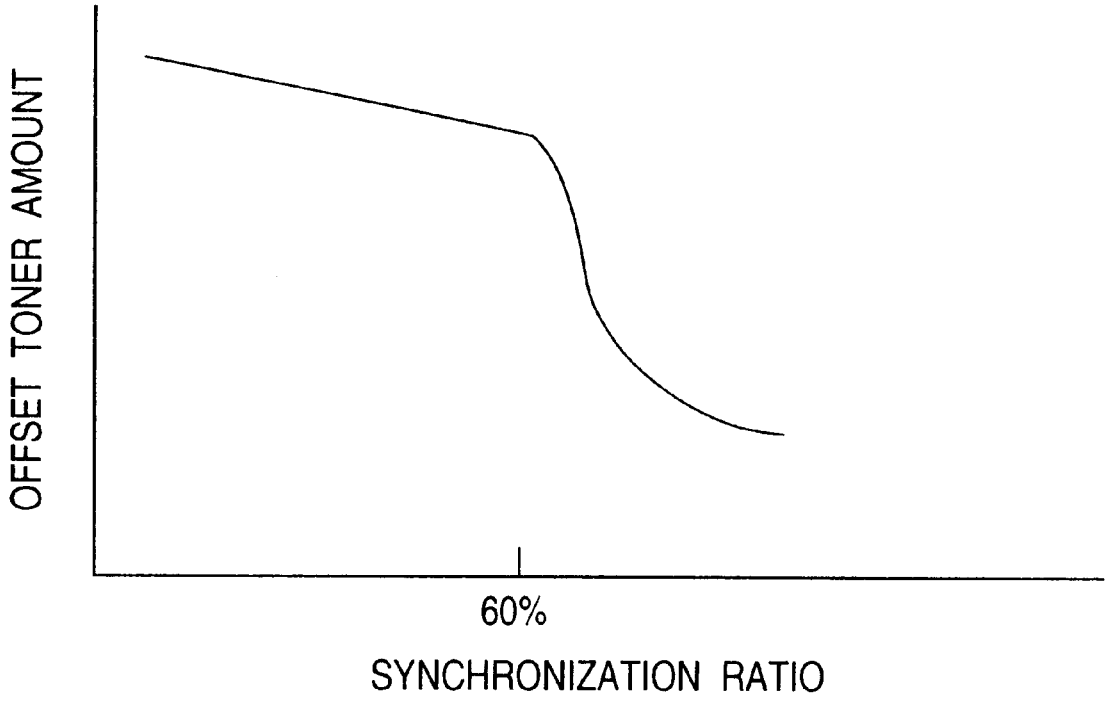
FIG. 19 is a graph showing image forming tests using toner shown in FIG. 19 and toner other than that shown in FIG. 18.

As can be understood from FIG. 19, the constitution that the synchronization ratio of the mother particles of toner and the external additives is not lower than 60% causes the amount of offset toner which adheres to the heating member 209*a* to rapidly be changed. As a result, winding of the transfer paper 208 around the heating member 209*a* can substantially be prevented. Hence it follows that toner T according to this embodiment is able to reduce the amount of offset toner T to the heating member 209*a*. Therefore, occurrence of winding of the transfer paper 208 around the heating member 209*a* can be decreased.

Also toner T according to this embodiment is able to elongate the lifetime thereof similarly to the foregoing embodiments.

A fourth embodiment of the toner according to the second aspect of the present invention is constituted such that in addition to the constitution of toner T of any one of toner T according to the foregoing embodiments, a further constitution is added. That is, the polarity of the external additives 13 is made to be different from the polarity of the mother particles 12. Usually, the polarity of the mother particles 12 is made to be positive. Therefore, toner T according to this embodiment is constituted such that the polarity of the external additives 13 is negative. As a matter of course, the polarity of the external additives 13 is made to be positive when the polarity of the mother particles 12 is made to be negative.

Toner T constituted as described above and according to this embodiment cause the adhesive force between the mother particles 12 and the external additives 13 is enlarged owning to the difference in the polarity. As a result, adhesion between the mother particles 12 and the external additives 13 is made to furthermore be reliable. Therefore, reliable existence of the external additives 13 having low adhesive property at the interface between heating member 209*a* and the transfer paper 208 is permitted. Hence it follows that occurrence of offset of toner T with which toner T adheres to the heating member 209*a* does not easily occur. As a result, winding of the transfer paper 208 around the heating member 209*a* can be prevented similar to toner T according to the foregoing embodiments.

Toner T according to this embodiment is constituted such that the polarity of the mother particles 12 and that of the external additives 13 are made to be different from each other. Thus, the external additives having low adhesive property is able to exist at the interface between the heating member 209*a* and toner T on the transfer paper 208. As a result, the adhesive force between the heating member 209*a* and toner T on the transfer paper 208 can be reduced. Hence it follows that winding of the transfer paper 208 around the heating member 209*a* can effectively be prevented.

In the foregoing embodiments, the state of adhesion between the mother particles 12 and the external additives 13 of toner is analyzed by the toner analyzing method disclosed in the foregoing collection. As a matter of course, any toner analyzing method may be employed if the method is able to obtain the mean particle size of the equivalent particle sizes of the synchronized toner particles and the mean particle size of the equivalent particle sizes of the entire toner particles.

The image forming apparatus according to the present invention is not limited to the image forming apparatus 201 shown in FIG. 20. The present invention may be applied to any image forming apparatus if the apparatus comprises at least the fixing unit 209 for fixing a transferred image on the transfer paper 208 after transfer has been completed.

In each embodiment, silica ($SiO_2$) is employed to serve as the external additives 13. A material other than silica may be employed to serve as the external additives 13 if the material is able to adhere to the mother particles and improve the fluidity of toner T.

As can be understood from the foregoing description, the toner of the first embodiment in the second aspect of the present invention is constituted such that the particle size of the external additives including primary and secondary particle sizes is enlarged, the external additives being external additives which adhere to the mother particles which have high adhesive property with respect to the fixing unit. Therefore, the adhesive force with which the transfer member and the fixing unit adhere to each other can be reduced. As a result, offset of toner on the transfer member to the fixing unit can be prevented. Hence it follows that adhesion of the transfer member to the fixing unit can be prevented.

The toner of the second embodiment in the second aspect of the present invention is constituted such that the external additives are able to uniformly adhere to at least the mother particles having the large particle size. Therefore, the coagulating force between toner and the fixing unit can be reduced. Thus, occurrence of offset of toner on the transfer member can be prevented and, therefore, adhesion of the transfer member to the fixing unit can be prevented.

According to the third embodiment in the second aspect of the invention, the external additives having low adhesive property is caused to exist at the interface between the fixing unit and toner on the transfer member. Therefore, the adhesive force between the fixing unit and toner on the transfer member can be reduced. Hence it follows that occurrence of offset of toner on the transfer member can be prevented. Therefore, adhesion of the transfer member to the fixing unit can be prevented.

According to the fourth embodiment, the adhesive force between the mother particles and the external additives are enlarged by using the different in the polarity. Therefore, adhesion between the mother particles and the external additives is made to furthermore be reliable. Thus, the external additives having low adhesive property are able to reliably exist at the interface between the fixing unit and the fixing unit. As a result, the adhesive force with which the fixing unit and toner on the transfer member adhere to each other can be reduced. Therefore, occurrence of offset of toner on the transfer member can be prevented. Hence it follows that adhesion of the transfer member to the fixing unit can be prevented.

The image forming apparatus according to the second aspect of the present invention, occurrence of offset of toner on the transfer member during the fixing process can be prevented. Thus, adhesion of the transfer member to the fixing unit can be prevented.

The toner and the image forming apparatus according to the second aspect of the present invention is able to prevent liberation of the external additives from the mother particles if stress is repeatedly exerted on toner during the contact development or the contact transfer. As a result, the lifetime of toner and that of the image forming apparatus can furthermore be elongated.

Third Aspect of the Invention

Figure 22:
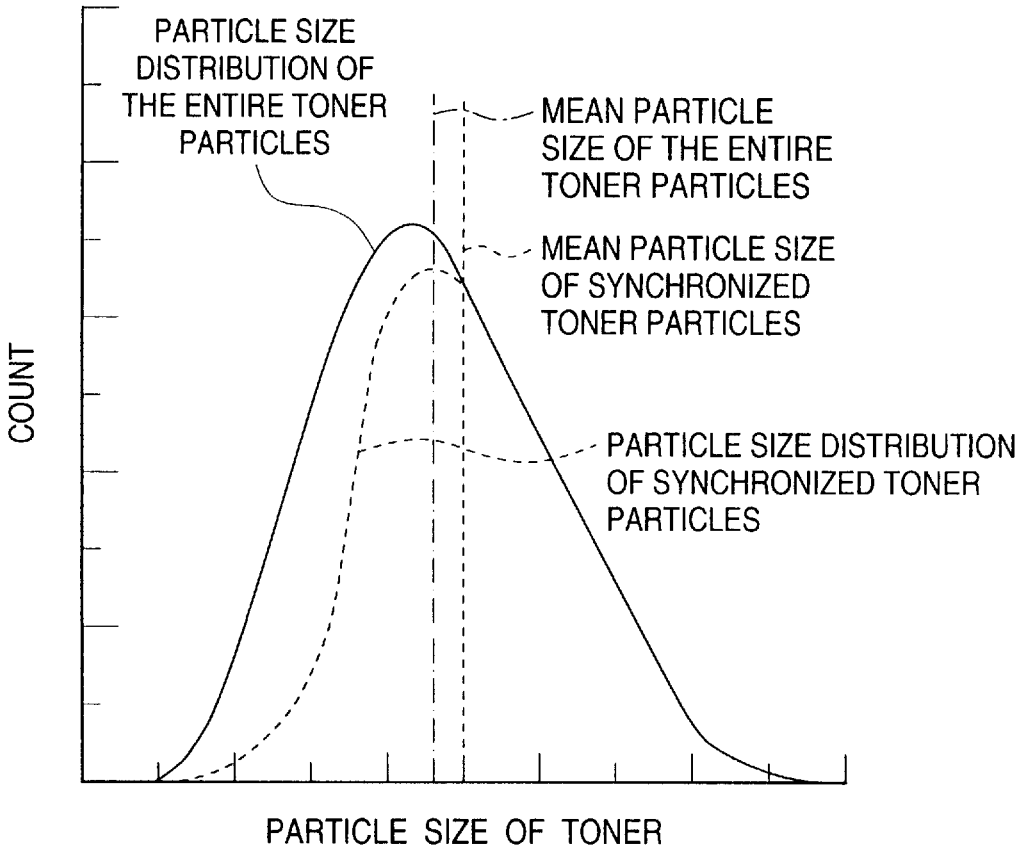
FIG. 22 is a normal distribution graph showing distribution of particle sizes of toner according to an embodiment of the present invention.

Toner T according to the third aspect of the invention has been subjected to analysis by the foregoing analyzing method. The toner according to an embodiment of this aspect of the invention comprises silica particles as the external additives. Particles of analyzed toner T is expressed such that the axis of abscissa stands for the particle sizes (the equivalent particle sizes) of toner and the axis of ordinate stands for the number of particles having the respective particle sizes. Thus, a normal distribution graph as shown in FIG. 22 is obtained. In accordance with the distribution of the particle sizes of toner, the mean particle size of toner particles (hereinafter called "external additive-synchronized toner") in which external additives adhere to the resin mother particles and the mean particle size of the entire toner particles are obtained. Toner T according to this embodiment is constituted such that the obtained mean particle size of external additive-synchronized toner particles is set to be larger than the mean particle size of the entire toner particles, as shown in FIG. 22. That is, the following relationship is satisfied.

$$\frac{\text{mean particle size of synchronized toner}}{\text{mean particle size of overall portion of toner}} > 1$$

Since the toner constituted as described above and according to this embodiment is arranged such that the mean particle size of external additive-synchronized toner particles is larger than the mean particle size of the entire toner particles, the fluidity and electrification characteristic of toner can be improved. Therefore, retention of toner T in which external additives are not allowed to adhere and which has a large particle size in the vicinity of the nip portion of the toner-regulating blade 306 which is made contact with the toner carrier 305 can be prevented. Thus, formation of a movement stripe can be prevented. As a result, a developed image having an excellent image quality can be obtained.

Figure 23:
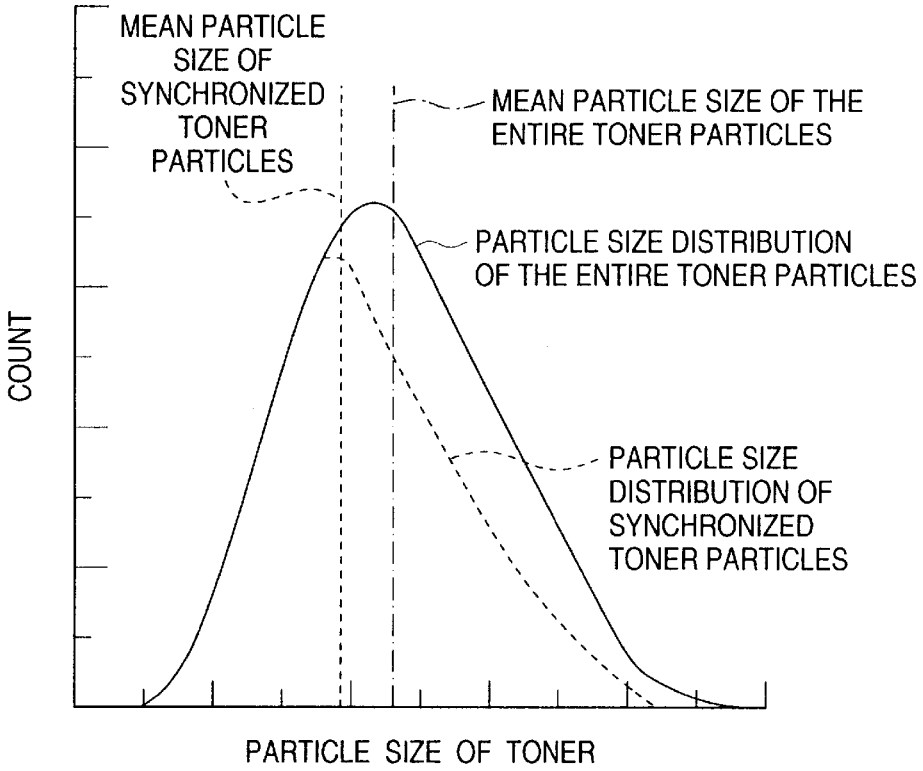
FIG. 23 is a normal distribution graph showing distribution of particle sizes of toner not according to the embodiment shown in FIG. 23.
Figure 26:
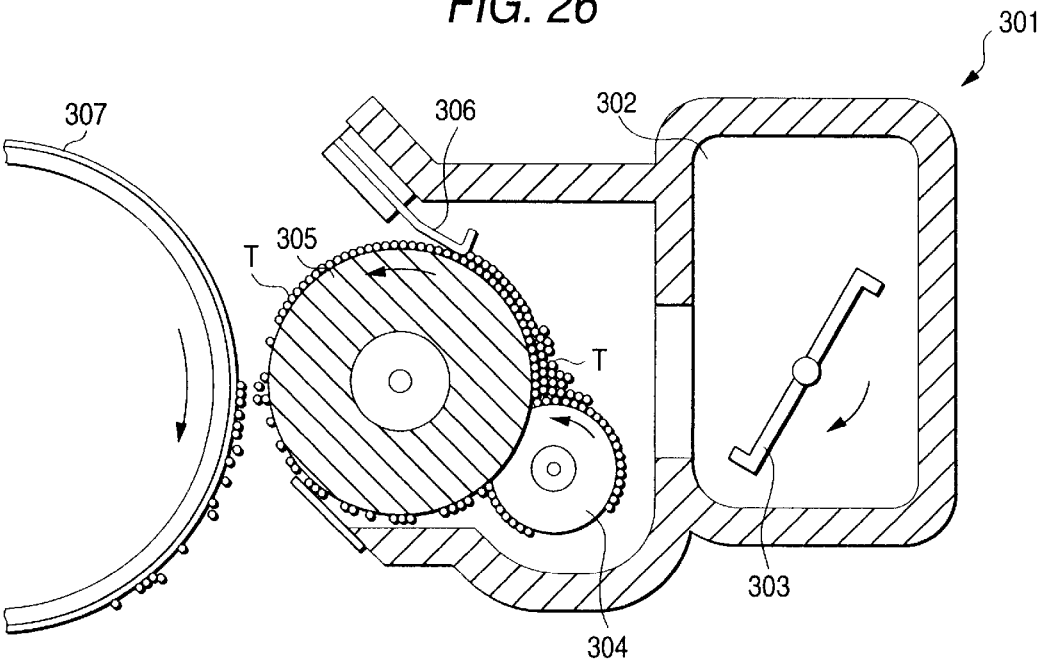
FIG. 26 is a schematic view showing a conventional development unit including a developer carrier and a toner-regulating blade.
Figure 27:
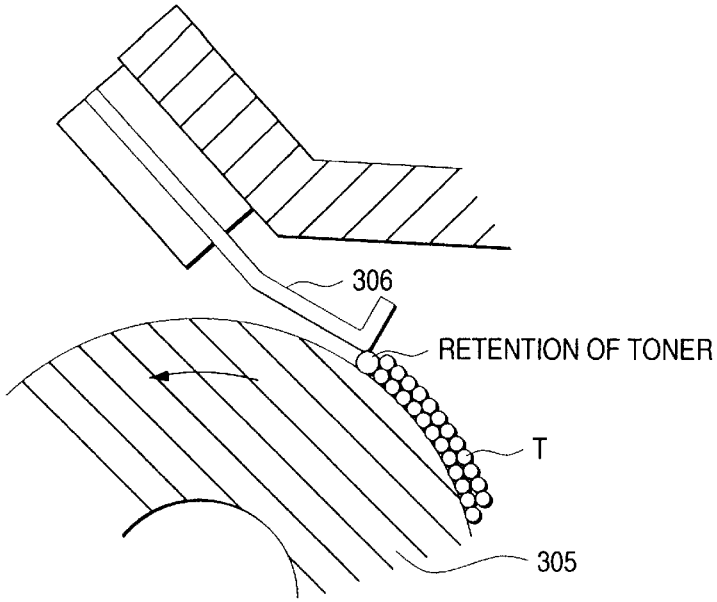
FIG. 27 is a diagram showing retention toner and movement stripes which occurrence when development is performed by the development unit shown in FIG. 8 by using conventional toner particles.

Toner T according to this embodiment and toner T constituted such that the mean particle size of the external additive-synchronized toner particles is smaller than the mean particle size of the entire toner particles as shown in FIG. 23, that is, the relationship shown below is satisfied, were used to perform development tests by using the development unit equipped with the toner-regulating blade serving as the toner-regulating member and constituted as shown in FIG. 26.

$$\frac{\text{mean particle size of synchronized toner}}{\text{mean particle size of overall portion of toner}} < 1$$

Figure 24:
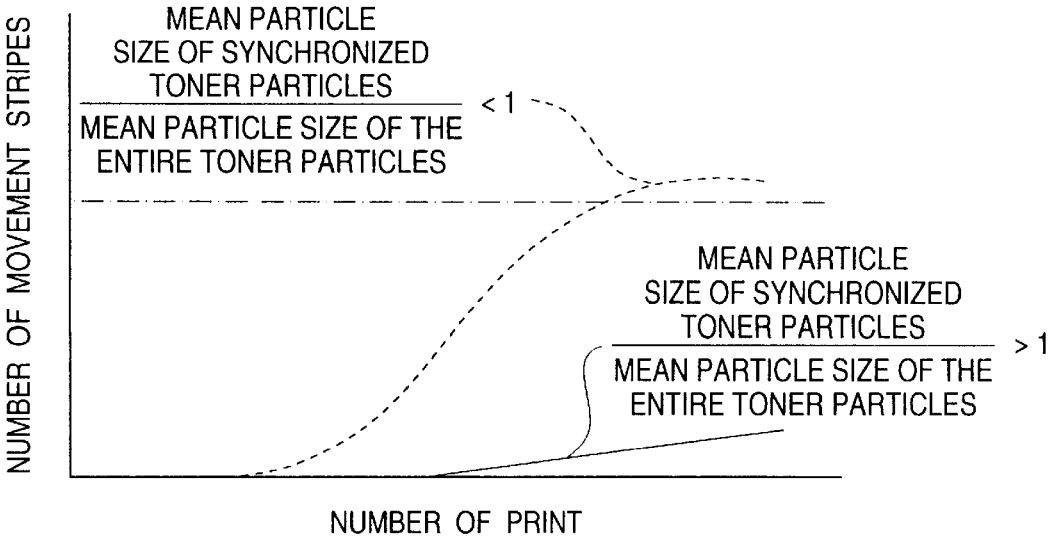
FIG. 24 is a graph showing results of development tests using toner according to the embodiment shown in FIG. 22 and toner according to the embodiment shown in FIG. 23.

Thus, results shown in FIG. 24 were obtained. The toners for use the tests were each toner comprising silica particles. Emission spectrum of Si was detected to perform measurement.

As can be understood from FIG. 24, toner T shown in FIG. 23 encounters a fact that the number of movement stripes is enlarged over a defective movement limit line which exerts an influence on the image quality after the number of prints has been enlarged. Toner T according to this embodiment (that is, toner shown in FIG. 22) forms little movement stripes by a small number which is not larger than the defective movement limit line. Thus, the fluidity and electrification characteristic of toner can be improved.

The external additives according to the third aspect of the present invention is not limited to silica fine particle. A variety of materials may be employed, as described above. When the toner analyzing test is performed, the emission spectrum of the elements, which must be detected, is appropriately selected in accordance with the material of the external additives. Thus, a similar measurement can be made by using external additives other than silica. When titanium oxide is employed to serve as the external additives, the emission spectrum of Ti must be detected and processed. When alumina is employed, the emission spectrum of Al must be detected and processed.

Figure 25:
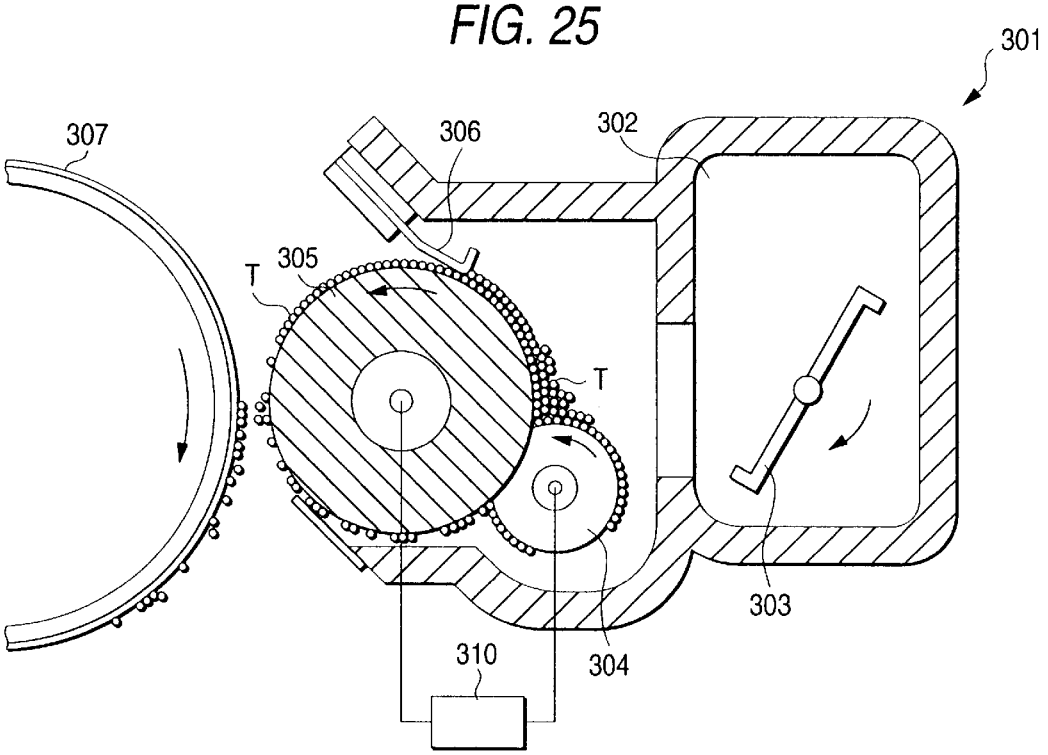
FIG. 25 is a schematic view showing another embodiment of a development unit external additives to the present invention.

FIG. 25 is a schematic view showing a development unit according to another embodiment in the third aspect of the invention, in which the toner according to the third aspect of the present invention is used.

As shown in FIG. 25, the development unit 301 according to the embodiment comprises a bias-voltage apply member 10 disposed between the toner supply member 304 and the toner carrier 305. The bias-voltage apply member 10 applies bias voltage to the space between the toner supply member 304 and the toner carrier 305 in a direction in which toner T is moved from the toner supply member 304 to the toner carrier 305 owning to the difference in the potential.

The other constitutions of the development unit 301 are the same as those of the conventional development unit shown in FIG. 26.

In the development unit 301 constituted as described above and according to this embodiment, when bias voltage is applied to the space between the toner supply member 304 and the toner carrier 305 by the bias-voltage apply member 10, the bias voltage causes movement force owning to an electrostatic force in addition to the mechanical movement force. Therefore, toner having low electrification characteristic and large particle sizes is, in a large amount, allowed to pass through the space between the toner-regulating blade 306 and the toner carrier 305 together with toner having the high electrification characteristic. As a result, selective movement of only toner having small and intermediate particle sizes to the latent-image carrier 307 can be prevented. Therefore, retention of toner having large particle sizes in the nip portion of the toner-regulating blade 306 can be prevented. Therefore, formation of a movement stripe of toner T on the toner carrier 305 can furthermore effectively be prevented.

As described above, the development unit 301 according to this embodiment is able to prevent occurrence of a movement stripe caused from toner T. Moreover, movement stripes caused from the development unit 301 can be prevented. As a result, occurrence of the movement stripes can considerably and effectively be prevented.

In the foregoing embodiments, the state of adhesion between the mother particles and the external additives of toner is analyzed by the toner analyzing method disclosed in the foregoing collection. As a matter of course, any toner analyzing method may be employed if the method is able to obtain the mean particle size of the equivalent particle sizes of the synchronized toner particles and the mean particle size of the equivalent particle sizes of the entire toner particles.

The development unit according to the present invention is not limited to the development unit 301 shown in FIG. 26. The present invention may be applied to any one of development units which comprise at least the toner supply member 304, the toner carrier 305 and the toner-regulating member (including a member other than the toner-regulating blade 306).

As can be understood from the foregoing description, toner according to the third aspect of the present invention is constituted such that the value obtained by dividing the mean particle size of toner particles in which the mother particles and the external additives are allowed to adhere to one another with the mean particle size of the entire toner particles is larger than 1. Therefore, the fluidity and electrification characteristic can considerably be improved.

The development unit according to the third aspect of the present invention uses the above-mentioned toner having satisfactory fluidity and electrification characteristic. Thus, toner particles having large particle sizes are able to pass through the space between the toner carrier and the toner-regulating member. Therefore, retention, in the nip portion of the toner-regulating member, of toner particles to which no external additive adheres and which has large particle sizes can be prevented. Therefore, formation of a movement stripe of toner in the toner carrier can be prevented. As a result, a developed image having an excellent image quality can be obtained.

The development unit according to another embodiment in the third aspect of the invention further comprises the bias voltage apply member. When bias voltage is applied to a space between the toner supply member and the toner carrier, the bias voltage causes movement force owning to an electrostatic force in addition to the mechanical movement force. Therefore, toner particles having low electrification characteristic and large particle sizes are, in a large amount, allowed to pass through the space between the toner supply member and the toner carrier together with toner particles having the high electrification characteristic. As a result, selective movement of only toner having small and intermediate particle sizes to the latent-image carrier can be prevented. Therefore, retention, in the nip portion of the toner-regulating blade, of toner particles having large particle sizes can be prevented. Therefore, formation of a movement stripe of toner on the toner carrier can furthermore effectively be prevented.

Fourth Aspect of the Invention

The toner-regulating member for use in the development unit of the image forming apparatus according to the fourth aspect of the invention may comprise a rubber or elastomer having an impact resilience of 10% or higher.

The toner T according to the fourth aspect of the invention has been subjected to analysis of toner by the foregoing analyzing method. The toner according to this embodiment comprises the external additives which are sprayed silica having the surface subjected to a process for obtaining hydrophobic characteristic. The analysis of toner is performed by using a particle analyzer to perform measurement. The particle analyzer comprises four spectrometers having two types of channels of spectrometers which are adapted to different blaze wavelengths. Therefore, if the measurement is performed with different channels, the absolute value of the particle size is deviated and indicated owning to the difference in the sensitivity of the spectrometer. Therefore, the embodiment of the present invention is attempted to prevent deviation of the absolute value of the particle size by defining the channels for use to detect elements as follows:

Mother Particles of Toner T: channel 1 or channel 2

External additives ($SiO_2$): channel 3 or channel 4

Figure 28:
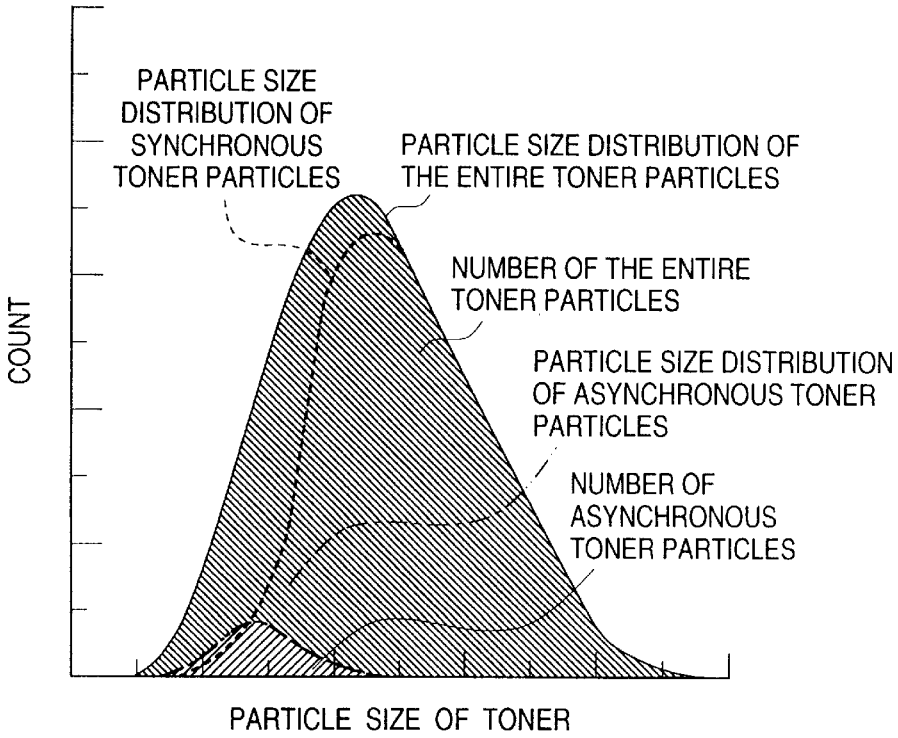
FIG. 28 is a normal distribution graph of particle sizes of toner according to the embodiment of the present invention and obtained from results of analysis shown in FIG. 1.

The toner particles analyzed as described above are shown such that the axis of abscissa stands for the particle sizes (equivalent particle sizes) of toner particles and the axis of ordinate stands for the number of particles having the above-mentioned particle sizes. Thus, a normal distribution graph of the particle sizes of toner as shown in FIG. 28 can be obtained.

Toner T of the developer for use in an embodiment of the development unit according to the present invention is described below. The number of mother particles 12 of toner indicated on the axis of abscissa of the graph shown in FIG. 3 (i.e., the total number of particles of toner T having an external additive concentration lower than a predetermined concentration and particles of toner T composed of mother particles 12 and having no external additives adhered thereto: "number of toner particles having an external additive concentration lower than a predetermined concentration" shown in FIG. 28) accounts for not more than 30% based on the number of overall particles of toner ("number of overall toner particles" shown in FIG. 28). That is, the following relationship is satisfied.

{(count of asynchronous mother particles)/(count of synchronous mother particles+count of asynchronous mother particles)}×100=30 (% by number)

As may be understood from the above, the toner particles having an external additive concentration lower than a predetermined concentration is defined as the sum of toner particles in which the external additives 13 having an equivalent particle size of not larger than about 0.8 $\mu$m adhere to the mother particles 12 and particles of toner T composed of mother particles 12 and having no external additives adhered thereto. The sum of the count of synchronous mother particles (synchronous toner particles) and the count of asynchronous mother particles is defined as the entire toner particles.

Figure 29:
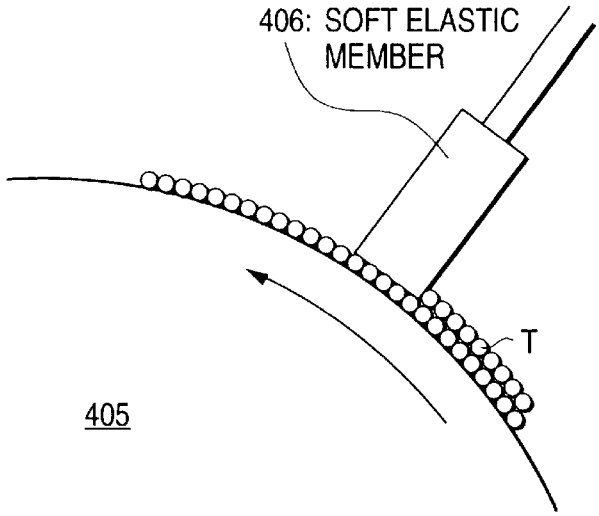
FIGS. 29(*a*)–*c* are diagrams showing a portion of the embodiment of the development unit according to the present invention, in which FIG. 29(*a*) is a diagram showing a developer-regulating member and FIGS. 29(*b*) and 29(*c*) are diagrams showing the operation of the developer-regulating member.
Figure 29:
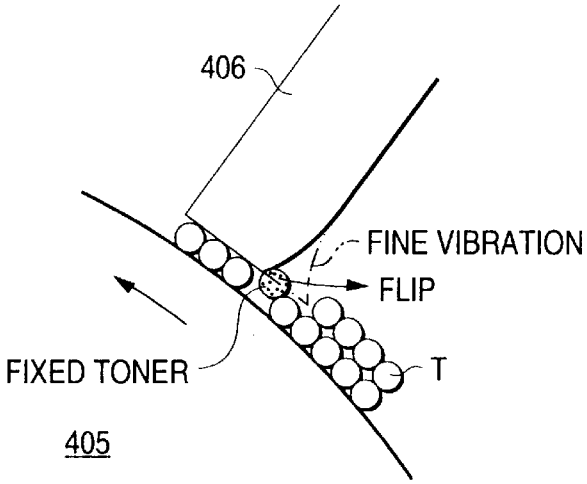
Figure 29:
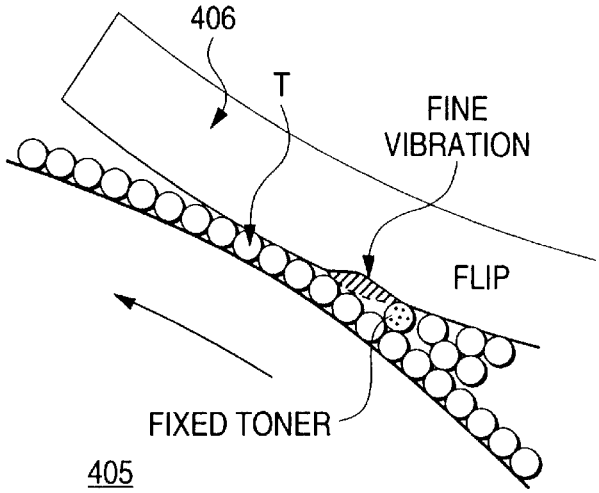

In the development unit 401 according to a second embodiment in the third aspect of the present invention, the toner-regulating member 406 comprises a soft elastic member as shown in FIG. 29(*a*). It is preferred that the soft elastic member is made of a rubber or elastomer having an impact resilience of 10% or higher. The toner-regulating member 406 is arranged to cause appropriate fine fretting phenomenon to occur at its portion which is made contact with the toner carrier 405 to be vibrated finely, as described below. The intensity of the fretting phenomenon of the toner-regulating member 406 varies depending on a state of toner existing in the vicinity of the contact portion between the toner carrier 405 and the toner-regulating member 406. The fretting phenomenon occurs when energy accumulated in the toner-regulating member 406 has raised to a predetermined level.

In case where the toner-regulating member 406 is used to be brought into contact with the toner at the edge thereof as shown in FIG. 29(*b*), it is preferable that the soft elastic member is arranged to have rubber hardness (hardness tester according to JIS-A) of 60 or lower. In case where the toner-regulating member 406 is used to be brought into contact with the toner with the body thereof as shown in FIG. 29(*c*), it is preferable that the soft elastic member has rubber hardness (hardness tester according to JIS-A) of 30 or lower.

Figure 30:
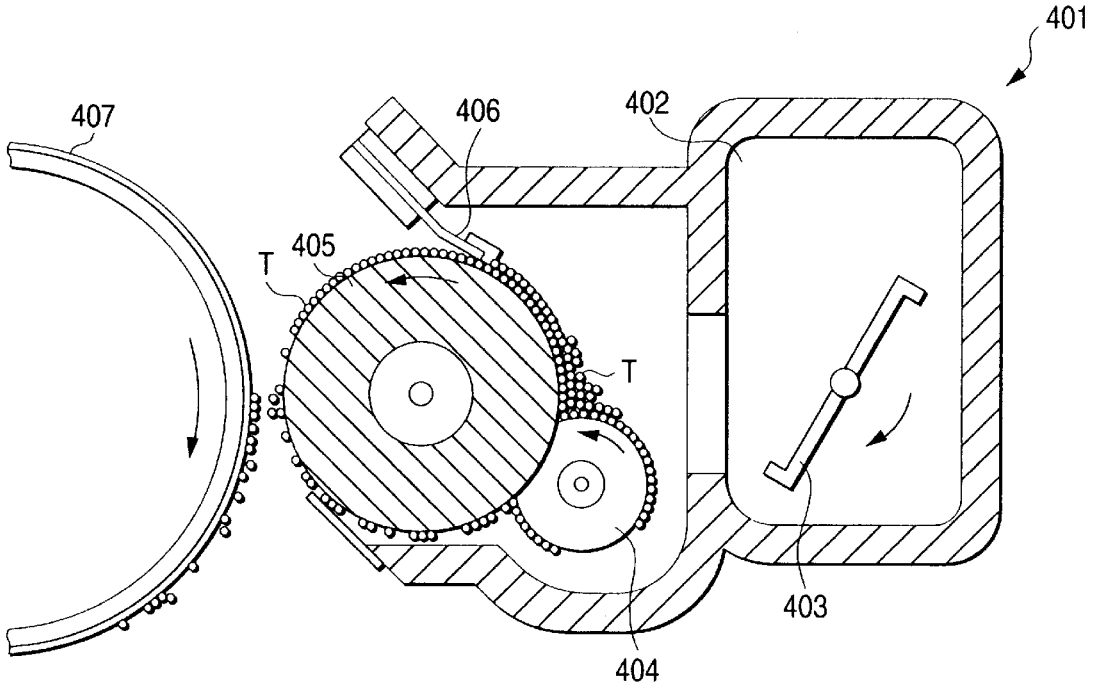
FIG. 30 is a schematic view showing a conventional one-component development unit including a developer carrier and a toner-regulating blade.
Figure 31:
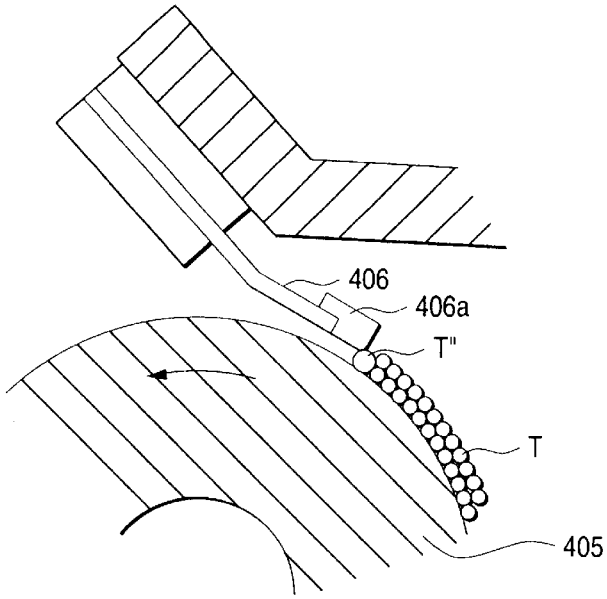
FIG. 31 is a diagram showing fixation of toner to the toner-regulating blade and unevenness in the movement of toner which occur when development is performed by the development unit shown in FIG. 30 by using conventional toner particles.

The other constitutions of the development unit 401 are the same as those of the conventional development unit shown in FIG. 30.

The development unit 401 according to this embodiment employs the above-mentioned toner T. Since toner T is employed, the toner-regulating member 406 causes adequate fretting phenomenon to occur. Thus, the toner-regulating member 406 is adequately perform fine vibrations. As shown in FIG. 29(*b*), the toner-regulating member 406 performing fine vibrations owning to the adequate and fine fretting phenomenon flips toner T. Thus, fixation of toner T to the toner-regulating member 406 can be prevented.

The development unit 401 according to the embodiment of the present invention and constituted as described above uses the foregoing toner T. Toner T is arranged such that the number of the mother particles 12 containing the external additives, the concentration of which is lower than a predetermined concentration, is 30% by number with respect to the number of the overall toner particles. When the above-mentioned toner T exists in the vicinity of the contact portion between the toner-regulating member 406 made of the soft elastic member and the toner carrier 405, toner T causes the toner-regulating member 406 to perform adequate fretting when the toner carrier 405 has been rotated. Therefore, if toner T is willing to be fixed to the toner-regulating member 406, the toner-regulating member 406 flips toner T, which is willing to be fixed to the toner-regulating member 406, owning to the fine vibrations caused from the adequate fretting, as shown in FIG. 29(*b*). Therefore, fixation of toner T to the toner-regulating member 406 can be prevented. Moreover, abrasion of the external additives 13 owning to chipping can be prevented.

The reason why toner T for use in the development unit 401 according to this embodiment causes the toner-regulating member 406 to perform adequate fretting is described below. When external additives having equivalent particle sizes larger than about 0.8 $\mu$m are allowed to adhere to the mother particles 12, the major portion of the surfaces of the mother particles 12 is covered with the external additives 13. Therefore, the areas in which the mother particles 12 are made direct contact with one another can be reduced. Moreover, the distances among adjacent toner particles can be elongated. Thus, the physical adhesive force can be reduced. To enable toner T to easily move when external force is exerted, the degree of freedom in movement of toner T is improved. When the external additives 13 have been allowed to adhere to the surfaces of the toner-regulating member 406 made of the soft elastic member, toner T having improved degree of freedom in the movement. When the foregoing toner T exists in the vicinity of the contact portion between the toner-regulating member 406 and the toner carrier 405, sliding occurs between toner T and the toner-regulating member 406. Thus, the toner-regulating member 406 performs an adequate fretting phenomenon. As a result, adequate fine vibrations occur owning to the fretting phenomenon.

If toner T containing the external additives, the concentration of which is lower than a predetermined concentration, exist in an amount of 30% by number or larger, the toner-regulating member 406 cannot easily cause the fretting phenomenon to occur. Therefore, the fine vibrations of the toner-regulating member 406 cannot be performed sufficiently. When non-covered toner composed of the mother particles 12 which are not covered with the external additives 13 and having low degree of freedom in the movement is allowed to adhere to the toner-regulating member 406, movement (flipping) of toner T owning to the external force cannot easily be performed. As a result, fixation of toner T to the toner-regulating member 406 takes place.

When only toner T composed of the external additives 13 which does not adhere to the mother particles 12 exists in the vicinity of the contact portion between the toner-regulating member 406 and the toner carrier 405, the fine particles of the external additives 13 adhere and cover the surface of the toner-regulating member 406 made of the soft elastic member (soft rubber) owning to strong electric force. Therefore, sliding between the external additives 13 allowed to adhere to the toner-regulating member 406 and the toner carrier 405 cannot easily be performed. That is, the coefficient of friction between the toner-regulating member 406 to which the external additives 13 have been allowed to adhere and the external additives 13 is undesirably raised. If the coefficient of friction between the toner-regulating member 406 and the external additives 13 is raised, the toner-regulating member 406 causes excessive fretting phenomenon to occur in the contact portion between the toner-regulating member 406 and the toner carrier 405. As a result, the contact portion of the toner-regulating member 406 encounters abrasion owning to chipping.

When only non-covered toner composed of the mother particles 12 which are not covered with the external additives 13 exists in the vicinity of the contact portion between the toner-regulating member 406 and the toner carrier 405, the toner-regulating member 406 does not cause the fretting phenomenon to occur. Therefore, the non-covered toner adheres to the toner-regulating member 406. When thermo-mechanical stress is repeatedly exerted on the non-covered toner allowed to adhere to the toner-regulating member 406, the shape of toner is undesirably changed. As a result, adjacent toner particles are joined to one another, that is, completely fixed.

When the development unit 401 according to this embodiment is constituted as described above, the toner-regulating member 406 performs adequate fretting phenomenon and adequate fine vibrations. As a result, fixation of toner T to the toner-regulating member 406 can be prevented.

Examples of the fourth aspect of the present invention were tested. Details of the tests are described below.

EXAMPLE 1

In example 1, sprayed silica having the surface subjected to a process for obtaining a hydrophobic characteristic was employed. As the toner-regulating member, urethane having an impact resilience of 14% was employed. Toner particles of five types were tested which had asynchronous toner proportions of 36.1% by number, 23.6% by number, 19.4% by number, 15.2% by number and 6.8% by number, respectively. The results are shown in Table 1.

TABLE 1

| Tests | Condition for Addition | Ratio of Asynchronous Toner (%) | Number of Prints (A4) | Unevenness in Density of Image | Fixation of Toner |
|---|---|---|---|---|---|
| 1 | A | 36.1 | 500 sheets | poor | occurred |
| 2 | B | 23.6 | 5000 sheets | good | slightly occurred |
| 3 | C | 19.4 | 10000 sheets | excellent | not occurred |
| 4 | D | 15.2 | 10000 sheets | excellent | not occurred |
| 5 | E | 6.8 | 10000 sheets | excellent | not occurred |

The regulating member was that according to Example 2-(2).

As can be understood from the results of the tests according to Example 1 and shown in Table 1, toner containing asynchronous toner at the proportion of 36.1% by number encountered fixation of toner after a relatively small number of 500 prints was made. As a result of occurrence of fixation of toner, unevenness in the density of the images occurred. Toner containing asynchronous toner at the proportion of 23.6% by number encountered slight fixation of toner after 5000 prints were made. However, no unevenness in the density of the images occurred. Substantially no influence was exerted on the image quality. Three types of toner containing asynchronous toner at 19.4% by number or lower were free from fixation of toner after 10,000 prints were made. Moreover, no unevenness in the density of the images occurred. Therefore, use of the toner-regulating member made of urethane having the impact resilience of 14% enabled fixation of toner to substantially be prevented in a case of the present invention in which the proportion of the asynchronous toner was 30% by number or lower. Moreover, unevenness of the density of images which exerts an adverse influence on the image quality did not occur. When the proportion of asynchronous toner was 20% by number or lower, satisfactory results were obtained such that fixation of toner was completely prevented and no unevenness in the density of images occurred. When the proportion of the asynchronous toner was 30% by number or lower, relatively satisfactory results were obtained. It is preferable that the proportion is 20% by number or lower.

EXAMPLE 2

In Example 2, sprayed silica having the surface subjected to a process for obtaining a hydrophobic characteristic was employed as the external additive. Moreover, toner having the proportion of asynchronous toner of 19.4% by number was employed. Moreover, three types of toner-regulating members composed of SUS having an impact resilience of 0%, urethane having an impact resilience of 14% and an impact resilience of 35%. The results are shown in Table 2.

TABLE 2

| Tests | Impact Resilience (%) | Toner | Number of Prints (A4) | Unevenness in Density of image | Fixation of Toner |
|---|---|---|---|---|---|
| 1 | 0% (SUS) | Example 1-(3) | 5000 sheets | poor | occurred |
| 2 | 14 (urethane) | Example 1-(3) | 10000 sheets | excellent | not occurred |
| 3 | 35 (urethane) | Example 1-(3) | 10000 sheets | excellent | not occurred |

As can be understood from the results of Example 2 shown in Table 2, the use of the toner-regulating member made of SUS having the impact resilience of 0% encountered fixation of toner after 5000 prints were made if toner having the proportion of asynchronous toner of 19.4% by number. Moreover, unevenness in the density of the images occurred. When the toner-regulating member made of urethane members having the impact resilience of 14% and 35%, respectively, no fixation of toner occurred and no unevenness in the density of the image occurred after 10000 prints were made. Therefore, use of toner having the proportion of asynchronous toner of 19.4% by number enables fixation of toner and unevenness in the density of images to be prevented.

EXAMPLE 3

In Example 3, sprayed silica having the surface subjected to a process for obtaining a hydrophobic characteristic was employed as the external additive. Moreover, toner having a proportion of asynchronous toner of 19.4% by number was employed. In addition, a toner-regulating member made of the urethane having the impact resilience of 14%. Thus, occurrence of fretting phenomenon was observed in two cases including a case (Test 1) in which the toner-regulating member made of the urethane having the impact resilience of 14%, and toner T was brought into contact with the edge of the toner-regulating member as shown in FIG. 29(*b*) and a case (Test 2) in which toner T was brought into contact with the body of the toner-regulating member as shown in FIG. 29(*c*). The results are shown in Table 3.

TABLE 3

| | Test 1 | Test 2 |
|---|---|---|
| Regulating Member | contact with edge | contact with body |
| Hardness of Rubber | 60 or lower | 30 or lower |

As can be understood from results of tests according to Example 3 shown in Table 3, the contact with the edge employed in Test 1 encountered easy occurrence of fretting phenomenon when the rubber hardness (the hardness tester per JIS-A) of the soft elastic member of the toner-regulating member was 60 or lower. Therefore, adequate fretting enabled the effect of flipping toner to be obtained. In the case of Test 2 in which the contact with the body encountered a fact that adequate fretting was not obtained when the rubber hardness (the hardness tester per JIS-A) of the soft elastic member of the toner-regulating member was raised. Therefore, a soft elastic member having a rubber hardness lower than that of the soft elastic member which was employed to the contact with the edge in Test 1 was required. In actual, the soft elastic member must have a rubber hardness of 30 or lower, preferably 20 or lower. When the soft elastic member having the rubber hardness of 30 or lower was employed, slight deformation occurred in the contact portion with the toner carrier. As a result, adequate fretting occurred. The adequate fretting enabled the effect of flipping toner to be obtained.

In the foregoing embodiments, the state of adhesion between the mother particles and the external additives of toner is analyzed by the toner analyzing method disclosed in the foregoing collection. As a matter of course, any toner analyzing method may be employed if the method is able to obtain the mean particle size of the equivalent particle sizes of the synchronized toner particles and the mean particle size of the equivalent particle sizes of the entire toner particles.

The development unit according to the fourth aspect of the present invention is not limited to the development unit 401 shown in FIG. 30. The present invention may be applied to any one of development units if the development unit comprises the toner carrier 405 and the toner-regulating member (including members besides the toner-regulating member 406).

The external additives according to the fourth aspect of the present invention is not limited to silica fine particle. A variety of materials may be employed, as described above. When the toner analyzing test is performed, the emission spectrum of the elements, which must be detected, is appropriately selected in accordance with the material of the external additives. Thus, a similar measurement can be made by using external additives other than silica. When titanium oxide is employed to serve as the external additives, the emission spectrum of Ti must be detected and processed. When alumina is employed, the emission spectrum of Al must be detected and processed.

As can be understood from the foregoing description, the development unit according to the fourth aspect of the present invention has the constitution that the developer contains toner in which the concentration of the external additives is lower than a predetermined concentration and the ratio of which is not higher than 30% by number with respect to the entire toner particles, and the toner-regulating member is a toner-regulating member comprising a soft elastic member. Therefore, the toner-regulating member is caused to perform adequate fine vibrations owning to adequate fretting. Thus, toner allowed to adhere to the toner-regulating member is flipped. Thus, fixation of toner to the toner-regulating member can be prevented. As a result, unevenness in movement of the developer which is performed by the toner carrier can be prevented. Moreover, occurrence of unevenness in the density of the images in the form of a longitudinal stripe caused from the unevenness in the movement can be prevented.

Since fixation of toner to the toner-regulating member can be prevented, also fixation of toner to the toner carrier can be inhibited. Thus, the durability of the development unit can be improved. Simple supply of the toner enables the development unit to be repeatedly be used for a long time.

Since the toner-regulating member is simply made of the soft elastic member, the structure of the toner-regulating member can be simplified. Thus, the cost of the toner-regulating member can be reduced. Since the necessity of wearing the toner-regulating member can be eliminated, the toner-regulating member can be used for a long time. Thus, the durability of the development unit can furthermore be improved.

Hence it follows that the development unit according to the present invention is able to quickly form images in a large amount for a long time. Moreover, images having excellent image quality can be formed.

Fifth Aspect of the Invention

The toner-regulating member for use in the development unit of the image forming apparatus according to the fifth aspect of the invention may comprise a rubber or elastomer having an impact resilience of 10% or higher.

The toner T according to the fifth aspect of the invention has been subjected to analysis of toner by the foregoing analyzing method. The toner according to this embodiment comprises the external additives which are sprayed silica having the surface subjected to a process for obtaining hydrophobic characteristic. The analysis of toner is performed by using a particle analyzer to perform measurement. The particle analyzer comprises four spectrometers having two types of channels of spectrometers which are adapted to different blaze wavelengths. Therefore, if the measurement is performed with different channels, the absolute value of the particle size is deviated and indicated owning to the difference in the sensitivity of the spectrometer. Therefore, the embodiment of the present invention is attempted to prevent deviation of the absolute value of the particle size by defining the channels for use to detect elements as follows:

Mother Particles of Toner T: channel 1 or channel 2

External additives ($SiO_2$): channel 3 or channel 4

Figure 32:
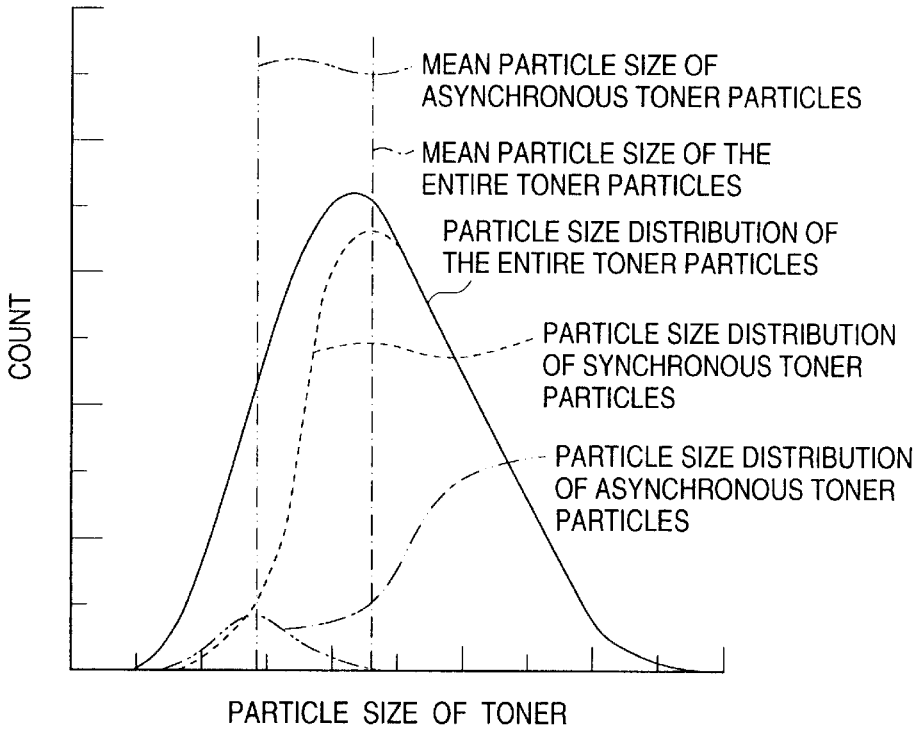
FIG. 32 is a normal distribution graph showing distribution of particle sizes of toner in accordance with the results of analysis of toner shown in FIG. 1.

The toner particles analyzed as described above are shown such that the axis of abscissa stands for the particle sizes (equivalent particle sizes) of toner particles and the axis of ordinate stands for the number of particles having the above-mentioned particle sizes. Thus, a normal distribution graph of the particle sizes of toner as shown in FIG. 32 can be obtained.

Toner T for use in an embodiment of the fifth aspect of the present invention is described below. The mean particle size of the entire toner particles indicated with an one-dot-and-dash line in FIG. 32 and the mean particle size of asynchronous toner particles (indicated on the axis of abscissa shown in FIG. 3, that is, particles of toner T in which external additives 13, the concentration of which is lower than a predetermined concentration, are allowed to adhere to the mother particles 12 and particles of toner T composed of mother particles 12 to which no external additives 13 are allowed to adhere) indicated with a two-dot-and-dash line in FIG. 32 satisfy the following relationship:

$D1/D2<2$ wherein D1 represents the mean particle size of the entire toner particles and D2 represents the mean particle size of toner particles composed of mother particles containing external additives, the concentration of which is lower than a predetermined concentration.

As may be understood from the above, the toner particles having an external additive concentration lower than a predetermined concentration is defined as the count of asynchronous mother particles, i.e., the sum of toner particles in which the external additives 13 having an equivalent particle size of not larger than about 0.8 $\mu$m adhere to the mother particles 12 and particles of toner T composed of mother particles 12 and having no external additives adhered thereto. The sum of the count of synchronous mother particles (synchronous toner particles) and the count of asynchronous mother particles is defined as the entire toner particles.

Toner T constituted as described above and according to the fifth aspect of the present invention is arranged such that the ratio of the mean particle size of the entire toner particles and the mean particle size of the mother particles 12, in which the concentration of the external additives is lower than a predetermined concentration, is less than 2. The ratio of less than 2 indicates that the toner particles having an external additive concentration less than predetermined value has a reduced proportion of particles having smaller particle sizes.

The reason why the particle size of toner T, in which the concentration of the external additives is lower than a predetermined concentration, has a reduced proportion of particles having smaller particle sizes is described below. Originally, the external additives 13 easily adhere to the mother particles 12 when the specific surface of the mother particles 12 is large and the particle size of the same is small. Since mother particles 12 having the small particle size frequently secondarily coagulated with one another, the external additives 13 cannot easily be allowed to adhere to the mother particles 12 secondarily coagulated and having the small particle size. Therefore, the mother particles 12 secondarily coagulated and having the small particle size encounter reduction in the coverage of the external additives 13. Thus, a sufficiently high concentration of the external additives cannot be realized. In actual, the mother particles 12 existing as single particles and having large particle size are easily covered with the external additives 13. Conventional toner encounters a fact that toner T, in which the concentration of the external additives is lower than a predetermined concentration, is toner having small particle sizes. Toner T according to the present invention is constituted such that mother particles 12 of toner secondarily coagulated and having the small particle size are covered with the external additives 13 with priority. To achieve this, the external additive addition process is performed under optimum shearing strength with which mother particles secondarily coagulated and having the small particle size are pulverized. If the shearing strength is excessively large and the duration of the process is too long, there arises a problem in that the external additives 13 are embedded in the mother particles 12. When the shearing strength which is exerted on the mother particles 12 and the external additives 13 during the external additive addition process and the duration of the process are optimized, the mother particles 12 having small particle size are covered with the external additives with priority without embedding of the external additives 13 in the mother particles 12. When the mother particles of toner is subjected to the external additive addition process, the particle size of toner T in which the concentration of the external additives is lower than a predetermined concentration can substantially be enlarged.

When toner T is allowed to adhere to the toner-regulating member 406 owning to physical adhesive force in the vicinity of the contact portion between the toner-regulating member 406 and the toner carrier 405, thermomechanical stress is exerted on toner T owning to repeated rubbing and sliding between the toner-regulating member 406 and the toner carrier 405 which moves at high speed. In the foregoing state, the thermal capacity of toner T is enlarge according to the large particle size. Thus, thermal deformation does not easily occur. When the particle size is furthermore enlarged, movement easily occurs owning to flow of toner. Therefore, thermomechanical stress exerted from outside can easily be dispersed to the surrounding portion. Thus, the effect of preventing change in the shape of toner can be improved. If the toner carrier 405 which is moved at high speed is brought into contact with the toner-regulating member 406 through toner T, the phenomenon that toner T adheres to adjacent toner particles and the surface of the toner-regulating member 406 can be prevented. Thus, fixation of toner T to the toner-regulating member 406 can be prevented. As a result, unevenness in the movement of toner T can be prevented.

The development unit 401 employs toner T as the developer. Therefore, fixation of toner T to the toner-regulating member 406 does not easily occur. Therefore, durability of the development unit 401 can be improved. Simple supply of toner T enables the development unit 401 to repeatedly be operated for a long time.

Toner T and the development unit 401 according to this embodiment are free from unevenness in the movement of toner T caused from the toner carrier 405. Therefore, unevenness in the density of the images in the form of a longitudinal stripe caused from the unevenness in the movement can be prevented. Thus, the image quality can be improved.

Toner T according to the fifth aspect of the present invention is constituted such that the mother particles 12 secondarily coagulated and having the small particle size are covered with the external additives 13 with priority. To achieve this, the external additive addition process is performed under the condition of the shearing strength with which the mother particles secondarily coagulated and having the small particle size are pulverized. The shearing strength with which the mother particles 12 secondarily coagulated and having the small particle size are covered with the external additives 13 is too large for the mother particles 12 having large particle sizes. Therefore, there arises a problem in that the external additives 13 are embedded in toner. To compensate the foregoing state, external additives 13 are again added after the mother particles 12 have been covered. Then, small shearing strength is set to be small strength and a post process is performed for a relatively long time.

It is preferable that the external additives 13 are previously subjected to a pulverizing process using a jet mill or the like. The external additives 13 which are again added may be made of a material other than the external additives which is the external additives 13 added first. The particle size may be different from the particle size of the external additives 13 added first.

Examples of the fifth aspect of the present invention were tested. Details of the tests are described below.

EXAMPLE 4

In Example 4, six types of toner particles were tested which were constituted such that the ratio D1/D2 of the mean particle size D1 of the entire toner particles and the mean particle size D2 of toner particles composed of the mother particles in which the concentration of the external additives was lower than a predetermined concentration was varied to 2.07, 1.92, 1.72, 1.70, 1.67 and 1.45. The results are shown in Table 4.

TABLE 4

| Tests | Additive | D1/D2 | Number of Prints (A4) | Unevenness in Density of Image | Fixation of Toner |
|---|---|---|---|---|---|
| 1 | A | 2.07 | 200 sheets | poor | occurred |
| 2 | A | 1.92 | 1000 sheets | fair | occurred slightly |
| 3 | A | 1.72 | 10000 sheets | good | occurred slightly |
| 4 | A | 1.70 | 10000 sheets | excellent | not occurred |
| 5 | B | 1.67 | 10000 sheets | excellent | not occurred |
| 6 | C | 1.45 | 10000 sheets | excellent | not occurred |

As can be understood from results shown in Table 4 and according to Example 4, toner having the ratio D1/D2 of 2.07 encountered fixation of toner even after a small number of prints 200 sheets were produced. Since fixation of toner occurred, unevenness in the density of images occurred. Toner having the ratio D1/D2 of 1.92 countered slight fixation of toner after 1000 sheets were printed. As a result of the fixation of toner, unevenness in the density of the images occurred to a degree with which substantially no adverse influence was exerted on the image quality. Toner having the ratio D1/D2 of 1.72 encountered somewhat fixation of toner after a relatively large number of 10000 prints were produced. However, substantially no unevenness in the density of the images occurred. Thus, substantially no adverse influence was exerted on the image quality. Three types of toner having the ratio D1/D2 of 1.70 or lower were free from fixation of toner after 10000 sheets were printed. Moreover, no unevenness in the density of the images occurred. Therefore, when the ratio D1/D2 is lower than 2, substantially no fixation of toner occurred and also no unevenness in the density of the image which exerts an adverse influence on the image quality occurred. In particular, the ratio D1/D2 is 1.7 or lower, no fixation of toner occurred and no unevenness in the density of the image occurred. As a result, the ratio D1/D2 must be smaller than 2. It is preferable that the ratio D1/D2 is 1.7 or lower.

In the foregoing embodiments, the state of adhesion between the mother particles and the external additives of toner is analyzed by the toner analyzing method disclosed in the foregoing collection. As a matter of course, any toner analyzing method may be employed if the method is able to obtain the mean particle size of the equivalent particle sizes of the synchronized toner particles and the mean particle size of the equivalent particle sizes of the entire toner particles.

The development unit according to the fifth aspect of the present invention is not limited to the development unit 401 shown in FIG. 29. The present invention may be applied to any one of development units if the development unit comprises at least the toner carrier 405 and the toner-regulating member (including members besides the toner-regulating member 406).

The external additives according to the fifth aspect of the present invention is not limited to silica fine particle. A variety of materials may be employed, as described above. When the toner analyzing test is performed, the emission spectrum of the elements, which must be detected, is appropriately selected in accordance with the material of the external additives. Thus, a similar measurement can be made by using external additives other than silica. When titanium oxide is employed to serve as the external additives, the emission spectrum of Ti must be detected and processed. When alumina is employed, the emission spectrum of Al must be detected and processed.

As can be understood from the foregoing description, toner according to the fifth aspect of the present invention has the constitution that the ratio of the mean particle size of the entire toner particles and the mean particle size of toner particles composed of the mother particles in which the concentration of the external additives is lower than a predetermined concentration is lower than 2. Thus, the particle size of toner in which the concentration of the external additives is lower than the predetermined concentration can substantially be enlarged. As a result, if thermo-mechanical stress is exerted on toner allowed to adhere to the toner-regulating member owning to the physical adhesive force, change in the shape of toner can be prevented.

If the toner carrier, which moves at high speed, is brought into contact with the toner-regulating member through toner, adhesion of toner to adjacent toner particles and the surface of the toner-regulating member can be prevented. Therefore, fixation of toner to the toner-regulating member can be prevented and the unevenness in the movement of the developer can be prevented.

The development unit according to the fifth aspect of the present invention uses toner as described above. Therefore, fixation of toner to the toner-regulating member can be prevented. As a result, the durability of the development unit can be improved. Thus, simply supply of the toner to the development unit enables the development unit to repeatedly be operated for a long time.

Toner and the development unit according to the present invention are able to prevent unevenness in the movement of the toner caused from the toner carrier. Moreover, occurrence of unevenness in the density of the images in the form of a longitudinal stripe caused from the unevenness in the movement can be prevented. As a result, an excellent image quality can be obtained.

Sixth Aspect of the Invention

The equivalent particle size is usually expressed by cube-root voltage. When intensity of certain emission spectrum must be converted into a voltage level to perform data-processing of the intensity, the simple conversion of the intensity of the emission spectrum into the voltage level encounters excessive enlargement of the range of the numeric value. Therefore, the cube-root voltage is employed. The cube-root voltage is a cube-root voltage of voltage obtained by converting the intensity of emission spectrum into the voltage. The cube-root voltage is a value corresponding to the particle size, that is, the equivalent particle size.

To obtain an absolute particle size from the equivalent particle size given as the cube-root voltage, that is, to obtain a mean volume particle size, the cube-root voltage must be converted into an absolute particle size. The absolute particle size can be calculated from a relationship: cube-root voltage×β(a coefficient)=absolute particle size. The coefficient β which varies depending on the substance which must be measured and obtained for each measurement. When the coefficient β of silica ($SiO_2$) for use in the foregoing toner analyzing method is obtained, silica having a large particle size (particle size: 10 μm) for use in liquid crystal is measured by using a coulter counter. Thus, the absolute particle size of silica is obtained. Moreover, the same silica is measured by a particle analyzer (for example, PT1000 manufactured by Yokogawa Electric Corporation) to obtain the cube-root voltage. In accordance with the foregoing relational expression, the absolute particle size is divided with the cube-root voltage. Thus, the coefficient β can be obtained. Then, a conversion graph between the cube-root voltages of silica and the absolute particle sizes of the same is produced. The produced conversion graph is used to obtain the absolute particle size of silica from the cube-root voltage obtained from the measurement. That is, the mean volume particle size can be obtained.

Figure 33:
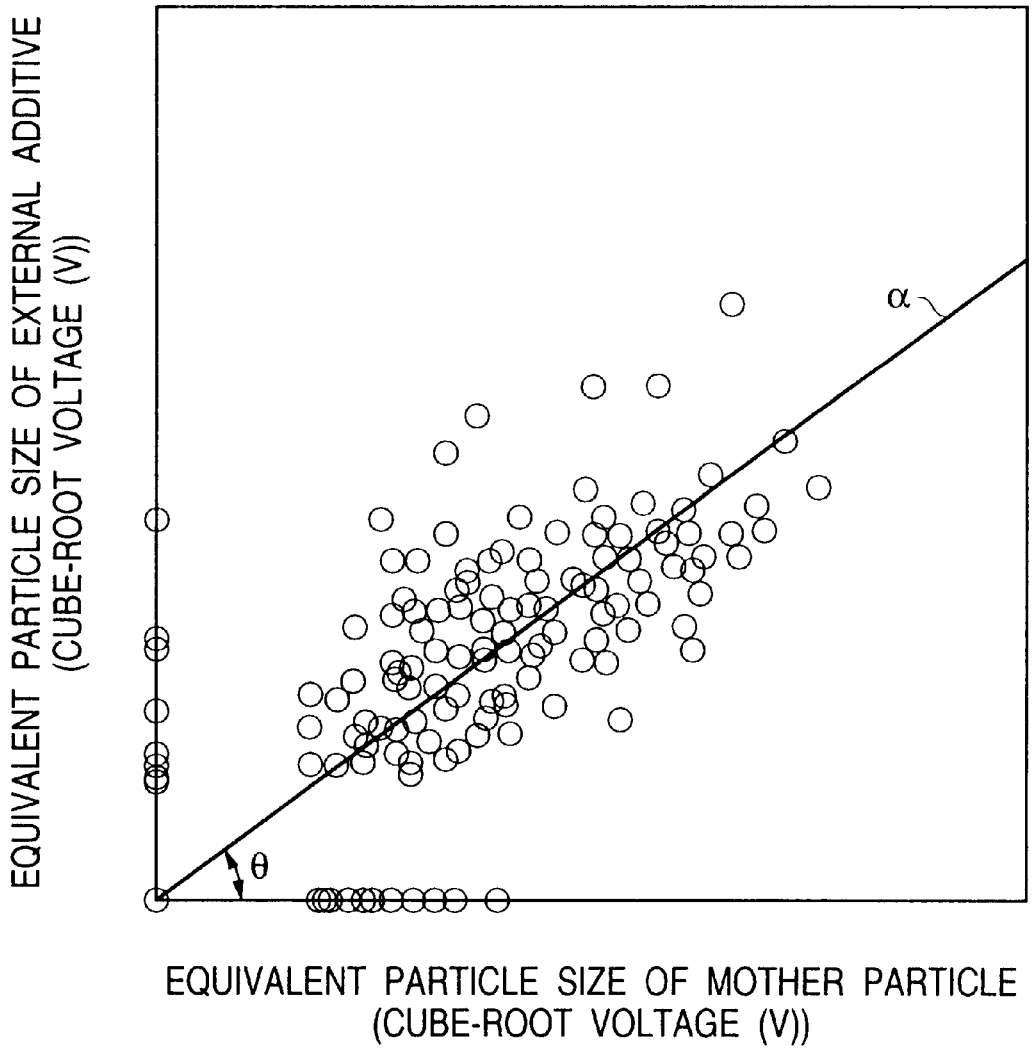
FIG. 33 is a graph showing results of analysis obtained by the toner analyzing method shown in FIG. 1 and an approximation straight Line for use to constitute toner according to the present invention.

When the equivalent particle size (the cube-root voltage) of the equivalent particle obtained from the emission spectrum of each of the mother particles and the external additives is plotted for each particle of toner T, a graph showing the distribution of equivalent particle sizes of the toner particles as shown in FIG. 33 can be obtained.

The graph shown in FIG. 33 has an axis of abscissa which stands for equivalent particle sizes of the mother particles and an axis of ordinate which stands for equivalent particle sizes of the external additives. The equivalent particles indicated on the axis of abscissa represent asynchronous mother particles to which the external additives are not allowed to adhere. On the other hand, the equivalent particles indicated on the axis of ordinate represent asynchronous external additives liberated from the mother particles. Equivalent particles deviated from the axis of abscissa and the axis of ordinate indicate synchronized toner T having the external additives allowed to adhere the mother particles.

The distribution graph of equivalent particle sizes of toner particles shown in FIG. 33 is used to analyze as state of adhesion of the external additives to the mother particles 12 of toner T. To perform the analysis, one approximation straight line α is used which is approximation of the distribution of the external additives with respect to the particle sizes of the mother particles 12 and which is obtained by the least-square method and passing through the origin, as shown in the drawing. The inclination (equivalent particle size of the external additives/equivalent particle size of the mother particles: tan θ) of the approximation straight line α indicates the concentration of the external additives 13 allowed to adhere (synchronized with) the mother particles 12. That is, the concentration of the external additives 13 is lowered as the inclination θ is reduced. In the foregoing case, the amount of the synchronized external additives 13 is small and also the particle size is small. As the inclination (tan θ) is enlarged, the concentration of the synchronized external additives 13 raised. In the foregoing case, the amount of the synchronized external additives 13 is large and also the particle size is large.

Figure 34:
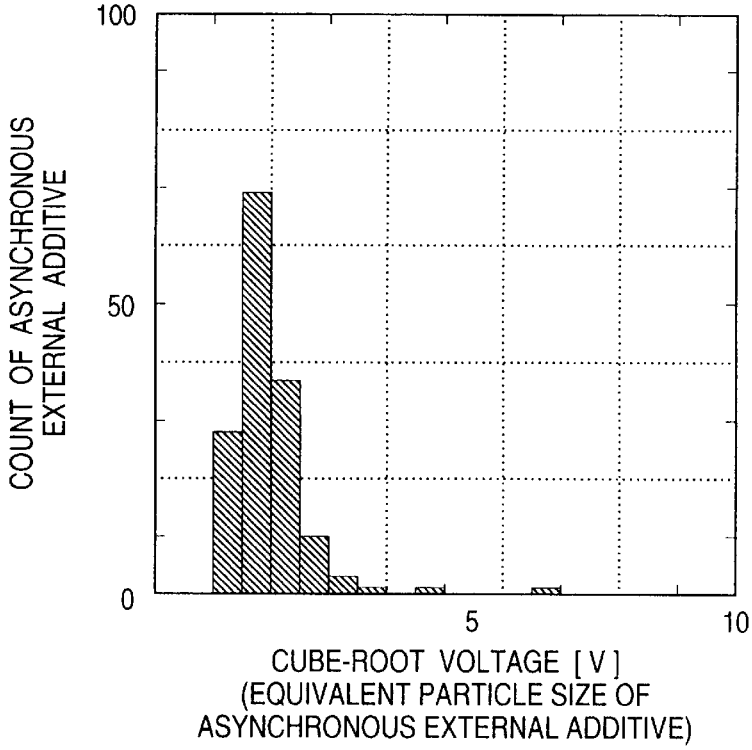
FIG. 34 is a bar graph showing the number of counted asynchronous external additives with respect to the equivalent particle sizes (cube-root voltage) of asynchronous external additives.

To indicate the size of the coagulated external additives of the liberated external additives to perform the analysis of toner T, cumulative relative frequency D50 of the liberated external additives which are asynchronous with the mother particles of toner is used. To obtain the cumulative relative frequency D50, a bar graph indicating the count of the asynchronous external additives with respect to the equivalent particle sizes (the cube-root voltage) of the asynchronous external additive-synchronized toner ($SiO_2$) on the axis of ordinate is produced as shown in FIG. 34. Then, a 50% value of the cumulative value of the bar graph is obtained. Thus, D50 (that is, a volume average particle size) of cumulative relative frequency with respect to the cube-root voltage corresponding to the particle size of the external additives can be obtained.

Toner T according to an first embodiment in the sixth aspect of the present invention comprises a plurality of mother particles and a plurality of external additive particles allowed to adhere to the mother particles, wherein an inclination (particle sizes of the external additives/particle sizes of the mother particles: tan θ) of an approximation straight line α concerning the concentration of the synchronized external additives is not smaller than 0.4, and the amount of liberated external additives is 1.0 wt % or higher. The amount of the liberated external additives is the ratio of the liberated external additives which is asynchronous with the mother particles of toner positioned on the axis of ordinate of FIG. 33, based on the overall amount of the mother particles of toner and the external additives.

Figure 41:
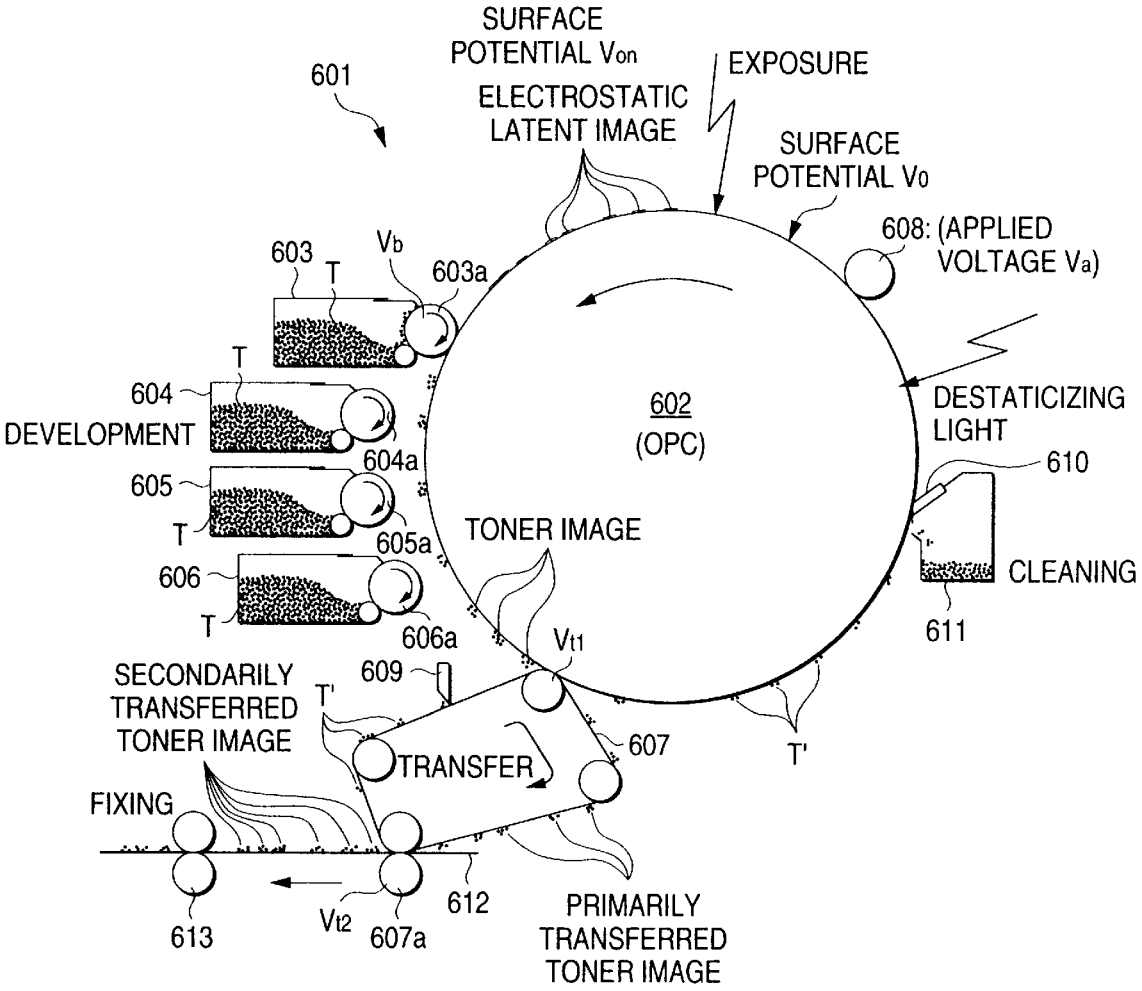
FIG. 41 is a schematic view showing an example of a conventional image forming apparatus equipped with a cleaning member.

The image forming apparatus using toner T according to the first embodiment may be a full color and intermediate transfer type color printer as shown in FIG. 41. Also another image forming apparatus other than the printer, an image forming apparatus other than the intermediate transfer type apparatus, an image forming apparatus for forming one to three color images may be employed. That is, any one of image forming apparatuses may be employed if the apparatus is arranged such that an electrostatic latent image on the OPC is developed with toner T to form a toner image on the OPC so as to transfer the toner image on the OPC so that a toner image is formed on a transfer member.

A process using toner T according to the first embodiment to form an image by the color printer 601 shown in FIG. 41 is described below referring to, for example, the case where silica ($SiO_2$) is employed as the external additives. The operation of the color printer 601 to form an image by using toner T according to the first embodiment is the same as the operation of the color printer 601 which uses conventional toner shown in FIG. 41. The above-mentioned constitution of toner T according to the first embodiment causes the difference to occur. The color printer 601 using toner T is different from the color printer 601 using conventional toner in the state of movement of toner from each of development roller 603*a*, 604*a*, 605*a* and 606*a* to the OPC 602. Moreover, a state of movement of toner from the OPC 602 to the intermediate transfer medium 607 and a state of movement of toner from the intermediate transfer medium 607 to the transfer member 612 are different.

Similarly to the conventional color printer, in the color printer 601 using toner T according to the first embodiment, silica-covered toner and liberated silica (SiO2) in the development units 603, 604, 605 and 606 are, on the development rollers 603*a*, 604*a*, 605*a* and 606*a*, electrified with development bias voltage $V_k$, and then moved to the OPC 602. In the color printer 601 according to the first embodiment, electrified liberated silica exists in the form of coagulation and in the form of adhesion to silica of the silica-covered toner. Liberated silica in the form of coagulation moved to the OPC 602 and having a small particle size and light weight is exerted with an influence of a negative electric field of the latent image on the OPC 602 before silica-covered toner on the development rollers 603*a*, 604*a*, 605*a* and 606*a* is made contact with the latent-image portion of the OPC 602. Therefore, foregoing liberated silica is moved prior to the movement of silica-covered toner to be allowed to adhere to the OPC 602 so as to be developed. Then, silica-covered toner on the development rollers 603*a*, 604*a*, 605*a* and 606*a* is moved from the development rollers 603*a*, 604*a*, 605*a* and 606*a* to the OPC 602 when the foregoing development rollers have been brought into contact with the latent image portion of the OPC 602 so as to be allowed to adhere. Thus, the latent image on the OPC 602 is developed. At this time, silica-covered toner allowed to adhere to the OPC 602 is placed on liberated silica previous allowed to adhere to the OPC 602. In the foregoing state, liberated silica allowed to adhere to the OPC 602 and silica-covered toner are moved to the intermediate transfer medium 607 applied with positive voltage.

Liberated silica on the OPC 602 moved to the intermediate transfer medium 607 is exerted with an influence of the positive electric field of the intermediate transfer medium 607 before silica-covered toner on the OPC 602 is brought into contact with the intermediate transfer medium 607. Thus, liberated silica is moved prior to the movement of the silica-covered toner to be allowed to adhere the intermediate transfer medium 607. Since liberated silica previously allowed to adhere to the OPC 602 is, at this time, interposed between the OPC 602 and silica-covered toner, the area of contact between silica-covered toner and the OPC 602 is reduced. Thus, silica-covered toner can easily be separated from the OPC 602. Moreover, the distance from the OPC 602 to the silica-covered toner is elongated. Therefore, the mirror force which acts on silica-covered toner has been weakened. Therefore, silica-covered toner on the OPC 602 is able to easily move and allowed to adhere to the intermediate transfer medium 607. That is, liberated silica previous allowed to adhere to the OPC serves as a lubricant.

Silica-covered toner allowed to adhere to the intermediate transfer medium 607 is placed on liberated silica previously allowed to adhere to the intermediate transfer medium 607, similarly to the case of the OPC 602. In the foregoing state, liberated silica and silica-covered toner allowed to adhere to the intermediate transfer medium 607 are moved to the transfer member 612 by the intermediate transfer medium 607.

Similarly to the case of the OPC 602, liberated silica previous allowed to adhere to the intermediate transfer medium 607 has been interposed between the intermediate transfer medium 607 and silica-covered toner. Therefore, liberated silica serves as the lubricant. Hence it follows that silica-covered toner on the intermediate transfer medium 607 is easily moved owning to secondarily transferred bias voltage $V_{t2}$ of the secondary transfer roller 607*a* so as to be allowed to adhere to the transfer member 612. Thus, the toner image primarily-transferred and formed on the intermediate transfer medium 607 is furthermore reliably transferred to the transfer member 612.

As described above, toner T according to the first embodiment is constituted such that the inclination (particle sizes of the external additives/particle sizes of the mother particles: tan θ) of an approximation straight by a least-square method is not smaller than 0.4. Moreover, the amount of liberated external additives is 1.0 wt % or higher. Therefore, liberated silica furthermore effectively serves as the lubricant. Therefore, the transfer efficiency can be improved owning to improvement in the separating characteristic of the toner image when the transfer is performed. Therefore, occurrence of unevenness in the color owning to missing of an intermediate portion can reliably be prevented regardless of the type of the transfer member 612 including rough paper.

When silica-covered which silica has deteriorated owning to use for a long time has been brought to a state in which silica is separated from the mother particles by a stirring member or the like in the development unit, toner according to this embodiment causes a state in which liberated silica to exist. Therefore, supplement of silica to the mother particles in which silica has been separated can effectively be performed. Therefore, an efficient transfer characteristic can be maintained for a long time. Thus, stable color development can be realized.

The external additives according to the present invention is not limited to silica fine particle. A variety of materials may be employed, as described above. When the toner analyzing test is performed, the emission spectrum of the elements, which must be detected, is appropriately selected in accordance with the material of the external additives. Thus, a similar measurement can be made by using external additives other than silica. When titanium oxide is employed to serve as the external additives, the emission spectrum of Ti must be detected and processed. When alumina is employed, the emission spectrum of Al must be detected and processed.

If the amount of liberated silica is determined as described above, the liberated silica is able to reliably exhibit the function as the lubricant. If the amount of liberated silica is enlarged, the development roller, the OPC 602 and the intermediate transfer medium 607 easily encounter filming of silica. In this case, silica cannot be sufficiently remved by the cleaning blade. Therefore, it is preferable that the amount of liberated silica is 5.0 wt % or lower.

Examples of the sixth aspect of the present invention were tested. Details of the tests are described below.

EXAMPLE 5

Four toner samples (1), (2), (3) and (4) shown in Table 5 were used to perform image forming tests using the color printer 601 as shown in FIG. 41. Moreover, toner was analyzed by using particle analyzer PT1000 manufactured by Yokogawa Electric Corporation.

Test Conditions:

Environment for Measurement: temperature: 23° C. humidity: 65% RH

Mother Particles: polyester

Amount of Added Silica (wt %) small particle-size silica (particle size: 10 nm)/large particle-size silica (particle size: 40 nm)

Voltage ($V_a$) to Electrifying Roller 608=−1.2 KV

Surface Potential $V_0$ of OPC 602=−570 V

Surface Potential $V_{on}$ of OPC 602 after recording has been performed owning to exposure=−70 V Development Bias $V_d$=−120 V (common to the four colors)

Amount of Development of Magenta and that of cyan is 0.59 mg/cm$^2$.

Primary Transfer Bias $V_{t1}$=+400 V (varied from transfer current $I_{t1}$=−300 $\mu$A to +100 $\mu$A according to electric resistance of intermediate transfer medium 607)

Also the surface potential of the intermediate transfer medium 607 is made to be almost the same level. The amount of toner when magenta and cyan have been transferred from the OPC 602 to the intermediate transfer medium 607 is 1.1 mg/cm$^2$. Therefore, the primary transfer efficiency with respect to a multilayered structure is 93%.

Current $I_{t2}$ when secondary transfer current is controlled to be a constant current=+30 $\mu$A (secondary transfer bias $V_{t2}$ can automatically be varied according to electric resistance of the transfer member)

Lower-limit bias $V_{t2}$ for secondary transfer=+1000 V (transfer current $I_{t2}$ at this time can automatically be varied to +300 $\mu$A according to the electric resistance of transfer member)

Secondary transfer bias $V_{t2}$ is applied to the secondary transfer roller 607*a* when the toner image is transferred from the intermediate transfer medium 607 to the transfer member 612.

Transfer Member:

XEROX4024 as plain paper

NEENAHBOND (U.S.A) Model No.02700 as rough paper Intermediate Transfer Medium: A belt is employed which has a structure that aluminum is evaporated to a substrate made of PET, followed by coating the substrate with a coating material having resistance adjusted with a conductive material. In the foregoing case, ends of the belt were formed by applying a carbon electrode layer on the aluminum layer in place of the coating material. The primary transfer bias $V_{t1}$ is applied from the carbon electrode layer at the end of the belt to the intermediate transfer member.

Cleaning Blade: Both of blades for the OPC and intermediate transfer belt have a structure that urethane rubber is bonded to a metal plate to clean substances at the edge of the rubber.

Figure 35:
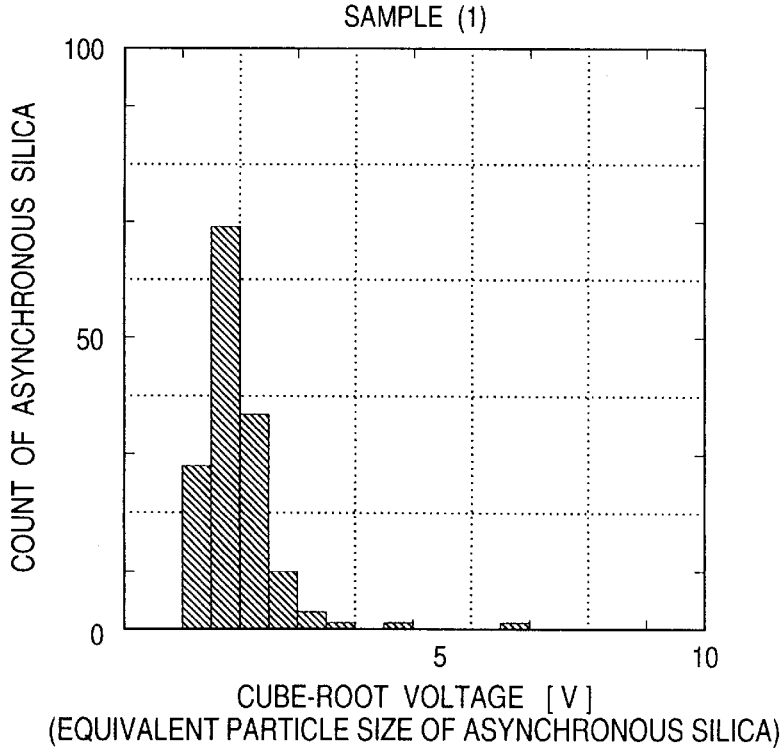
FIG. 35 is a bar graph showing results of tests of sample (1) and corresponding to FIG. 34.
Figure 36:
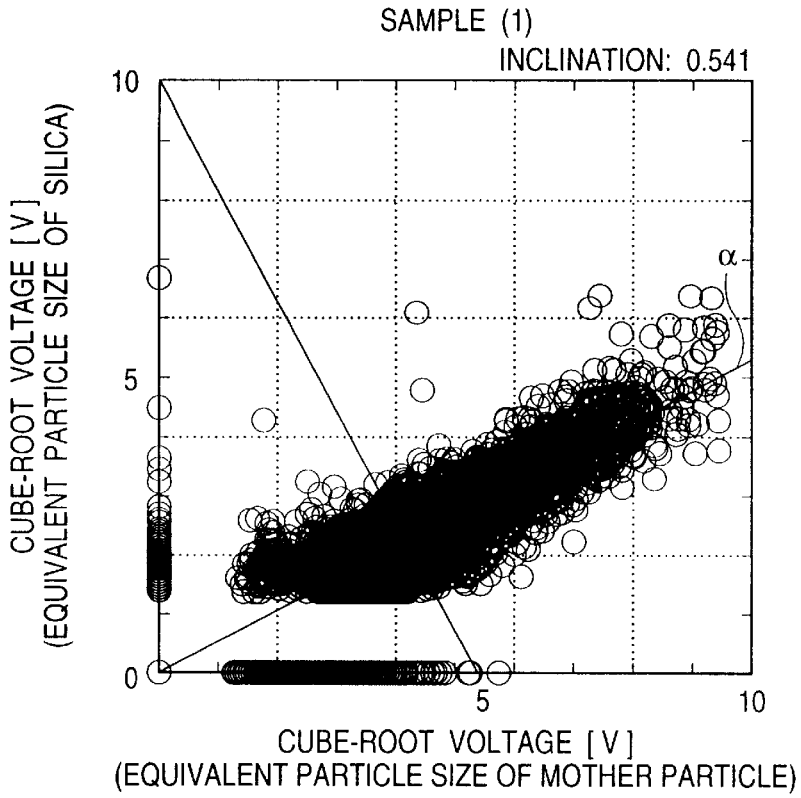
FIG. 36 is a distribution graph showing the equivalent particle sizes of toner particles showing results of tests of sample (1) and corresponding to FIG. 33.
Figure 37:
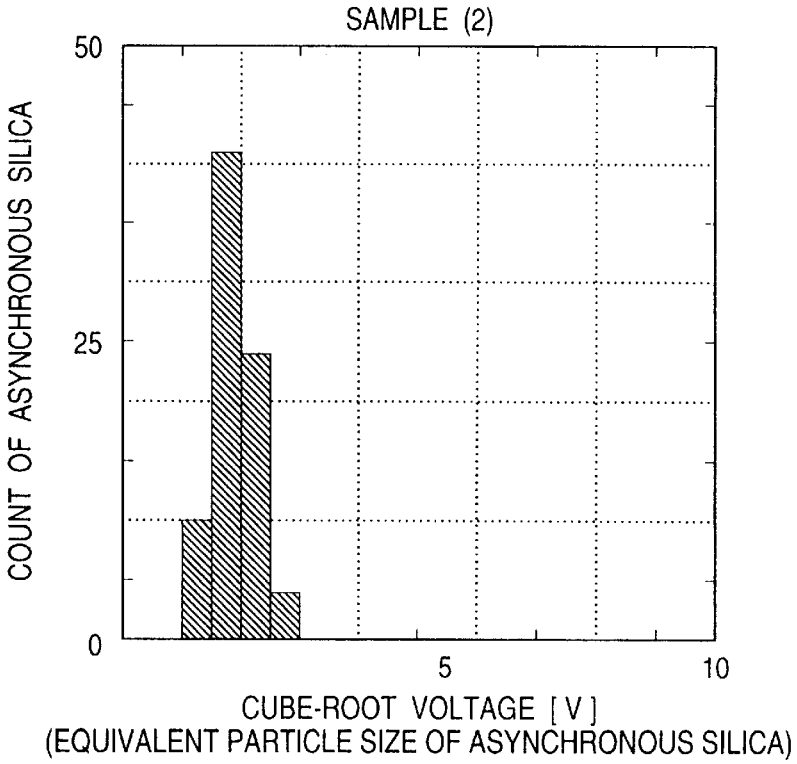
FIG. 37 is a bar graph showing results of tests of sample (2) and corresponding to FIG. 34.
Figure 38:
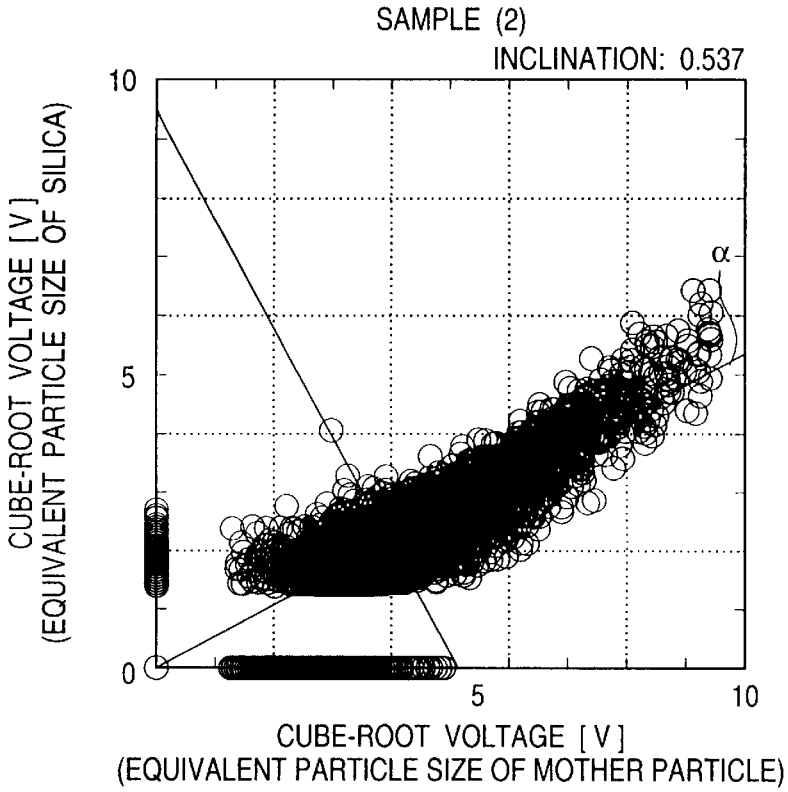
FIG. 38 is a distribution graph showing the equivalent particle sizes of toner particles showing results of tests of sample (2) and corresponding to FIG. 33.
Figure 39:
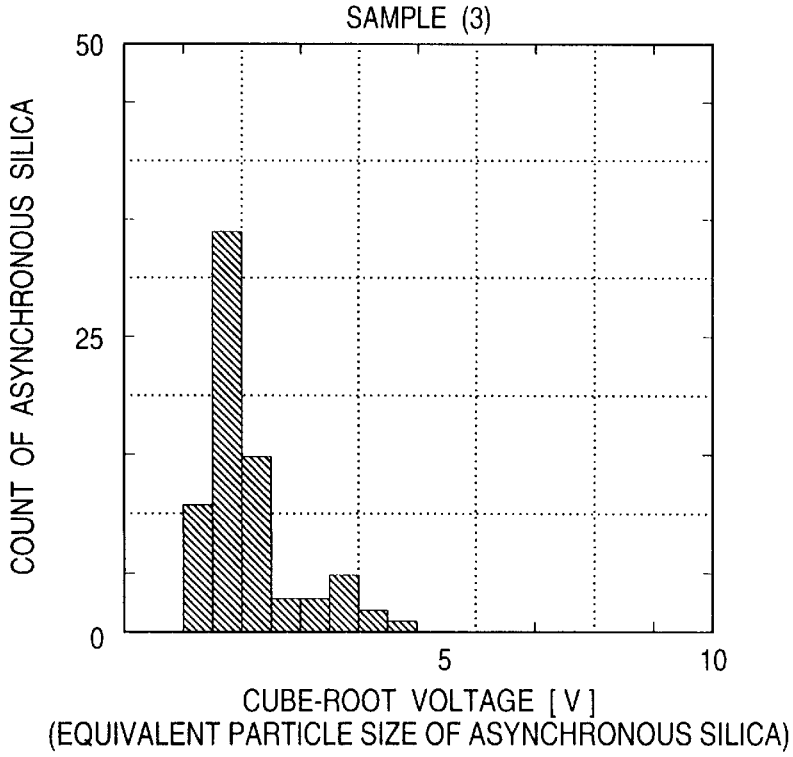
FIG. 39 is a bar graph showing results of tests of sample (3) and corresponding to FIG. 34.
Figure 40:
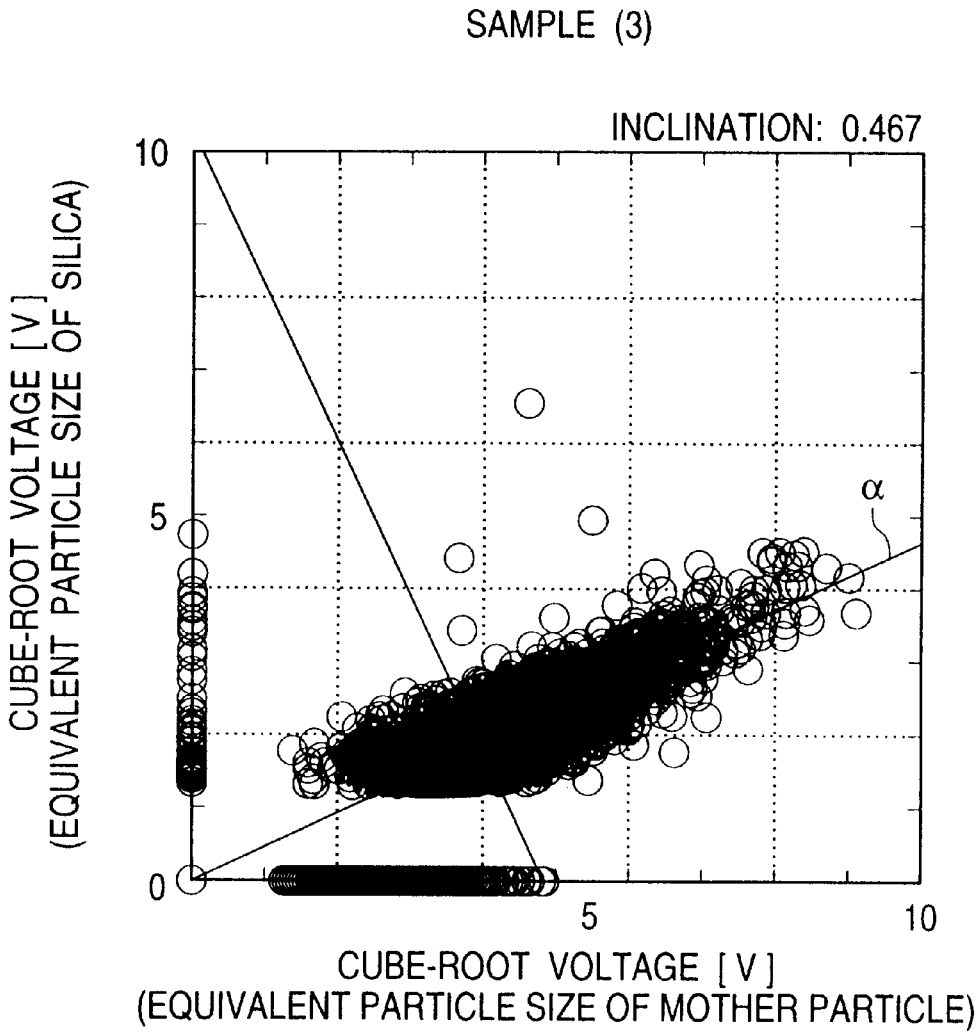
FIG. 40 is a distribution graph showing the equivalent particle sizes of toner particles showing results of tests of sample (3) and corresponding to FIG. 33.

Results of tests are shown in FIGS. 35 to 40. In the foregoing case, FIG. 35 is a bar graph corresponding to FIG. 34 showing sample (1). FIG. 36 is a graph showing distribution of equivalent particle sizes corresponding to FIG. 33 showing sample (1). FIG. 37 is a bar graph corresponding to FIG. 34 showing sample (2). FIG. 38 is graph showing distribution of equivalent particle sizes of toner particles and corresponding to FIG. 33 showing sample (2). FIG. 39 is a bar graph corresponding to FIG. 34 showing sample (3). FIG. 40 is a graph showing distribution of equivalent particle sizes of toner particles and corresponding to FIG. 33 showing sample (3).

In accordance with results of the tests shown in FIGS. 35 to 40, inclinations θ of the approximation straight line and mean volume particle sizes of liberated silica were obtained. The results are shown in Table 5 for the cases where multilayer-transfer to rough paper was performed.

TABLE 5

| Sample | Amount of Added silica (wt %) | Inclination of Approximation Straight Line α (concentration of of silica synchronized with mother particles of toner | Amount of Liberated Silica (wt %) | Efficiency of Secondary Transfer to Rough Paper | State of Transfer |
|---|---|---|---|---|---|
| (1) | 2.0/0.7 | 0.541 | 3.72% | 90% | excellent |
| (2) | 1.6/0.7 | 0.537 | 1.72% | 86% | good |
| (3) | 2.0/0.7 | 0.467 | 2.32% | 88% | good |
| (4) | 1.5/0.7 | 0.393 | 1.60% | 83% | fair |

Excellent: No color missing owning to defective transfer was observed, that is, transfer was excellent because of no difference from plain paper.
Good: Local color missing owning to defective transfer was observed. However, results of transfer was fine.
Fair: Transfer was unsatisfactory in regions in which color missing owning to defective transfer was conspicuous.
*: Amount of added silica shown in the table was small-size external additives/large-size external additives (wt %)

As can be understood from Table 5, comparison between samples (1) and (2) resulted in a fact that the densities of silica synchronized with the mother particles of toner were substantially the same. Moreover, the particle sizes of liberated silica were substantially the same. At this time, the amount of liberated silica of sample (1) was larger than that in sample (2). The efficiency of the secondary transfer to the rough paper with sample (1) was higher than the efficiency with sample (2). That is, if the densities of silica which was synchronized with the mother particles of toner and the particle sizes of liberated silica were substantially the same, the efficiency of the secondary transfer was improved as the amount of liberated silica was enlarged. Sample (2) had the constitution that the amount of added silica having the small particle sizes was made to be smaller than that of sample (1) (that is, the method of adding the external additives was changed). Thus, raising of the concentration of silica-covered toner to that of sample (1) was permitted. However, the efficiency of transfer was not improved satisfactorily.

When a comparison between samples (3) and (4) are made, results about liberated silica were substantially the same. However, the (coagulated) particle sizes of liberated silica in the form of coagulation of sample (4) were larger than those of sample (3). The efficiency of secondary transfer to the rough paper realized by sample (4) was higher than that of sample (3). That is, if liberated silica was substantially the same, the efficiency of the secondary transfer was improved as the particle sizes of liberated silica (in the form of coagulation) was enlarged.

A second embodiment of toner T according to the sixth aspect of the present invention is constituted such that the volume-based mean particle size of liberated silica ($SiO_2$) which is not allowed to adhere to the mother particles is 1.5 $\mu$m or larger. In the foregoing case, toner according to this embodiment has the constitution that when the volume-based mean particle size of liberated silica ($SiO_2$) is expressed with cubic-root voltage, the value is 1.5 V or higher.

The toner constituted as described above and according to this embodiment is brought to a state in which coagulated external additives among the liberated external additives are enlarged. As a result, coagulated external additives exist between the OPC 602 and silica-covered toner similarly to the above-mentioned embodiment. Therefore, the areas of contact between the silica-covered toner and the OPC 602 is furthermore reduced. Moreover, the distances from the OPC 602 to silica-covered toner are elongated, causing image-force to be weakened. Therefore, the liberated external additives furthermore effectively serve as the lubricant.

Therefore, the characteristic for separating the toner image can be improved when transfer is performed similarly to the foregoing embodiment. Thus, the efficiency of transfer can be improved. Moreover, occurrence of unevenness in the color owning to missing of an intermediate portion can reliably be prevented regardless of the type of the transfer member 612.

If toner according to this embodiment is brought to a state in which silica-covered toner which has deteriorated owning to use for a long time and which comprises silica separated from the mother particles by the stirring member or the like in the development unit, liberated silica exists. Therefore, supplement of silica to the mother particles from which silica has been separated can effectively be performed. Therefore, an efficient transfer characteristic can be maintained for a long time. Thus, stable color development can be realized.

EXAMPLE 6

Five types of toner samples (5), (6), (7), (8) and (9) shown in Table 6 were used to perform image forming tests by operating the color printer 601 constituted as shown in FIG. 41. Moreover, toner was analyzed by using particle analyzer PT1000 manufactured by Yokogawa Electric Corporation. The other test conditions were the same as those according to the foregoing embodiment.

The results of the tests are shown in Table 6 for the cases where multilayer-transfer to rough paper was performed.

TABLE 6

| Sample | Amount of Added Silica (wt %) | Means Volume Particle size of Liberated Silica (value of Cumulative Relative Frequency D50 Expressed with Cubic-Root Voltage) | Secondary Transfer Efficiency to Rough Paper | State of Transfer |
|---|---|---|---|---|
| (5) | 2.0/0.7 | 1.80 V | 90% | excellent |
| (6) | 2.0/0.7 | 2.34 V | 88% | good |
| (7) | 1.6/0.7 | 1.81 V | 86% | good |
| (8) | 2.0/0.7 | 1.47 V | 78% | poor |
| (9) | 1.5/0.7 | 1.52 V | 83% | fair |

Excellent: No color missing owning to defective transfer was observed and satisfactory result of transfer was obtained because no difference from plain paper.
Good: Local color missing owning to defective transfer was observed. However, satisfactory results of transfer were realized.
Fair: Color missing owning to defective transfer was conspicuous. Acceptable results of transfer were obtained.
Poor: Excessive color missing owning to defective transfer was observed. Exposure of fibers of paper was observed in a plurality of portions.
*: The amounts of silica shown in the table was small particle-size external additives/large particle-size external additives (wt %). The mean voltage particle sizes of liberated silica is absolute particle sizes (V) of "cubic-root voltage" which was an index corresponding to the volume-based particle size of liberated silica which was asynchronous with the mother particles of toner.

As can be understood from Table 6, when the mean volume particle size of liberated silica, that is, when the value of cumulative relative frequency D50 of liberated silica which is asynchronous with the mother particles of toner is 1.5 or greater, an excellent efficiency of transfer to the rough paper can be realized. When transfer to the rough paper is performed, transfer can be performed to a state in which missing of an intermediate portion cannot be observed as a defective image at least with the unaided eyes.

In the foregoing embodiments, the state of adhesion between the mother particles and the external additives of toner is analyzed by the toner analyzing method disclosed in the foregoing collection. As a matter of course, any toner analyzing method may be employed if the method is able to obtain the mean particle size of the equivalent particle sizes of the synchronized toner particles and the mean particle size of the equivalent particle sizes of the entire toner particles.

As can be understood from the foregoing description, toner according to the sixth aspect of the present invention causes liberated silica to serve as a furthermore effective lubricant. Therefore, the separating characteristic of the toner image can be improved when transfer is performed, causing the efficiency of transfer to be improved. Therefore, occurrence of unevenness in color owning to missing of an intermediate portion can effectively be prevented regardless of the type of the transfer member including the rough paper.

Toner and the image forming apparatus according to the sixth aspect of the present invention enables liberated silica to exist if silica is separated from the mother particles by the stirring member or the like in the development unit owning to deterioration in silica-covered toner caused from use of toner for a long time. Therefore, supplement of silica to the mother particles from which silica has been separated can effectively be performed. As a result, an efficient transfer characteristic can be maintained for a long time. Hence it follows that stable color development can be realized.

While the invention has been described in detail and with reference to specific examples thereof, it will be apparent to one skilled in the art that various changes and modifications can be made therein without departing from the spirit and scope thereof.

What is claimed is:

1. A toner comprising:

a plurality of mother particles; and a plurality of external additive particles to be attached to said mother particles, said external additive particles including external additive particles attached to said mother particle and external additive particles liberated from said mother particles, wherein an inclination (particle sizes of said external additives/particle sizes of said mother particles) of an approximation straight line obtained by approximating distribution of particle sizes of said external additives with respect to the particle sizes of said mother particles by a least-square method is not larger than 0.6.

2. The toner according to claim 1, the proportion of the number of said external additive particles liberated from said mother particles is not higher than 5% based on the number of the entire toner particles.

3. The toner according to claim 1, wherein a value obtained by dividing the average of the equivalent particles sizes of said external additive particles attached to said mother particle with the average of the equivalent particle sizes of the entire external additive particles is larger than 1.

4. A toner comprising:

a plurality of mother particles; and a plurality of external additive particles to be attached to said mother particles, said external additive particles including external additive particles attached to said mother particle and external additive particles liberated from said mother particles, wherein a value obtained by dividing the average of the equivalent particle sizes of said external additive particles attached to said mother particle with the average of the equivalent particle sizes of the entire external additive particles is larger than 1.

5. An image forming apparatus comprising:

a toner;

a latent-image carrier on which an electrostatic latent image is formed;

a development unit for developing the electrostatic latent image formed on said latent-image carrier by using said toner;

a transferring unit for transferring the developed image positioned on said latent-image carrier; and a cleaning member for cleaning residual toner left on said latent-image carrier after said transfer step, wherein said toner is a toner according to claim 1.

6. An image forming apparatus comprising:

a toner;

a latent-image carrier on which an electrostatic latent image is formed;

a development unit for developing the electrostatic latent image formed on said latent-image carrier by using said toner;

a transferring unit for transferring the developed image positioned on said latent-image carrier; and a cleaning member for cleaning residual toner left on said latent-image carrier after said transfer step, wherein said toner is a toner according to claim 4.

7. A toner comprising: a plurality of mother particles; and a plurality of external additive particles to be attached to said mother particles, and including toner particles comprising said mother particle having attached thereto said external additive particles and toner particles comprising said mother particle not having attached thereto said external additive particles, wherein an inclination (particle sizes of said external additive particles/particle sizes of said mother particles) of an approximation straight line obtained by approximating distribution of particle sizes of said external additive particles with respect to the particle sizes of said mother particles by a least-square method is not smaller than 0.4.

8. A toner comprising: a plurality of mother particles; and a plurality of external additive particles to be attached to said mother particles, and including toner particles comprising said mother particle having attached thereto said external additive particles and toner particles comprising said mother particle not having attached thereto said external additive particles, wherein a value obtained by dividing the mean particle size of said toner particles each comprising said mother particle having attached thereto said external additive particles with the mean particle size of the entire toner particles is larger than 1.

9. The toner according to claim 7, wherein a percentage of the number of said toner particles each comprising said mother particle having attached thereto said external additive particles and the number of the entire toner particles is not lower than 60%.

10. The toner according to claim 8, wherein a percentage of the number of said toner particles each comprising said mother particle having attached thereto said external additive particles and the number of the entire toner particles is not lower than 60%.

11. The toner according to claim 7, wherein said mother particles and said external additive particles have polarities different from each other.

12. The toner according to claim 8, wherein said mother particles and said external additive particles have polarities different from each other.

13. The toner according to claim 11, wherein the polarity of said mother particles is positive, and the polarity of said external additive particles is negative.

14. The toner according to claim 12, wherein the polarity of said mother particles is positive, and the polarity of said external additive particles is negative.

15. An image forming apparatus comprising:

a toner;

a latent-image carrier on which an electrostatic latent image is formed;

a development unit for developing the electrostatic latent image formed on said latent-image carrier by using said toner;

a transferring unit for transferring the developed image positioned on said latent-image carrier; and a fixing unit for fixing the transferred image positioned on said latent-image carrier, wherein said toner is a toner according to claim 7.

16. An image forming apparatus comprising:

a toner;

a latent-image carrier on which an electrostatic latent image is formed;

a development unit for developing the electrostatic latent image formed on said latent-image carrier by using said toner;

a transferring unit for transferring the developed image positioned on said latent-image carrier; and a fixing unit for fixing the transferred image positioned on said latent-image carrier, wherein said toner is a toner according to claim 8.

17. A development unit comprising:

a toner;

a toner carrier for carrying said toner;

a toner supply member for supplying toner to said toner carrier; and a toner-regulating member for limiting movement of toner such that a uniform thin layer of said toner is formed on said toner carrier, wherein said toner is a toner according to claim 8.

18. The development unit according to claim 17, further comprising a bias voltage apply member disposed between said toner carrier and said toner supply member and arranged to apply bias voltage in a direction in which toner is moved from said toner supply member to said toner carrier owning to the difference in the potential.

19. A development unit comprising:

a toner;

a toner carrier for carrying said toner; and a toner-regulating member for limiting movement of toner such that a uniform thin layer of said toner is formed on said toner carrier, wherein said toner comprises: a plurality of mother particles; and a plurality of external additive particles to be attached to said mother particles, and including: toner particles having an external additive concentration not lower than a predetermined concentration; and toner particles having an external additive concentration lower than a predetermined concentration wherein said toner has a proportion of the number of said toner particles having an external additive concentration lower than a predetermined concentration based on the number of the entire toner particles of not higher than 30%, and wherein said toner-regulating member comprises a soft elastic member.

20. The development unit according to claim 19, wherein said elastic member is a rubber or elastomer having an impact resilience of not lower than 10%.

21. The development unit according to claim 19, wherein when said toner-regulating member is used to contact with said toner with the edge thereof, said soft elastic member has a rubber hardness of 60 or lower, and when said toner-regulating member is used to contact with said with the body thereof, said soft elastic member has a rubber hardness of 30 or lower.

22. A toner comprising: a plurality of mother particles; and a plurality of external additive particles to be attached to said mother particles, and including: toner particles having an external additive concentration not lower than a predetermined concentration; and toner particles having an external additive concentration lower than a predetermined concentration, wherein said toner satisfy the following relationship: $D1/D2<2$ wherein D1 represents the average of the equivalent particle sizes of the entire toner particles and D2 represents the average of the equivalent particle sizes of said toner particles having an external additive concentration lower than a predetermined concentration.

23. A development unit comprising:

a toner;

a toner carrier for carrying said toner; and a toner-regulating member for limiting movement of toner such that a uniform thin layer of said toner is formed on said toner carrier, wherein said toner is a toner according to claim 22.

24. A toner comprising:

a plurality of mother particles; and a plurality of external additive particles to be attached to said mother particles, said external additive particles including external additive particles attached to said mother particle and external additive particles liberated from said mother particles, wherein an inclination (particle sizes of said external additives/particle sizes of said mother particles) of an approximation straight line obtained by approximating distribution of particle sizes of said external additives with respect to the particle sizes of said mother particles by a least-square method is not smaller than 0.4, and wherein the content of said liberated external additive particles is not lower than 1.0 wt % based on the total weight of said toner.

25. A toner comprising:

a plurality of mother particles; and a plurality of external additive particles to be attached to said mother particles, said external additive particles including external additive particles attached to said mother particle and external additive particles liberated from said mother particles, wherein said liberated external additive particles have a volume-based mean particle size of not smaller than 1.5 $\mu$m.

26. The toner according to claim 25, wherein said liberated external additive particles have a cumulative relative frequency value D50 of not lower than 1.5 V in case where the volume-based particle size of said liberated external additive particles is expressed with cubic-root voltage.

27. An image forming apparatus comprising:

a toner;

a latent-image carrier on which an electrostatic latent image is formed;

a development unit for developing the electrostatic latent image on said latent-image carrier with said toner; and a transfer unit for transferring said developed image on said latent-image carrier, wherein said toner is a toner according to claim 24.

28. An image forming apparatus comprising:

a toner;

a latent-image carrier on which an electrostatic latent image is formed;

a development unit for developing the electrostatic latent image on said latent-image carrier with said toner; and a transfer unit for transferring said developed image on said latent-image carrier, wherein said toner is a toner according to claim 25.

* * * * *

UNITED STATES PATENT AND TRADEMARK OFFICE

CERTIFICATE OF CORRECTION

PATENT NO. : 6,146,802 
DATED : November 14, 2000
INVENTOR(S) : Hideki Okada, Kazuhiro Ichikawa, Hiroshi Ito and Toshiya Takahata It is certified that error appears in the above-identified patent and that said Letters Patent is hereby corrected as shown below:

Column 18,
Line 42, change "contact" to -- mother particles --.

Signed and Sealed this

Twenty-sixth Day of March, 2002

*Attest:*

*Attesting Officer*

JAMES E. ROGAN
*Director of the United States Patent and Trademark Office*